US011166602B2

(12) United States Patent
Ohnishi

(10) Patent No.: US 11,166,602 B2
(45) Date of Patent: Nov. 9, 2021

(54) FOAM DISCHARGE CONTAINER

(71) Applicant: KAO CORPORATION, Tokyo (JP)

(72) Inventor: Hiroshi Ohnishi, Sumida-ku (JP)

(73) Assignee: KAO CORPORATION, Tokyo (JP)

( * ) Notice: Subject to any disclaimer, the term of this patent is extended or adjusted under 35 U.S.C. 154(b) by 164 days.

(21) Appl. No.: 16/336,385

(22) PCT Filed: Sep. 27, 2017

(86) PCT No.: PCT/JP2017/034883

§ 371 (c)(1),
(2) Date: Mar. 25, 2019

(87) PCT Pub. No.: WO2018/062236

PCT Pub. Date: Apr. 5, 2018

(65) Prior Publication Data

US 2021/0076884 A1 Mar. 18, 2021

(30) Foreign Application Priority Data

Sep. 29, 2016 (JP) ..... JP2016-191988
May 26, 2017 (JP) ..... JP2017-104707
Sep. 21, 2017 (JP) ..... JP2017-181346

(51) Int. Cl.
*A47K 5/16* (2006.01)
*B05B 11/00* (2006.01)
*B05B 1/02* (2006.01)

(52) U.S. Cl.
CPC ..... *A47K 5/16* (2013.01); *B05B 1/02* (2013.01); *B05B 11/0059* (2013.01); *B05B 11/0089* (2013.01); *B05B 11/3012* (2013.01)

(58) Field of Classification Search
CPC ... A47K 5/16; B05B 11/0059; B05B 11/3012; B05B 1/02; B05B 11/0089
USPC ..... 222/190
See application file for complete search history.

(56) References Cited

U.S. PATENT DOCUMENTS 3,572,591 A * 3/1971 Brown ..... B65D 83/20 239/337
3,865,283 A 2/1975 Hayes
10,625,930 B2 * 4/2020 Takahashi ..... B05B 1/14
2008/0035638 A1 2/2008 Burghaus et al.
(Continued)

FOREIGN PATENT DOCUMENTS

CN 101454223 A 6/2009
CN 102378724 A 3/2012
(Continued)

OTHER PUBLICATIONS

Extended European Search Report dated May 11, 2020 in Patent Application No. 17856185.8, 8 pages.
(Continued)

*Primary Examiner* — Donnell A Long
(74) *Attorney, Agent, or Firm* — Oblon, McClelland, Maier & Neustadt, L.L.P.

(57) ABSTRACT

A foam discharge container is a foam discharge container for discharging foam in response to a pushing operation, and includes a discharge port which is opened in a direction opposite to a pushing direction of the pushing operation and discharges foam, and a pushing portion that keeps the distance between a discharge target body receiving foam and the discharge port constant.

16 Claims, 32 Drawing Sheets

(56) References Cited

U.S. PATENT DOCUMENTS

| | | | | |
|---|---|---|---|---|
| 2008/0314931 | A1 | 12/2008 | Van Der Heijden | |
| 2012/0006857 | A1 | 1/2012 | Lee et al. | |
| 2012/0138699 | A1* | 6/2012 | Prischak | B65D 83/28 239/1 |
| 2016/0302624 | A1* | 10/2016 | Little | B65D 83/48 |

FOREIGN PATENT DOCUMENTS

| | | | |
|---|---|---|---|
| CN | 103370140 | A | 10/2013 |
| FR | 2 995 226 | A1 | 3/2014 |
| JP | 2-99795 | U | 8/1990 |
| JP | 2000-70774 | A | 3/2000 |
| JP | 2001-158488 | A | 6/2001 |
| JP | 2008-120443 | A | 5/2008 |
| JP | 2009-524558 | A | 7/2009 |
| JP | 2010-149060 | A | 7/2010 |
| JP | 5212867 | B2 | 6/2013 |
| JP | 2013-240759 | A | 12/2013 |
| JP | 5412106 | B2 | 2/2014 |
| JP | 2014-166616 | A | 9/2014 |
| JP | 2015-160667 | A | 9/2015 |
| JP | 2016-10919 | A | 1/2016 |
| JP | 2016-26962 | A | 2/2016 |
| JP | 2016-33032 | A | 3/2016 |
| JP | 2017-1678 | A | 1/2017 |
| JP | 2017-7706 | A | 1/2017 |
| JP | 2018-30601 | A | 3/2018 |
| JP | 2019-172313 | A | 10/2019 |
| TW | 200533419 | A | 10/2005 |
| TW | 201247496 | A1 | 12/2012 |
| WO | WO 2014/037533 | A1 | 3/2014 |

OTHER PUBLICATIONS

Combined Chinese Office Action and Search Report dated Nov. 18, 2019 in Chinese Patent Application No. 201780060357.0 (with English translation of Category of Cited Documents), 14 pages.

International Search Report dated Dec. 5, 2017 in PCT/JP2017/034883 filed on Sep. 27, 2017.

* cited by examiner

FOAM DISCHARGE CONTAINER

TECHNICAL FIELD

The present invention relates to a foam discharge container.

BACKGROUND ART

There have been proposed containers (foam discharge containers) in which various liquid materials (liquid agents) such as hand soap, facial cleanser, dishwashing detergent, and hair dressing agent are mixed with air to be foamed, and discharged. For example, Patent Document 1 describes a foam discharge container that discharges a liquid agent contained in the main body of the container as foam by performing a push-down operation on a head portion. In this foam discharge container, plural circular discharge ports are arranged discretely at positions corresponding to the apexes and center of a triangle or a pentagon. In this foam discharge container, the positions and the diameters of the discharge ports are set so that bubbles discharged from the plural discharge ports stick to one another to form a molded foamy object modeled on a character.

CITATION LIST

Patent Document 1 Japanese Patent Laid-Open No. 2010-149060

SUMMARY OF THE INVENTION

The present invention relates to a foam discharge container that discharges foam in response to a pushing operation, the foam discharge container including a discharge port that is opened in an opposite direction of a pushing direction of the pushing operation and discharges the foam, and a pushing portion that keeps the distance between a discharge target body receiving the foam and the discharge port constant.

Furthermore, the present invention relates a liquid agent discharge container that discharges a liquid agent in response to a pushing operation, the liquid agent discharge container including a container main body that stores a liquid agent, a liquid agent discharge cap that is mounted on the container main body and discharges the liquid agent in response to the pushing operation, wherein the liquid agent discharge cap includes a discharge port which is opened in a direction opposite of a pushing direction of the pushing operation and discharges the liquid agent, a pushing portion that keeps a distance between a discharge target body for receiving the liquid agent and the discharge port constant, and a pump portion that discharges the liquid agent from the discharge port upon movement of the container main body relative to the pushing portion in the opposite direction, and the container main body is an operating portion to be grasped and pushed by a user in the pushing operation.

DESCRIPTION OF EMBODIMENTS

Figure 1:
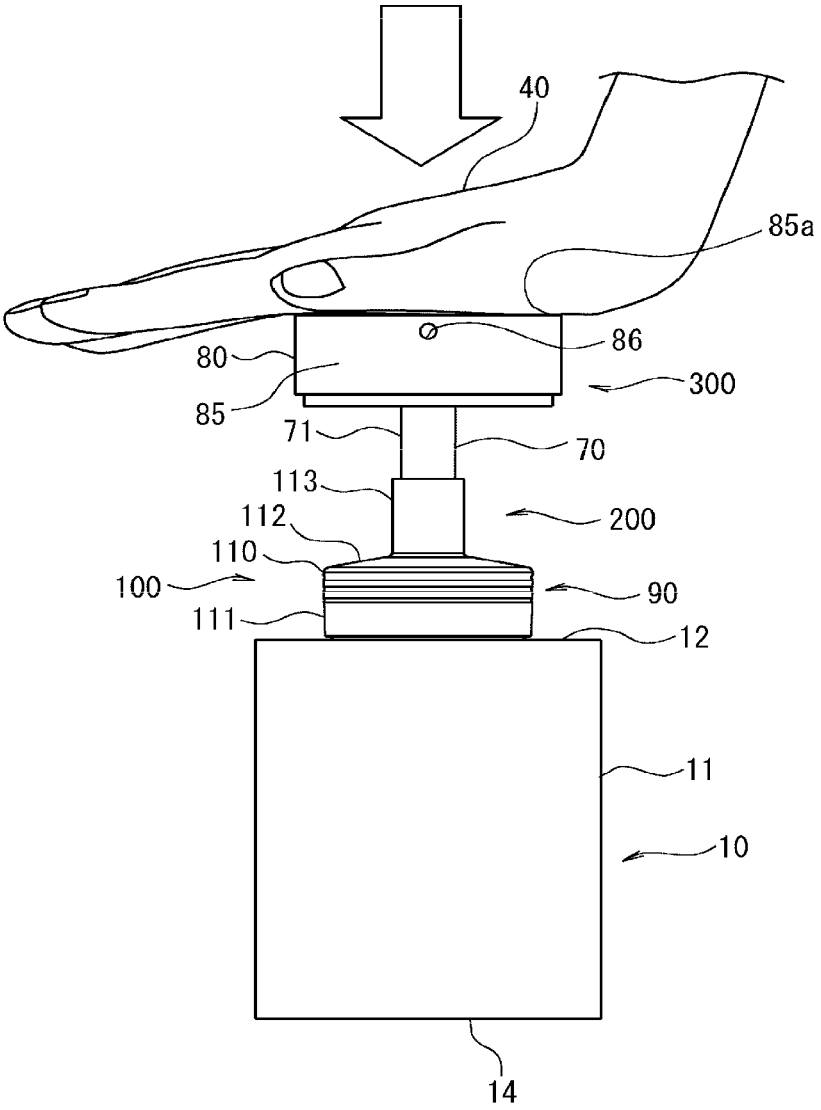
FIG. 1 is a front view showing a foam discharge container according to a first embodiment.

In the case of the foam discharge container as described above, in order to take foam in a hand, it is necessary to push down the head portion with one hand while the other hand is placed under the discharge port. That is, it is necessary to use both the hands.

Furthermore, there is the same problem with a liquid agent discharge container that discharges a liquid agent as a liquid rather than a foam.

The present invention relates to a foam discharge container, a foam discharge cap, and a foam discharge head with which foam can be received on a discharge target body such as a hand by one-hand operation.

Furthermore, the present invention also relates to a liquid agent discharge container with which a liquid agent can be received on a discharge target body such as a hand by one-hand operation.

Preferred embodiments of the present invention will be described below with reference to the drawings. In all the drawings, the similar components are represented by the same reference numerals, and duplicate description will not be repeated.

First Embodiment

First, a foam discharge container 100, a foam discharge cap 200, and a foam discharge head 300 according to a first embodiment will be described with reference to FIGS. 1 to 8.

Figure 3:
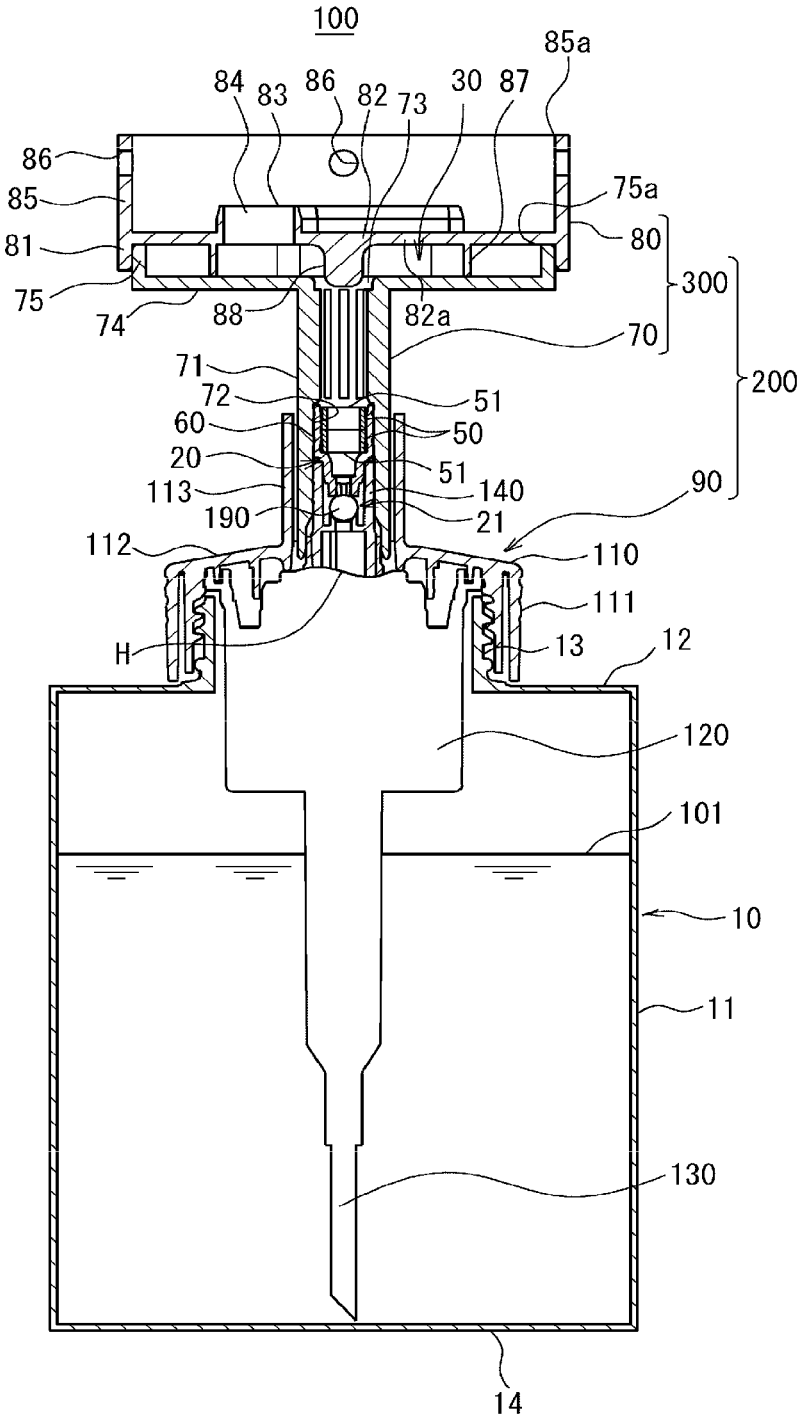
FIG. 3 is a front sectional view of the foam discharge container according to the first embodiment.

It is to be noted that the direction to a lower side is downward and the direction to an upper side is upward in FIGS. 1 and 3. That is, the direction to the lower side (downward) is the gravity direction in a state where a bottom portion 14 of the foam discharge container 100 is placed and the foam discharge container 100 stands by itself.

In FIG. 3, only an outline is shown with respect to a portion of the foam discharge cap 200 which is located below a break line H.

Figure 8:
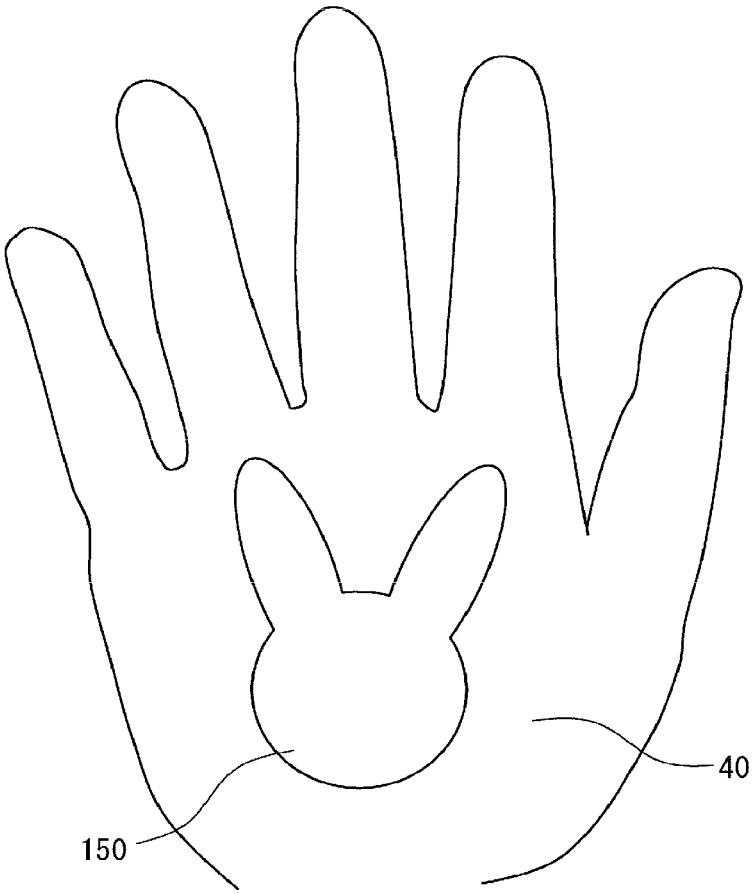
FIG. 8 is a plan view showing a state where a molded foamy object is received by a discharge target body (hand) in the first embodiment.

As shown in any one of FIGS. 1 to 4, the foam discharge container 100 is a foam discharge container 100 that discharges foam in response to a pushing operation, the foam discharge container including: a discharge port 83 that is opened in an opposite direction (upward in the present embodiment) of a pushing direction (downward in the present embodiment) of the pushing operation and discharges the foam; and a pushing portion 85 that keeps a distance between a discharge target body 40 receiving the foam (for example, a hand as shown in FIGS. 1 and 8) and the discharge port 83 constant. Accordingly, the direction opposite to the pushing direction is also the direction of discharge from the discharge port 83. In the first embodiment, the pushing direction of the pushing operation is an operating direction.

The foam discharge container 100 includes a foam discharge head 300 that discharges foam in response to the pushing operation, and the foam discharge head 300 has the pushing portion 85. The pushing portion 85 has a standing portion standing at a position which is away from the discharge port 83 in an outward direction. The pushing portion 85 has the standing portion, thereby forming a distance between the discharge port 83 and the discharge target body 40. The pushing direction is a direction in which the foam discharge head 300 is pushed relatively to the container main body 10 by the pushing operation. The outward direction is a direction from the discharge port 83 to a position on an outside of the discharge port 83 when the foam discharge head 300 is viewed from the upper side.

In the present embodiment, since the direction in which the foam discharge head 300 is pushed by the pushing operation is a downward direction, the pushing operation may be referred to as a push-down operation of the foam discharge head 300 in some cases.

Here, the pushing direction and the direction opposite to the pushing direction are not necessarily required to be different by 180 degrees on the same straight line, and they may be roughly opposite directions. Accordingly, a certain degree of axial misalignment (for example, an axial misalignment within 10 degrees) is allowed between the pushing direction and the direction opposite to the pushing direction.

Furthermore, keeping the distance between the discharge target body 40 and the discharge port 83 constant means that the distance between the discharge target body 40 and the discharge port 83 at an end stage of the pushing operation is made constant in each pushing operation. It is permitted that the distance between the discharge target body 40 and the discharge port 83 varies between the start stage and the end stage of the pushing operation. For example, it is cited that the pushing portion 85 is crushed or sags constantly due to each pushing operation. However, when the distance between the discharge target body 40 and the discharge port 83 varies between the start stage and the end stage of the pushing operation, it is preferable that the variation amount of the distance is constant in each pushing operation. In the case of the present embodiment, the whole of the foam discharge head 300 is substantially a rigid body, so that the distance between the discharge target body 40 and the discharge port 83 is kept constant from the start stage to the end stage of the pushing operation.

Furthermore, keeping the distance between the discharge target body 40 and the discharge port 83 constant means, as can be seen from FIGS. 1 and 3 and the like, keeping a state where the discharge target body 40 and the discharge port 83 are spaced apart from each other (a state where the discharge target body 40 and the discharge port 83 are not in contact with each other). The discharge target body 40 and the discharge port 83 are kept spaced apart from each other from the start stage to the end stage of the pushing operation.

According to the present embodiment, it is possible to receive foam on the discharge target body such as a hand by one-hand operation.

The foam discharge container 100 includes the container main body 10 that stores a liquid agent 101 (FIG. 3), and the foam discharge cap 200 detachably mounted on the container main body 10.

In other words, the foam discharge cap 200 is constituted by portions other than the container main body 10 in the configuration of the foam discharge container 100.

The foam discharge cap 200 is a foam discharge cap 200 that is used while mounted on the container main body 10 for storing the liquid agent 101 and discharges foam in response to the pushing operation, and includes the discharge port 83 and the pushing portion 85 described above.

Furthermore, the foam discharge cap 200 includes a cap 90 detachably mounted on the container main body 10, and the foam discharge head 300 which is used while (for example, detachably) mounted on the cap 90.

In other words, the foam discharge head 300 is constituted by portions other than the cap 90 in the configuration of the foam discharge cap 200.

The foam discharge head 300 is used while mounted on the container main body 10 for storing the liquid agent 101, discharges foam in response to the pushing operation, and includes the discharge port 83 and the pushing portion 85 described above. That is, the pushing operation is performed on the foam discharge head 300 under the state where the foam discharge head 300 is mounted on the cap 90 and the cap 90 is mounted on the container main body 10, whereby the foam discharge head 300 discharges foam.

As described later, the foam discharge head 300 is mounted on, for example, an upper end portion of a piston guide 140 equipped to the pump portion 120 of the cap 90.

In the present embodiment, a hand soap may be cited as a representative example of the liquid agent 101. However, the liquid agent 101 is not limited to the hand soap, and it is possible to exemplify various types materials used in the form of foam such as a facial cleanser, a cleansing agent, detergent for the tableware, a hair dressing agent, a body soap, a shaving cream, cosmetics for skin such as foundation and beauty essence, hair dye, disinfectant, cream to be coated on food such as bread, household detergent, disinfectant, detergent for clothes such as partial washing, etc. A viscosity of the liquid agent 101 before foaming, that is, a viscosity of the liquid agent 101 in the container main body 10 is not particularly limited, but it may be set to be equal to or more than about 1 mPa·s and equal to or less than 20 mPa·s at 20° C., for example. The viscosity of the liquid agent 101 is measured with a B type viscometer. As the B type viscometer, one having a rotor selected according to the viscosity is used. This rotor rotates at a speed of 60 revolutions per minute. The viscosity after 60 seconds from the start of the rotation of the rotor is measured.

Sponges for cleaning or coating, food such as bread to which cream or the like is coated, and the like as well as a hand may be cited as the discharge target body 40 for receiving foam having an intended shape.

The shape of the container main body 10 is not particularly limited, but the container main body 10 includes, for example, a body portion 11, a shoulder portion 12 connected to the upper end of the body portion 11, a cylindrical neck portion 13 (FIG. 3) projecting upward from a center portion of the shoulder portion 12, and a bottom portion 14 which blocks the lower end of the body portion 11. The upper end of the neck portion 13 is opened.

It is to be noted that the foam discharge container 100 is capable of self-standing while the bottom portion 14 is placed on a horizontal placement surface. In addition, foam is enabled to be discharged from the discharge port 83 by performing the push-down operation on the foam discharge head 300 while the foam discharge container 100 self-stands.

In the case of the present embodiment, the foam discharge container 100 is, for example, a manual pump container (pump foamer), and the container main body 10 stores the liquid agent 101 at atmospheric pressure. Furthermore, the foam discharge cap 200 includes a foamer mechanism 20 for foaming the liquid agent 101.

As shown in FIG. 3, the cap 90 includes a cap member 110 that is detachably mounted on the neck portion 13, a pump portion 120 that interlocks with the push-down operation of the foam discharge head 300 and operates to feed the liquid agent 101 and air to the foamer mechanism 20 and discharge foam from the discharge port 83, and a dip tube 130 for dipping up the liquid agent 101 in the container main body 10 to the pump portion 120. A suction port for sucking the liquid agent 101 in the container main body 10 is formed at the tip of the dip tube 130.

The structure of the pump portion 120 is well known, and detailed description thereof will be omitted in this specification.

Upon push-down of the foam discharge head 300, the cap 90 causes the liquid agent to foam, and discharges foam. In the present specification, a foamy liquid agent 101 is referred to as foam to be distinguished from a non-foamy liquid agent 101 stored in the container main body 10.

The cap member 110 includes a cylindrical mounting portion 111 detachably mounted on the neck portion 13 by a fastening method such as screwing, an annular blocking portion 112 for blocking the upper end portion of the mounting portion 111, and a standing tubular portion 113 that is formed in a cylindrical shape having a diameter smaller than that of the mounting portion 111 and stands upward from the center portion of the annular blocking portion 112.

It is to be noted that the mounting portion 111 may be formed in a dual cylindrical structure whose inner tubular portion is screwed to the neck portion 13, or may be formed in a single cylindrical structure. The mounting portion 111 is mounted on the neck portion 13, whereby the entire cap member 110, the entire cap 90, and consequently the entire foam discharge cap 200 are mounted on the container main body 10.

The foam discharge cap 200 is mounted on the container main body 10, whereby the opening at the upper end of the neck portion 13 is blocked by the foam discharge cap 200.

The foamer mechanism 20 includes a gas-liquid mixing portion 21 in which the liquid agent 101 fed by the pump portion 120 and air are mixed with each other. By mixing the liquid agent 101 and air in the gas-liquid mixing portion 21, the liquid agent 101 foams (foam is generated).

The pump portion 120 includes a liquid agent valve containing a ball valve 190, and this liquid agent valve is arranged to face the gas-liquid mixing portion 21.

When the push-down operation is performed on the foam discharge head 300, the ball valve 190 is pushed up to open the liquid agent valve, and the liquid agent 101 flows into the gas-liquid mixing portion 21 (that is, the liquid agent 101 is fed into the gas-liquid mixing portion 21).

Furthermore, when the liquid agent 101 is fed into the gas-liquid mixing portion 21, the pump portion 120 also performs the feed of air to the gas-liquid mixing portion 21 in parallel.

A cylindrical ring member 60 is arranged above a ball valve 190. The ring member 60 is, for example, a jet ring provided in a well-known foam discharge container, and is arranged inside a tubular portion 71 described later in such a posture that the axial direction of the ring member 60 extends vertically.

Cylindrical mesh holding rings 50 are provided, for example, at upper and lower two stages in the ring member 60. A mesh 51 is provided at each of an opening of the lower end of the lower mesh holding ring 50, and an opening of the upper end opening of the upper mesh holding ring 50.

The internal space of the ring member 60 constitutes, for example, a part of the gas-liquid mixing portion 21.

The mesh holding ring 50 and the mesh 51 constitute the foamer mechanism 20 together with the gas-liquid mixing portion 21.

As the foam generated in the gas-liquid mixing portion 21 passes through the mesh 51, the foam becomes finer and more uniform.

The foam discharge head 300 is constituted by, for example, two members such as a first head member 70 and a second head member 80 described below.

First, the first head member 70 will be described with reference to FIGS. 5A, 5B, 5C, and 5D.

Figure 5A:
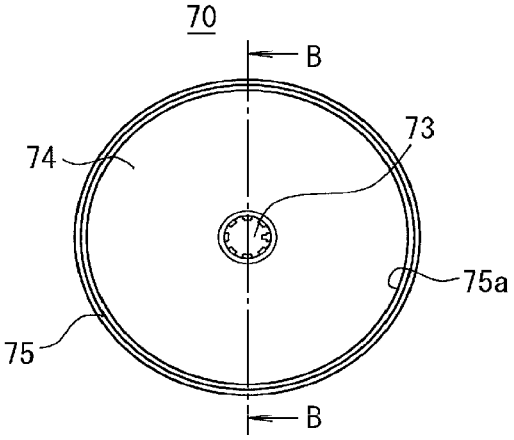
FIGS. 5A, 5B, 5C, and 5D are diagrams showing a first head member of the foam discharge container according to the first embodiment.
Figure 5B:
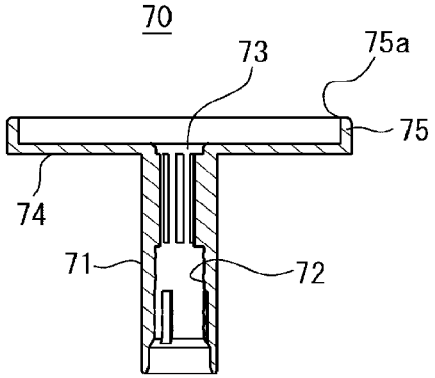
Figure 5C:
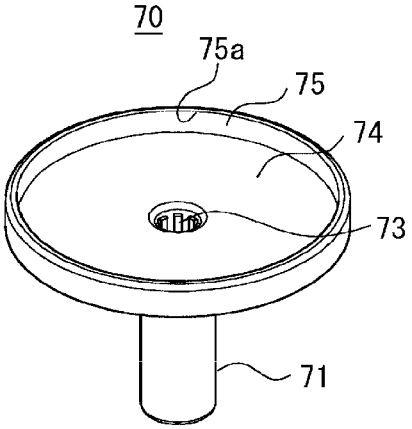
Figure 5D:
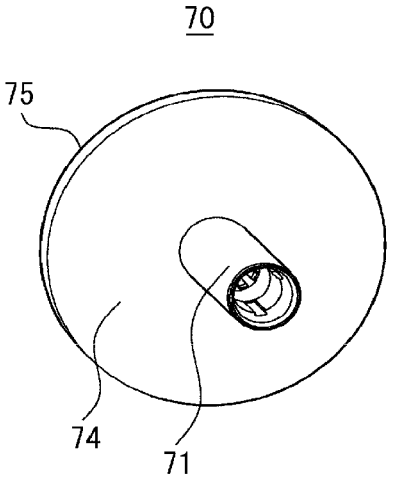

FIG. 5A is a plan view of the first head member 70, FIG. 5B is a sectional view taken along a line B-B of FIG. 5A (a side sectional view of the first head member 70), and FIG. 5C is a perspective view when the first head member 70 is viewed from an obliquely upper side, and FIG. 5D is a perspective view when the first head member 70 is viewed from an obliquely lower side thereof.

As shown in any of FIGS. 5A, 5B, 5C and 5D, the first head member 70 has, for example, a tubular portion 71 having a tubular shape (circular tubular shape), a primary plate-like portion 74 connected to the upper end of the tubular portion 71, and an annular wall 75 connected to the upper side of the primary plate-like portion 74.

The internal space of the tubular portion 71 intercommunicates with the internal space of the nozzle forming wall 84, and the tubular portion 71 supplies foam to the internal space of the nozzle forming wall 84.

Figure 4:
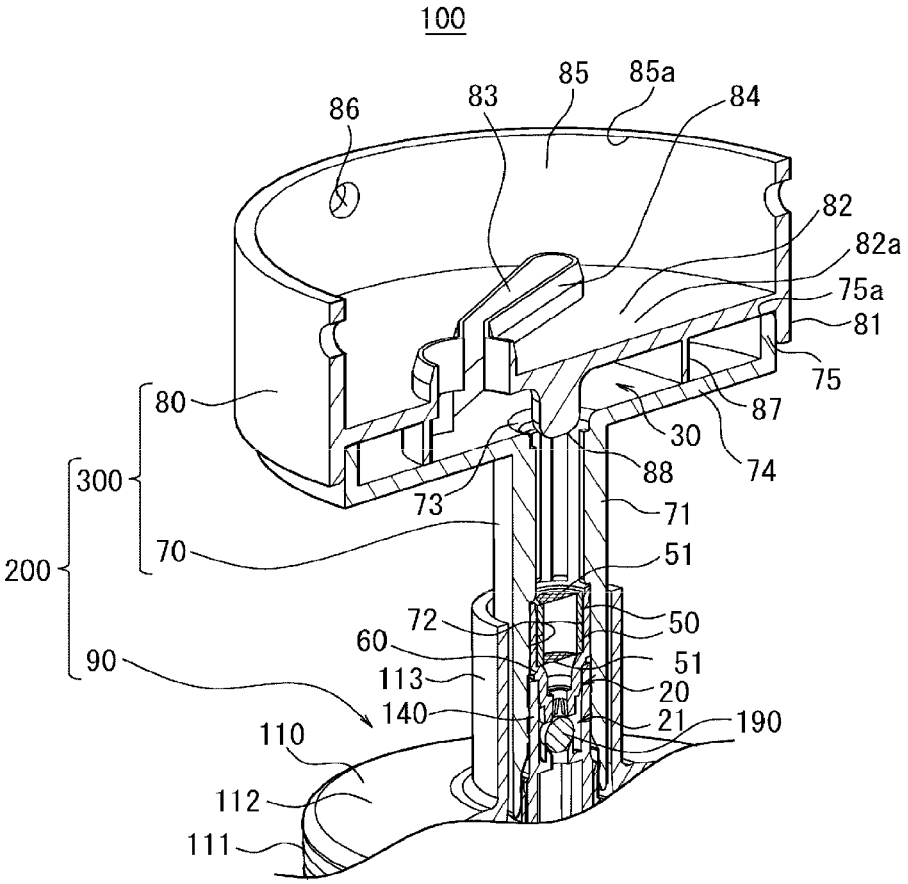
FIG. 4 is a perspective sectional view showing the foam discharge container according to the first embodiment.

The ring member 60 is held in a holding portion 72 which is a partial region of the internal space of the tubular portion 71 (see FIGS. 3 and 4). That is, the ring member 60 holding the two-stage mesh holding ring 50 is inserted into the tubular portion 71 from the lower end of the tubular portion 71 to be fixed to the holding portion 72. Plural vertical ribs for positioning the ring member 60 by restricting the upward movement of the ring member 60 are formed at an upper site of the holding portion 72 on the inner peripheral surface of the tubular portion 71 (see FIGS. 4 and 5B).

The primary plate-like portion 74 is formed, for example, in a flat-plate shape, and the plate surface of the primary plate-like portion 74 is orthogonal to the axial center of the tubular portion 71. The planar shape of the primary plate-like portion 74 is not particularly limited, but it is, for example, circular as shown in FIG. 5A.

A primary discharge port 73 is formed in a center portion of the primary plate-like portion 74. The planar shape of the primary discharge port 73 is circular, for example.

The annular wall 75 stands upward from the peripheral edge of the primary plate-like portion 74, and is formed in an annular shape in plan view. The axial center of the annular wall 75 is arranged in parallel to the axial center of the tubular portion 71, and more specifically, it is arranged coaxially with the axial center of the tubular portion 71.

An opening 75*a* is formed at the upper end of the annular wall 75.

The internal space of the annular wall 75 intercommunicates with the internal space of the tubular portion 71 via the primary discharge port 73 of the primary plate-like portion 74.

Next, the second head member 80 will be described with reference to FIGS. 6A, 6B, 6C, and 6D.

Figure 6A:
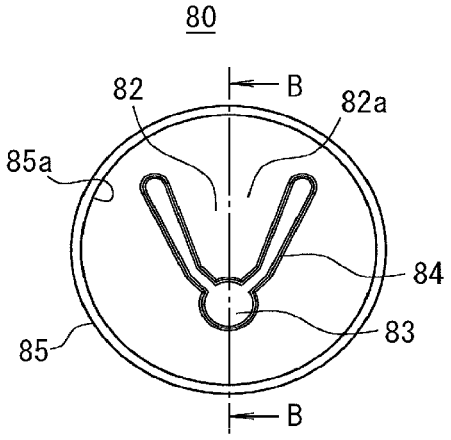
FIGS. 6A, 6B, 6C, and 6D are diagrams showing a second head member of the foam discharge container according to the first embodiment.
Figure 6B:
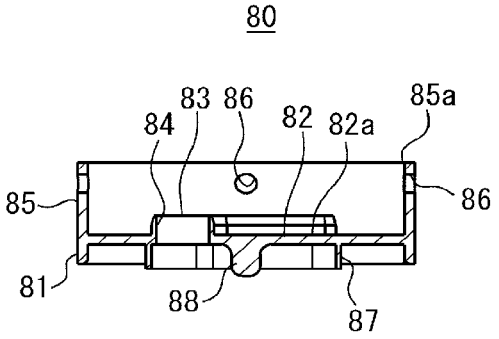
Figure 6C:
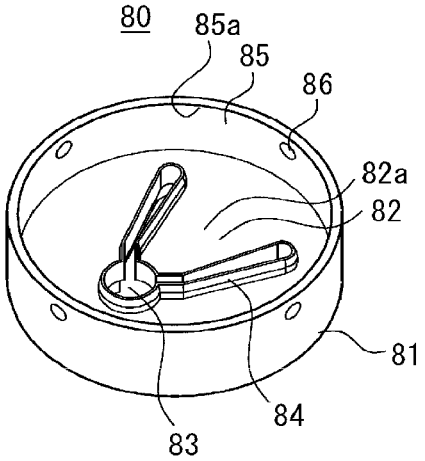
Figure 6D:
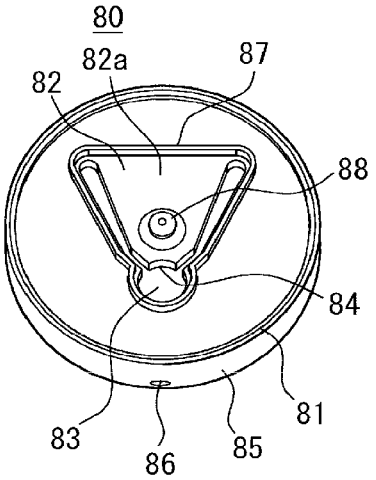

FIG. 6A is a plan view of the second head member 80, FIG. 6B is a sectional view taken along a line B-B of FIG. 6A (side sectional view of the second head member 80), FIG. 6C is a perspective view when the second head member 80 is viewed from an obliquely upper side thereof, and FIG. 6D is a perspective view when the second head member 80 is viewed from an obliquely lower side thereof.

As shown in any one of FIGS. 6A, 6B, 6C, and 6D, the second head member 80 includes, for example, a facing portion 82, an annular wall 81 extending downward from a peripheral edge portion of the facing portion 82, a pushing portion 85 extending upward from the peripheral edge portion of the facing portion 82, and a surrounding wall 87 extending downward from the facing portion 82 inside the annular wall 81.

The facing portion 82 includes a plate-like portion 82*a* having a flat-plate shape that is arranged so as to face the primary discharge port 73 of the first head member 70, and a discharge port 83 for discharging foam is formed in the plate-like portion 82*a*.

The facing portion 82 further includes a nozzle forming wall 84 standing upward from the plate-like portion 82*a*, and a protruding portion 88 protruding downward from the plate-like portion 82*a* inside the surrounding wall 87.

In the plate-like portion 82*a*, an opening penetrating vertically is formed at an inner portion of the nozzle forming wall 84 in plan view. An opening at the tip of the nozzle forming wall 84 constitutes the discharge port 83. That is, a space below and a space above the facing portion 82 intercommunicate with each other through the opening of the plate-like portion 82*a*, the internal space of the nozzle forming wall 84 and the discharge port 83.

The height of the pushing portion 85 is larger than the height of the nozzle forming wall 84. The height of the pushing portion 85 is the protruding length of the pushing portion 85 from the plate-like portion 82*a*, and is also the difference in height between the upper surface of the plate-like portion 82*a* and the upper end of the pushing portion 85. Furthermore, the height of the nozzle forming wall 84 is the protruding length of the nozzle forming wall 84 from the plate-like portion 82*a*, and is also the difference in height between the upper surface of the plate-like portion 82*a* and the upper end of the nozzle forming wall 84.

That is, the pushing portion 85 extends beyond the discharge port 83 in an opposite direction (upward) of the pushing direction of the pushing operation.

That is, the discharge port 83 is formed at the tip of the nozzle forming wall 84 standing in the opposite direction, and the pushing portion 85 extends beyond the discharge port 83 in the opposite direction. The pushing portion 85 stands more highly as compared with the nozzle forming wall 84 that has the discharge port 83 and stands in the direction opposite to the pushing direction.

The planar shapes of the nozzle forming wall 84 and the discharge port 83 are not particularly limited. When the planar shapes of the nozzle forming wall 84 and the discharge port 83 are circular, circular foam can be discharged. Furthermore, even when the planar shapes of the nozzle forming wall 84 and the discharge port 83 are non-circular, foam having shapes corresponding to the planar shapes can be discharged.

That is, the nozzle forming wall 84 and the discharge port 83 are formed to have shapes corresponding to an intended shape of the foam.

Furthermore, the discharge port 83 is not limited to one (single) opening, and may be an aggregate of plural mutually openings which are independent of one another.

Furthermore, the shapes of the nozzle forming wall 84 and the discharge port 83 are not necessarily the same as the intended shape of the foam. In order to form specific three-dimensional foam, it is preferable that the discharge port 83 is configured to have a non-circular shape or include plural openings. Here, the discharge port 83 including plural openings means that the discharge port 83 includes plural openings arranged independently of one other.

In the case of the present embodiment, the discharge port 83 shapes foam into a predetermined intended shape and discharges the foam. Here, shaping of foam into a predetermined intended shape means shaping of foam into a non-circular shape. Accordingly, the foam discharged from the discharge port 83 has been formed in a predetermined intended shape, and thus the foam has a non-circular shape. The foam having a non-circular shape means that the shape of the foam in plan view is non-circular. The non-circular shape mentioned here does not include a single circle, but includes shapes in which plural circles aggregate, and predetermined intended shapes described below. Examples of the predetermined intended shapes of foam include a triangle, a square, a rhombus, a star-like shape, a heart shape, a clover shape, and a spade shape of playing cards, a shape imitating the contour of the whole body or a part of the body such as the face of an animal such as a rabbit, a cat, an elephant, a bear, or a character of a game, a shape imitating the contour of a flower, a plant, a fruit thereof, a vehicle such as an airplane, a car or a yacht, etc.

In the case of the present embodiment, the predetermined intended shape of foam (the shape of a molded foamy object 150 (FIG. 8)) is a shape imitating a rabbit (rabbit). Therefore, the nozzle forming wall 84 and the discharge port 83 include, for example, a circular portion for discharging foam forming a facial part of a rabbit (excluding ears), and two elongated portions which extend from the circular portion and form the ears of the rabbit, respectively. In the case of the present embodiment, the number of the openings of the discharge port 83 is one (single).

The planar shape of the plate-like portion 82*a* is not particularly limited, but it is, for example, circular as shown in FIG. 6A.

Furthermore, the pushing portion 85 and the annular wall 81 are each formed into an annular shape in plan view. In addition, the axial center of each of the pushing portion 85 and the annular wall 81 is orthogonal to the plate-like portion 82*a*.

It is to be noted that the annular wall 81 and the pushing portion 85 are formed to have the same diameter, and are vertically continuous with each other. Therefore, the total body of the annular wall 81 and the pushing portion 85 forms one annular portion (tubular portion).

In the case of the present embodiment, the upper end surface of the pushing portion 85 is formed in an annular shape in plan view, and is arranged flatly and horizontally.

Figure 2:
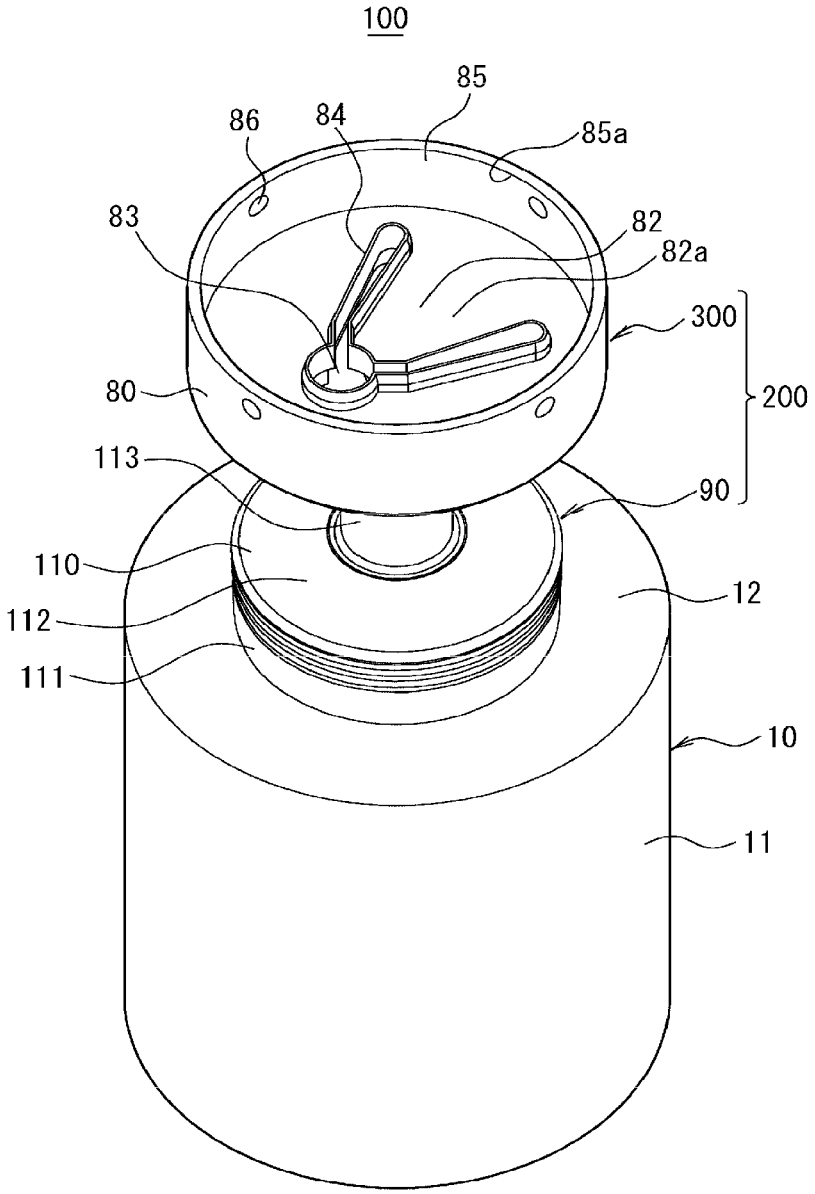
FIG. 2 is a perspective view showing the foam discharge container according to the first embodiment.

As described above, the pushing portion 85 has a standing portion standing at a position which is away from the discharge port 83 in an outward direction. The pushing portion 85 further has an intercommunicating portion which communicates an inside region and an outside region of the pushing portion 85 with each other. In the case of the present embodiment, one or plural holes 86 are formed in the pushing portion 85, and the holes 86 serve as the intercommunicating portion. As an example, as shown in FIG. 2, the holes 86 are formed at four places to be arranged at equiangular intervals (90-degrees intervals) in the peripheral direction of the pushing portion 85. The holes 86 penetrate through the pushing portion 85 to the inside and outside of the pushing portion 85 to cause the inside and outside regions of the pushing portion 85 to intercommunicate with each other.

That is, in the case of the present embodiment, the pushing portion 85 is formed in a wall-like shape that surrounds the periphery of the discharge port 83 and stands, and has the holes 86 which communicates the inside region and the outside region of the pushing portion 85 with each other.

Here, in the case of the present embodiment, the standing portion of the pushing portion 85 is configured as a continuous wall that circulates around the discharge port 83, but the present invention is not limited to this example. The standing portion of the pushing portion 85 may be constituted by plural wall portions arranged intermittently around the discharge port 83.

For example, the annular wall 75 of the first head member 70 and the annular wall 81 of the second head member 80 are fitted to each other, whereby the first head member 70 and the second head member 80 are assembled into the foam discharge head 300. For example, the annular wall 75 is fitted into the annular wall 81 as shown in FIGS. 3 and 4, whereby the first head member 70 and the second head member 80 are assembled to each other.

For example, in a state where the first head member 70 and the second head member 80 are assembled to each other, for example, the tip (upper end) of the annular wall 75 is in contact with the lower surface of the plate-like portion 82*a*, and the tip (lower end) of the surrounding wall 87 is in contact with the upper surface of the primary plate-like portion 74 in a circular shape. That is, the lower end of the surrounding wall 87 is horizontally arranged over the entire area. Furthermore, the primary plate-like portion 74 and the plate-like portion 82*a* face each other in parallel, for example. Furthermore, the opening 75*a* of the annular wall 75 is blocked by the facing portion 82 of the second head member 80.

Furthermore, the protruding portion 88 is formed in a columnar shape (for example, a columnar shape with a rounded tip portion (lower end portion)), and arranged coaxially with the tubular portion 71, and the tip portion of the protruding portion 88 intrudes into the primary discharge port 73.

The internal space of the tubular portion 71 is set in intercommunication with the internal space of the surrounding wall 87 via the primary discharge port 73. That is, the internal space of the tubular portion 71 is set in intercommunication with the internal space of the nozzle forming wall 84.

Here, the pump portion 120 is provided with a piston guide 140 formed in a cylindrical shape. The piston guide 140 holds a ball valve 190 at the upper end portion thereof.

For example, the foam discharge head 300 is mounted on the piston guide 140, for example, by pushing the tubular portion 71 of the foam discharge head 300 from the upper side of the standing tubular portion 113 into the standing tubular portion 113, and inserting and fixing the upper end portion of the piston guide 140 to the lower end portion of the tubular portion 71. As a result, the foam discharge head 300 is held by the piston guide 140.

The fixing of the piston guide 140 to the tubular portion 71 of the foam discharge head 300 is performed, for example, by fitting. By pulling up the foam discharge head 300 strongly, the fitting of the piston guide 140 to the tubular portion 71 is released, so that the foam discharge head 300 is allowed to be removed from the cap 90.

The piston guide 140 is supported by a case of the pump portion 120 via an urging member such as a coil spring.

When the push-down operation is performed on the foam discharge head 300, the foam discharge head 300 and the piston guide 140 descend integrally with each other against urging force of the urging member. It is to be noted that the push-down operation of the foam discharge head 300 is set to stop at a predetermined bottom dead point.

Also, when the push-down operation on the foam discharge head 300 is released, the foam discharge head 300 and the piston guide 140 ascend up to a top dead point position (the position in FIGS. 1 to 4) according to the urging of the urging member.

The foam discharge container 100 is configured to discharge a fixed amount of foam by a single push-down operation (an operation of pushing down the foam discharge head 300 from the top dead point to the bottom dead point) on the foam discharge head 300.

By fixing the piston guide 140 and the foam discharge head 300 to each other, the ring member 60 (the ring member 60 contains the mesh holding ring 50 therein) is arranged above the ball valve 190.

Accordingly, a region where the ball valve 190 is arranged intercommunicates with the internal space of a portion of the tubular portion 71 above the holding portion 72 via the internal space of the ring member 60 and the mesh holding ring 50, and consequently intercommunicates with the primary discharge port 73 at the upper end of the tubular portion 71.

That is, the foamer mechanism 20 including the gas-liquid mixing portion 21 intercommunicates with the primary discharge port 73 via the internal space of the tubular portion 71.

When the push-down operation on the foam discharge head 300 is performed, foam generated by the foamer mechanism 20 is discharged upward from the primary discharge port 73 via the tubular portion 71.

The surrounding wall 87 is formed in a closed-loop shape in plan view. A region that is the facing distance between the primary plate-like portion 74 and the facing portion 82 and is surrounded by the surrounding wall 87 is referred to as an anterior chamber 30.

The foam generated by the foamer mechanism 20 is discharged into the anterior chamber 30 via the tubular portion 71 and the primary discharge port 73 at the upper end of the tubular portion 71, spreads in the anterior chamber 30, and is discharged upward from the discharge port 83 of the facing portion 82.

That is, the foam discharge container 100 includes the primary discharge port 73 that discharges foam, the anterior chamber 30 in which the foam discharged from the primary discharge port 73 spreads in an internal space, and the facing portion 82 that is arranged so as to face the primary discharge port 73 with the anterior chamber 30 interposed between the facing portion and the primary discharge port and has the discharge port 83 formed in the facing portion.

Here, the facing portion 82 is the entire portion of a portion constituting a ceiling surface of the anterior chamber 30, and is arranged at least inside the surrounding wall 87 in plan view. In the case of the present embodiment, the facing portion 82 is arranged in an entire region excluding the discharge port 83 out of an inside region of the annular portion (tubular portion) constituted by the total body of the annular wall 81 and the pushing portion 85 in plan view, and also is present in an outer region of the surrounding wall 87 in plan view.

Figure 7:
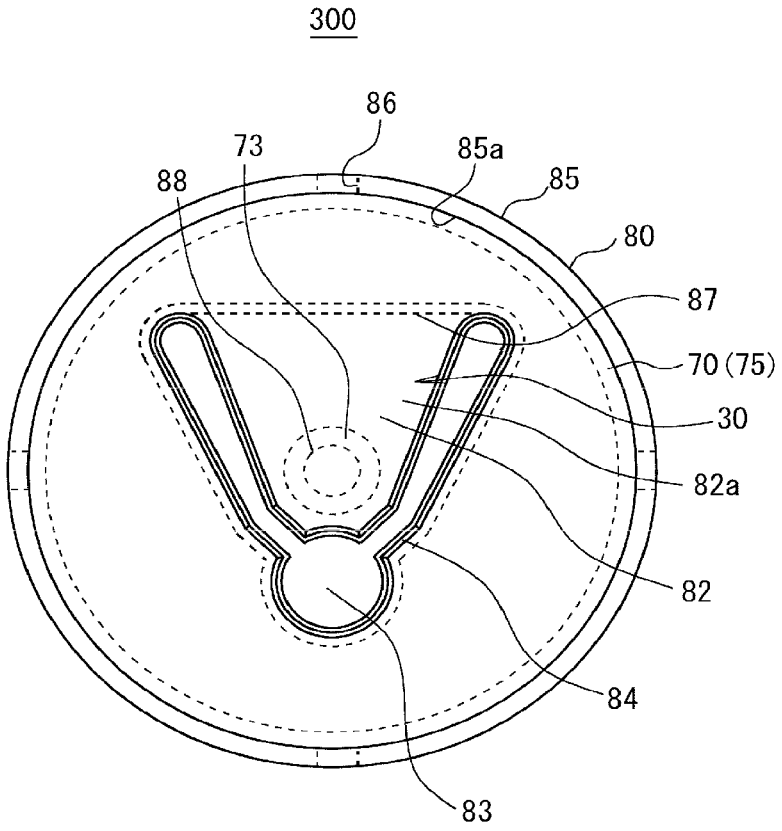
FIG. 7 is a plan view showing a foam discharge head of the foam discharge container according to the first embodiment.

Here, as shown in FIG. 7, in plan view, the surrounding wall 87 is accommodated inside the pushing portion 85, and the discharge port 83 and the primary discharge port 73 are accommodated inside the surrounding wall 87.

That is, the foam discharge container 100 includes the primary plate-like portion 74 having the primary discharge port 73 that discharges the foam, the anterior chamber 30 in which the foam discharged from the primary discharge port 73 spreads in an internal space, and the facing portion 82 that is arranged so as to face the primary discharge port 73 with the anterior chamber 30 interposed between the facing portion and the primary discharge port and has the discharge port 83 formed in the facing portion. The facing portion 82 is configured to include the plate-like portion 82*a* that is arranged so as to face the primary plate-like portion 74 with the anterior chamber 30 interposed between the plate-like portion and the primary plate-like portion and has the discharge port 83 formed in the plate-like portion. The anterior chamber 30 is a region surrounded by the surrounding wall 87 standing between the primary plate-like portion 74 and the plate-like portion 82*a*. When the foam discharge container 100 is viewed in the pushing direction, the surrounding wall 87 is accommodated inside the pushing portion 85, and the discharge port 83 and the primary discharge port 73 are accommodated inside the surrounding wall 87.

Therefore, as compared with a case where the surrounding wall 87 does not exist (for example, when the anterior chamber 30 is defined by the annular wall 75), a range in which foam spreads in the anterior chamber 30 can be limited, so that the foam can be surely discharged from the discharge port 83. As described above, the foam discharge container 100 is configured to discharge a fixed amount of foam by one push-down operation, so that a limited amount of foam can be surely discharged from the discharge port 83.

In the present embodiment, the surrounding wall 87 is a component of the second head member 80, and the surrounding wall 87 stands (is suspended) so as to direct from the plate-like portion 82*a* to the primary plate-like portion 74.

However, the surrounding wall 87 may be a component of the first head member 70, and in this case, the surrounding wall 87 is configured to stand so as to direct from the primary plate-like portion 74 to the plate-like portion 82*a*.

Furthermore, the surrounding wall 87 may have any shape as long as the inner peripheral surface of the surrounding wall 87 surrounds the discharge port 83 (and the inner peripheral surface of the nozzle forming wall 84) in plan view. From the viewpoint of limiting the range of the anterior chamber 30 as much as possible, it is preferable that the inner peripheral surface of the surrounding wall 87 surrounds the discharge port 83 (and the inner peripheral surface of the nozzle forming wall 84) at a substantially shortest distance as shown in FIG. 7. Furthermore, it is preferable that the inner peripheral surface of the surrounding wall 87 (the whole or a part of the inner peripheral surface of the surrounding wall 87) is formed inside the outer peripheral surface of the nozzle forming wall 84 in plan view. In the case of the present embodiment, in plan view, a part of the inner peripheral surface of the surrounding wall 87 is arranged along a part of the outer peripheral surface of the nozzle forming wall 84, and the part of the inner peripheral surface of the surrounding wall 87 is arranged inside the part of the outer peripheral surface of the nozzle forming wall 84.

Alternatively, the inner peripheral surface of the surrounding wall 87 may coincide with the outline of the discharge port 83 in plan view. That is, the surrounding wall 87 and the discharge port 83 may be formed to have the same size and shape in plan view, and may be arranged to overlap each other.

Furthermore, from the viewpoint of limiting the amount of foam to be filled in the anterior chamber 30 and improving three-dimensional formability of foam of a specific shape, the height dimension of the anterior chamber 30 is preferably set to be equal to or more than 20%, more preferably set to be equal to or more than 30%, and preferably set to be equal to or less than 120%, more preferably set to be equal to or less than 100% of that of the nozzle forming wall 84.

As described above, the facing portion 82 includes the protruding portion 88 protruding downward from the plate-like portion 82*a*, and in the present embodiment, the tip portion of the protruding portion 88 intrudes into the primary discharge port 73.

That is, the facing portion 82 is configured to include the protruding portion 88 protruding toward the primary discharge port 73, and when the foam discharge container 100 is viewed in the pushing direction, the protruding portion 88 overlaps at least a part of the primary discharge port 73.

Accordingly, when the foam discharge container 100 is viewed in the pushing direction, the facing portion 82 covers at least a part of the primary discharge port 73. That is, when the foam discharge container 100 is viewed in the pushing direction, the facing portion 82 may cover the whole primary discharge port 73 or may cover a part of the primary discharge port 73.

Since the facing portion 82 covers at least a part of the primary discharge port 73 when the foam discharge container 100 is viewed in the pushing direction, it is possible to cause foam discharged from the primary discharge port 73 to impinge against the facing portion 82 and spread, and then shape and discharge the foam in a predetermined intended shape by the discharge port 83. Therefore, it is possible to sufficiently spread foam all over the discharge port 83. Therefore, it is possible to more surely shape the foam into a predetermined intended shape.

In the case of this embodiment, since the protruding portion 88 protrudes to the primary discharge port 73, the foam discharged from the primary discharge port 73 impinges against the protruding portion 88, so that the foam can be made to spread more surely.

In particular, since the protruding portion 88 intrudes into the primary discharge port 73, foam can be more surely made to spread by the protruding portion 88.

The foam discharge container 100 is configured as described above.

Next, an operation will be described.

In a normal state where the foam discharge head 300 is not pushed down, the foam discharge head 300 is present at the top dead point position (FIGS. 1 to 4).

The push-down operation on the foam discharge head 300 can be performed by pushing down the foam discharge head 300 by the discharge target body 40 in a state where the opening 85*a* at the upper end of the foam discharge head 300 (the upper end of the pushing portion 85) is blocked by the discharge target body 40 such as a hand as shown in FIG. 1 (that is, a state where the discharge target body 40 faces the discharge port 83). That is, the push-down operation on the foam discharge head 300 can be performed by one-hand operation.

When the push-down operation is performed on the foam discharge head 300, the foam discharge head 300 and the piston guide 140 descend relatively to the container main body 10 against the urging of the urging member in the pump portion 120.

At this time, the liquid agent 101 and air are supplied to the gas-liquid mixing portion 21 by the action of the pump portion 120 to generate foam in the gas-liquid mixing portion 21. The foam generated in the gas-liquid mixing portion 21 passes through the mesh 51, so that the foam becomes finer and uniform foam. The foam generated by the foamer mechanism 20 in the manner as described above passes through the interior of the tubular portion 71, is discharged from the primary discharge port 73 to the anterior chamber 30, and then spreads in the anterior chamber 30.

Furthermore, the foam passes through the nozzle forming wall 84 formed in the facing portion 82, and is discharged from the discharge port 83. Upon passage through the nozzle forming wall 84 and the discharge port 83, the foam is shaped into a predetermined intended shape (a shape simulating a rabbit in the present embodiment) and attached to the lower surface of the discharge target body 40 which blocks the opening 85*a*. That is, the foam which pops out from the discharge port 83 by the pushing operation of the pushing portion 85 is transferred to the discharge target body 40, and a molded foamy object 150 as the foam which has been shaped into a predetermined intended shape is attached to the lower surface of the discharge target body 40.

Thereafter, when the push-down operation on the foam discharge head 300 is released, the piston guide 140 and the foam discharge head 300 ascend according to the urging of the urging member, and the foam discharge head 300 returns to the top dead point position.

Thereafter, by lifting up the discharge target body 40 above the opening 85*a* and turning it over, the molded foamy object 150 has been formed on the discharge target body 40 as shown in FIG. 8. That is, it is possible to receive the molded foamy object 150 having the predetermined intended shape on the discharge target body 40.

When the piston guide 140 ascends, the liquid agent 101 in the container main body 10 is sucked into the pump portion 120 via the dip tube 130.

Furthermore, since the pushing portion 85 has the standing portion standing at the position spaced outward from the discharge port, the foam discharge head 300 can be stably pushed by the pushing operation of the pushing portion 85.

In the present embodiment, since the pushing portion 85 surrounds the periphery of the discharge port 83, the discharge target body 40 is pushed against the upper end surface of the pushing portion 85, and the pushing portion 85 is pushed down by the discharge target body 40, whereby the foam discharge head 300 can be stably pushed down.

In particular, the upper end surface of the pushing portion 85 is flatly and horizontally arranged. That is, the whole tip end surface (upper end surface) of the pushing portion 85 is arranged at the same position in the pushing direction (vertical direction) of the pushing operation. Therefore, it is possible to more stably perform the pushing operation on the foam discharge head 300.

With respect to the pushing operation of the foam discharge head 300, from the viewpoint of making foam to be smoothly discharged from the discharge port 83 and stably and suitably forming foam of a specific shape on the discharge target body 40 such as a hand, the pushing pressure when the foam discharge head 300 is pushed down at a speed of 30 mm/s is preferably equal to or more than 1 N, more preferably equal to or more than 5 N, and preferably equal to or less than 40 N, more preferably equal to or less than 35 N.

In the pushing portion 85, there are formed the holes 86 through which the inside and outside regions of the pushing portion intercommunicate with each other. Therefore, even in a case where the opening 85*a* is hermetically blocked by the discharge target body 40 when the pushing operation is performed on the foam discharge head 300, air inside the pushing portion 85 can be smoothly discharged to the outside of the pushing portion 85 via the holes 86.

Therefore, since the push-down operation of the foam discharge head 300 can be performed with a small force, it is possible to smoothly push down the foam discharge head 300 and discharge foam from the discharge port 83. In addition, since foam can be discharged smoothly, foam having a specific shape can be suitably formed in a desired three-dimensional shape.

Since foam can be discharged from the discharge port 83 after the foam spreads in the anterior chamber 30 arranged at anterior of the discharge port 83 and is filled in the anterior chamber 30. Therefore, the foam can be easily sufficiently distributed over the whole region of the discharge port 83, and the foam can be easily formed in a predetermined intended shape by the discharge port 83. Since the facing portion 82 is disposed, the foam discharged from the primary discharge port 73 is easily spread in the anterior chamber 30.

It is to be noted that the structure and operation of the cap 90 (including the pump portion 120) described here is merely an example, and with respect to the structure of the cap 90, there is no problem even when other well-known structures are applied to the present embodiment without departing from the subject matter of the present invention.

According to the first embodiment as described above, the foam discharge container 100 includes the discharge port 83 which is opened in the direction opposite to the pushing direction of the pushing operation and discharges foam, and the pushing portion 85 for keeping the distance between the discharge target body 40 and the discharge port 83 constant.

Therefore, by performing the pushing operation on the pushing portion 85 by the discharge target body 40 such as a hand, foam discharged from the discharge port 83 can be attached to the discharge target body 40. Accordingly, it is possible to receive foam on the discharge target body 40 such as a hand by one-hand operation. That is, since foam can be received on the discharge target body 40 with a simple operation, the convenience of the foam discharge container 100 is enhanced.

Furthermore, since the distance between the discharge target body 40 and the discharge port 83 can be kept constant by the pushing portion 85, foam discharged from the discharge port 83 can be received on the discharge target body 40 without squashing the foam by the discharge target body 40.

Therefore, particularly when foam is discharged while shaped into a predetermined intended shape, it is easy to more accurately form the foam having the predetermined intended shape on the discharge target body 40. That is, processability of the foam by the foam discharge container 100 becomes good.

Furthermore, since the discharge port 83 is formed at the tip of the nozzle forming wall 84, foam can be stably discharged in the direction opposite to the pushing direction by the pushing operation. Since the pushing portion 85 extends in the opposite direction beyond the discharge port 83 formed at the tip of the nozzle forming wall 84, the foam can be suitably received on the discharge target body 40.

Here, the height dimension of the pushing portion 85 is preferably equal to or more than twice of the height dimension of the nozzle forming wall 84, more preferably equal to or more than 3 times, and preferably equal to or less than 10 times, more preferably equal to or less than 8 times so that the molded foamy object 150 can be suitably received on the discharge target body 40.

Furthermore, the difference in height between the discharge port 83 and the pushing portion 85 is preferably equal to or more than 5 mm and equal to or less than 20 mm, and more preferably equal to or more than 7 mm and equal to or less than 18 mm.

Still furthermore, the height dimension of the nozzle forming wall 84 is preferably equal to or more than 1 mm, more preferably equal to or more than 2 mm, and equal to or less than 10 mm, more preferably equal to or less than 8 mm from the viewpoint of excellently receiving foam from the discharge port 83 onto the discharge target body 40.

Still furthermore, it is preferable that the structure of the foamer mechanism 20 such as the pump portion 120, the height dimensions of the pushing portion 85 and the nozzle forming wall 84, etc. are set so that foam to be discharged from the discharge port 83 pops up beyond the tip (upper end) of the pushing portion 85 when the pushing operation is performed on the pushing portion 85 without placing the discharge target body 40 at a position that the discharge port 83 faces.

Second Embodiment

Figure 9:
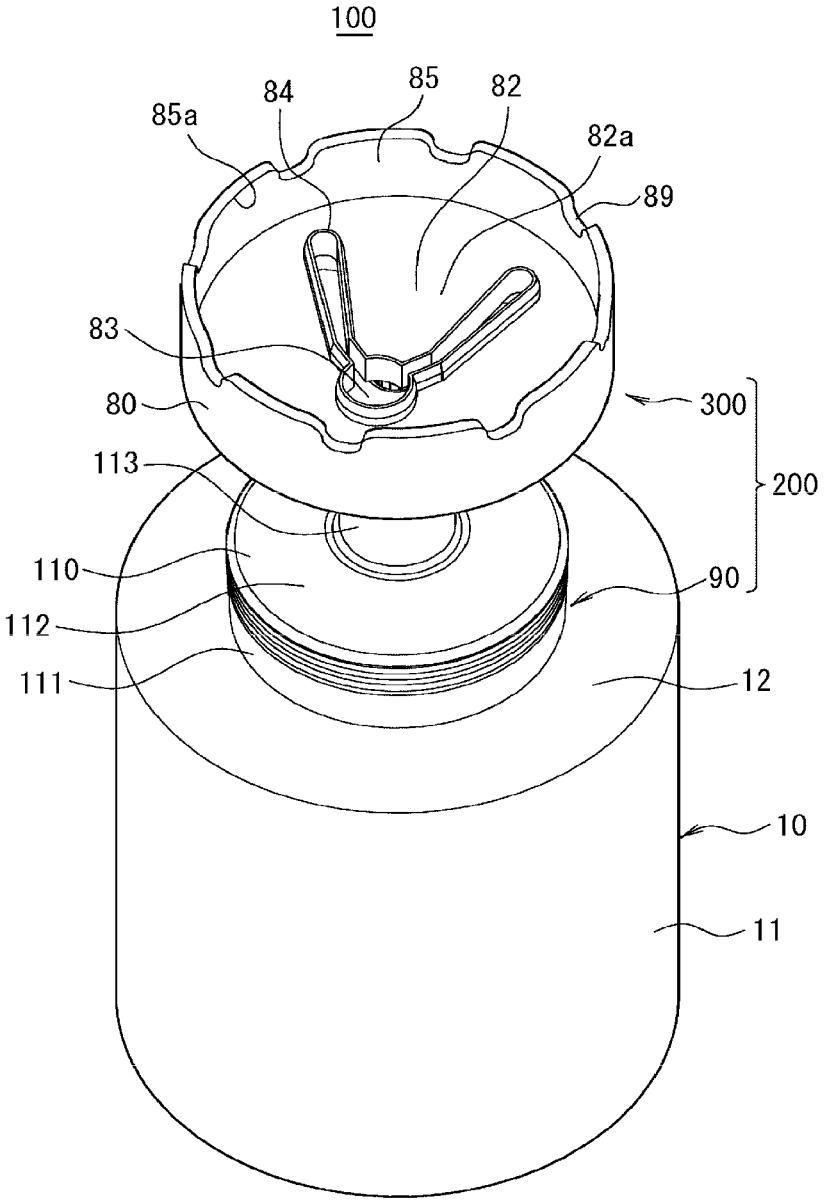
FIG. 9 is a perspective view of a foam discharge container according to a second embodiment.

Next, a foam discharge container 100, a foam discharge cap 200, and a foam discharge head 300 according to a second embodiment will be described with reference to FIGS. 9 and 10.

The foam discharge container 100, the foam discharge cap 200, and the foam discharge head 300 according to the present embodiment are different from the foam discharge container 100, the foam discharge cap 200, and the foam discharge head 300 according to the foregoing first embodiment in the following point, and are configured in the same manner as the foam discharge container 100, the foam discharge cap 200, and the foam discharge head 300 according to the foregoing first embodiment in the other points.

The pushing portion 85 of the foam discharge head 300 according to the present embodiment does not have any hole 86, but has notched portions 89 formed at the upper end thereof as intercommunicating portions instead. The notched portions 89 are shaped to be recessed downward from an area of the upper end of the pushing portion 85 where the notched portions 89 are not formed. The number of the notched portions 89 only has to be equal to or more than 1, but in the case of the present embodiment, plural (for example, eight) notched portions 89 are formed at equal angular intervals in the peripheral direction of the pushing portion 85 as shown in FIGS. 9 and 10.

That is, in the case of the present embodiment, the foam discharge container 100 has the notched portions 89 as the intercommunicating portions through which the inside and outside regions of the pushing portion 85 intercommunicate with each other.

Figure 10:
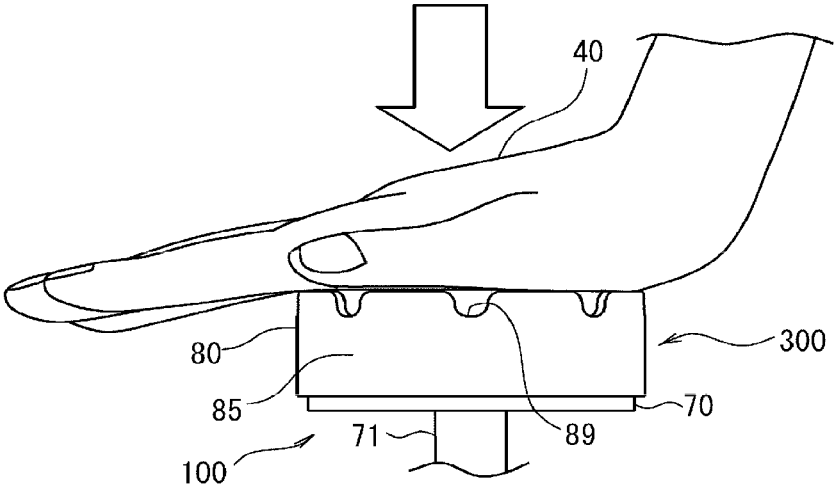
FIG. 10 is a front view showing a state where the foam discharge container according to the second embodiment is used.

In the case of the present embodiment, when the discharge target body 40 such as a hand is placed on the upper end of the pushing portion 85 and the foam discharge head 300 is pushed down by the discharge target body 40, a gap is formed between the discharge target body 40 and the pushing portion 85 at each place where each notched portion 89 is formed (FIG. 10). Therefore, the air inside the pushing portion 85 can be smoothly discharged to the outside of the pushing portion 85 through these gaps.

Therefore, since the push-down operation of the foam discharge head 300 can be performed with a small force, the foam discharge head 300 can be smoothly pushed down to discharge foam from the discharge port 83.

Third Embodiment

Next, a foam discharge container 100, a foam discharge cap 200, and a foam discharge head 300 according to a third embodiment will be described with reference to FIGS. 11 to 13.

The foam discharge container 100, the foam discharge cap 200, and the foam discharge head 300 according to the present embodiment are different from the foam discharge container 100, the foam discharge cap 200 and the foam discharge head 300 according to the foregoing first embodiment in the shapes of the discharge port 83 and the nozzle forming wall 84, but are configured in the same manner as the foam discharge container 100, the foam discharge cap 200 and the foam discharge head 300 according to the foregoing first embodiment in the other points.

Figure 13:
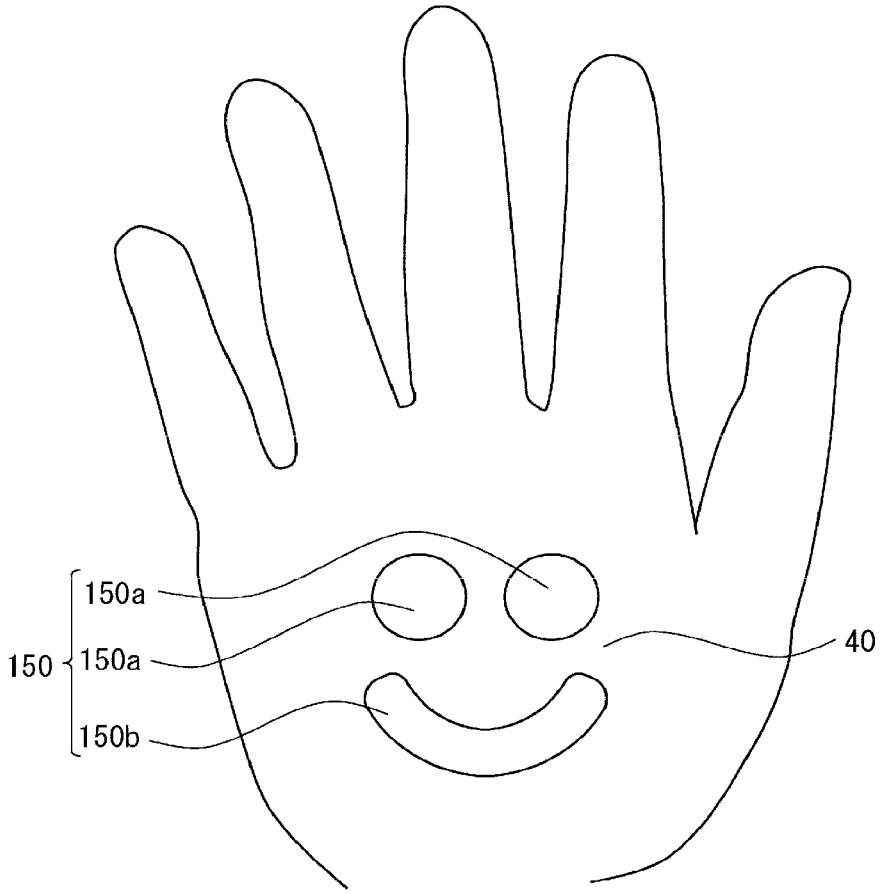
FIG. 13 is a plan view showing a state where a molded foamy object is received by a discharge target body (hand) in the third embodiment.

In the case of the present embodiment, the molded foamy object 150 has a shape including two first portions 150*a* each imitating a human's eye, and one second portion 150*b* imitating the mouth of a smiling person (a shape simulating a smiling face of a person) as shown in FIG. 13.

Figure 11:
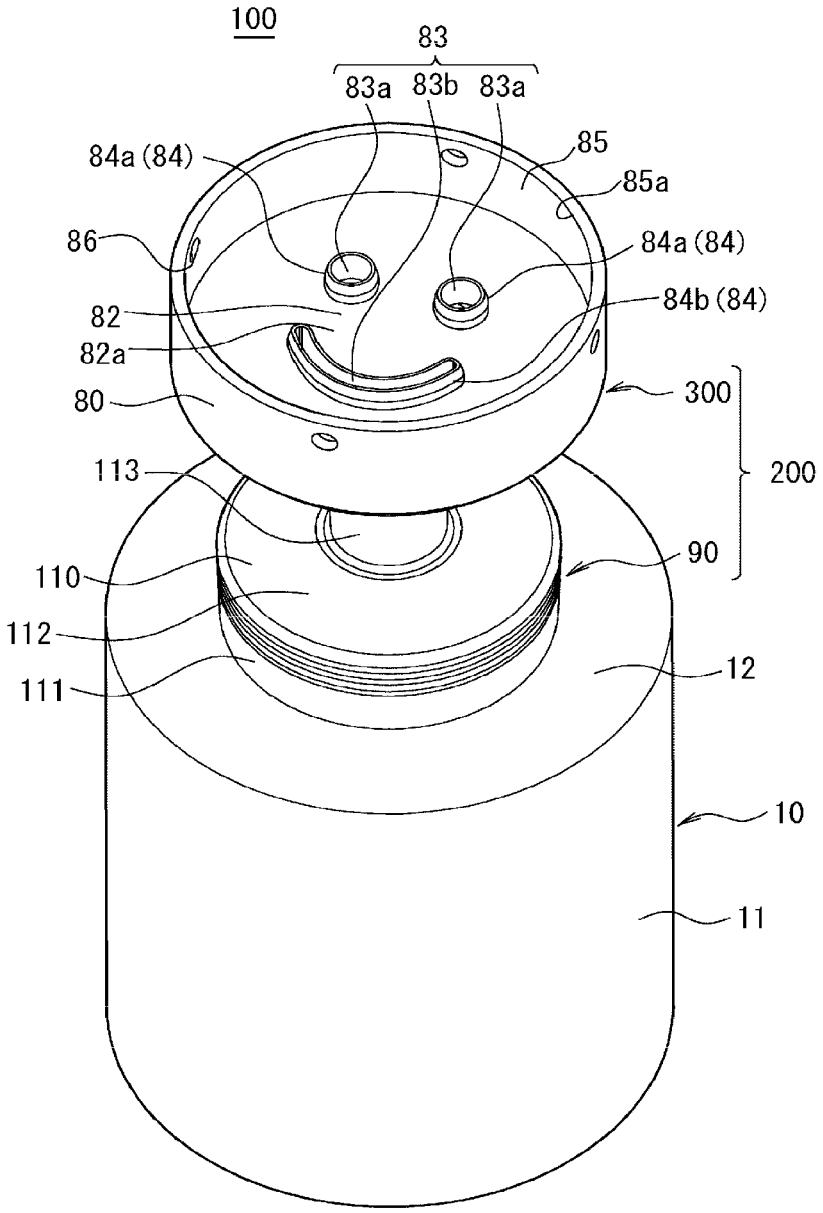
FIG. 11 is a perspective view of a foam discharge container according to a third embodiment.
Figure 12:
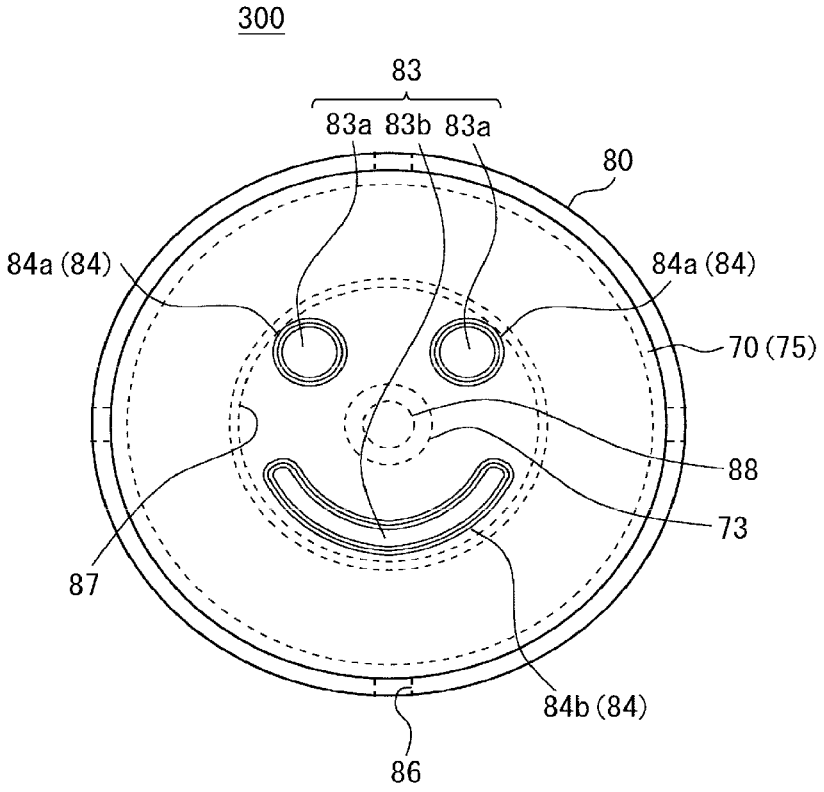
FIG. 12 is a plan view showing a foam discharge head of the foam discharge container according to the third embodiment.

As shown in FIGS. 11 and 12, the discharge port 83 and the nozzle forming wall 84 are adaptable to the molded foamy object 150 having such a shape, the discharge port 83 is configured to include plural openings, and the foam discharge container 100, the foam discharge cap 200, and the foam discharge head 300 have plural nozzle forming walls 84 corresponding to the respective openings.

That is, the second head member 80 includes, as the nozzle forming walls 84, for example, two first wall portions 84*a* each of which is circular in planar shape, and one second wall portion 84*b* which is arcuate in planar shape, and the discharge port 83 is configured to include two first portions 83*a* each having an opening which is circular in planar shape, and a second portion 83*b* having an opening which is arcuate in planar shape. Each first portion 83*a* is formed at the tip of each first wall portion 84*a*, and the second portion 83*b* is formed at the tip of the second wall portion 84*b*.

Fourth Embodiment

Next, a foam discharge container, a foam discharge cap, and a foam discharge head 300 according to a fourth embodiment will be described with reference to FIGS. 14 to 16.

The foam discharge container, the foam discharge cap, and the foam discharge head 300 according to the present embodiment are different from the foam discharge container 100, the foam discharge cap 200, and the foam discharge head 300 according to the foregoing first embodiment in the following point, and are configured in the same manner as the foam discharge container 100, the foam discharge cap 200, and the foam discharge head 300 according to the foregoing first embodiment in the other points.

In the present embodiment, the foam discharge container, the foam discharge cap, and the foam discharge head 300 do not have the surrounding wall 87.

Figure 16:
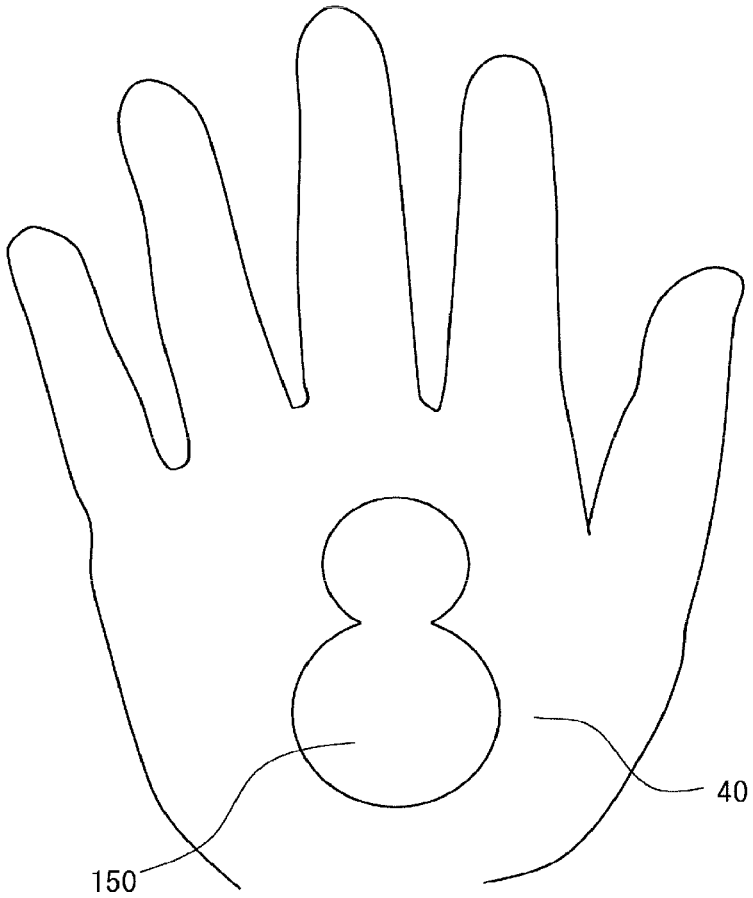
FIG. 16 is a plan view showing a state where a molded foamy object is received by a discharge target body (hand) in the fourth embodiment.

In the case of the present embodiment, the molded foamy object 150 has a shape simulating a snowman as shown in FIG. 16.

Figure 14:
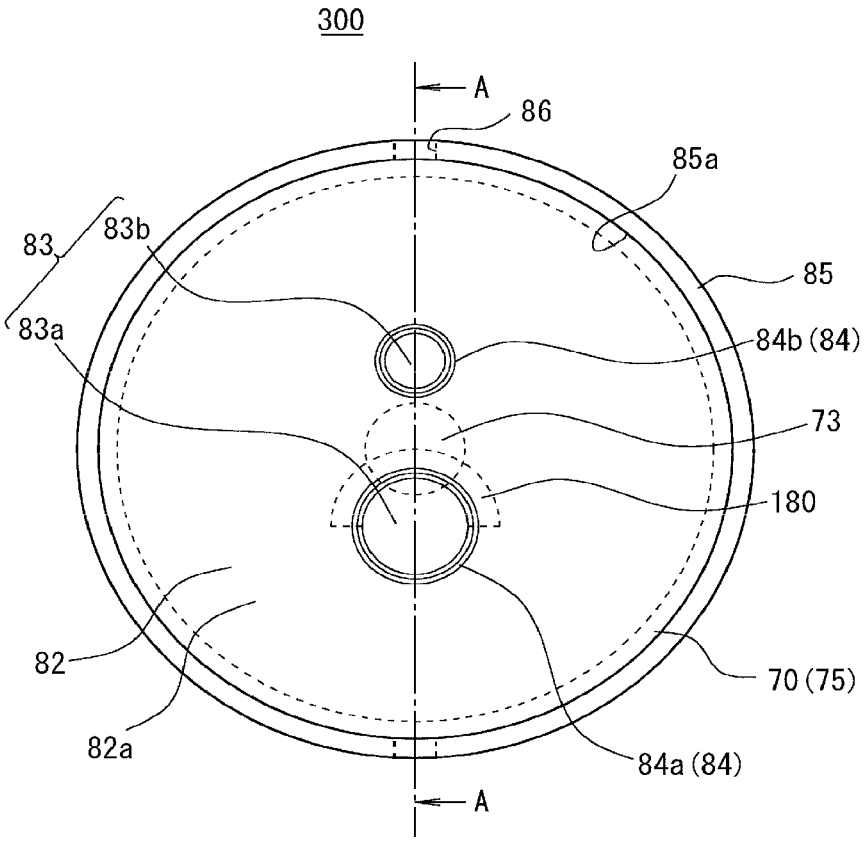
FIG. 14 is a plan view showing a foam discharge head of a foam discharge container according to a fourth embodiment.
Figure 15:
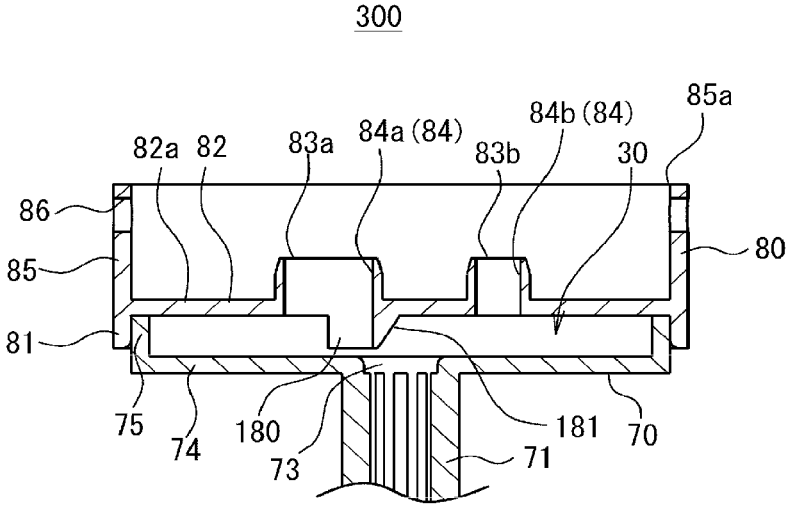
FIG. 15 is a sectional view taken along a line A-A in FIG. 14.

As shown in FIGS. 14 and 15, the discharge port 83 and the nozzle forming wall 84 are adaptable to the molded foamy object 150 having such a shape, the discharge port 83 is configured to include plural openings, and the foam discharge container 100, the foam discharge cap 200, and the foam discharge head 300 have plural nozzle forming walls 84 corresponding to the respective openings.

That is, the second head member 80 has, for example, a first wall portion 84*a* and a second wall portion 84*b* each of which is circular in planar shape as the plural nozzle forming walls 84. The plane area of the internal space of the first wall portion 84*a* is larger than the plane area of the internal space of the second wall portion 84*b*. It is to be noted that the distance between the first wall portion 84*a* and the primary discharge port 73 is smaller than the distance between the second wall portion 84*b* and the primary discharge port 73.

Furthermore, the discharge port 83 is configured to include a first portion 83*a* and a second portion 83*b* each of which is an opening having a circular planar shape. The first portion 83*a* is formed at the tip of the first wall portion 84*a*, and the second portion 83*b* is formed at the tip of the second wall portion 84*b*. The plane area of the first portion 83*a* is larger than the plane area of the second portion 83*b*. It is to be noted that the distance between the first portion 83*a* and the primary discharge port 73 is smaller than the distance between the second portion 83*b* and the primary discharge port 73.

The first wall portion 84*a* and the first portion 83*a* are arranged, for example, so as to partially overlap the primary discharge port 73 in plan view, and the second wall portion 84*b* and the second portion 83*b* are arranged, for example, so as not to overlap the primary discharge port 73.

Furthermore, in plan view, both the first wall portion 84*a* and the first portion 83*a*, and both the second wall portion 84*b* and the second portion 83*b* are arranged on opposite sides with the center of the primary discharge port 73 interposed therebetween.

In the case of the present embodiment, as shown in FIGS. 14 and 15, the facing portion 82 has an inhibiting and guiding wall 180 which is formed so as to protrude downward from the plate-like portion 82*a*.

The inhibiting and guiding wall 180 is formed, for example, so as to protrude downward from a half portion of the first wall portion 84*a* which is closer to the primary discharge port 73 in plan view, and the planar shape of the inhibiting and guiding wall 180 is a semicircular shape. That is, the inhibiting and guiding wall 180 is formed in a semi-cylindrical shape.

The inhibiting and guiding wall 180 shaped and arranged as described above has a function as an inhibiting portion for inhibiting foam discharged from the primary discharge port 73 to the anterior chamber 30 from flowing toward the first wall portion 84*a* and the first portion 83*a*.

Furthermore, the inhibiting and guiding wall 180 shaped and arranged as described above also functions as a guiding portion for guiding foam discharged from the primary discharge port 73 into the anterior chamber 30 toward the second wall portion 84*b* and the second portion 83*b*.

As described above, the discharge port 83 is configured to include a first discharge region (the first portion 83*a*) and a second discharge region (the second portion 83*b*), and the foam discharge container includes one or both of the inhibiting portion (constituted by the inhibiting and guiding wall 180) that inhibits the foam discharged from the primary discharge port 73 into the anterior chamber 30 from flowing to the first discharge region, and the guiding portion (constituted by the inhibiting and guiding wall 180) that guides the foam discharged from the primary discharge port 73 into the anterior chamber 30 to the second discharge region.

That is, the foam is inhibited from flowing to the first portion 83*a* by the inhibiting and guiding wall 180, whereby the discharge amount of the foam from the first portion 83*a* can be suppressed from excessively increasing. Furthermore, the foam is guided to the second portion 83*b* by the inhibiting and guiding wall 180, whereby the discharge amount of the foam from the second portion 83*b* can be suppressed from excessively decreasing.

That is, it is possible to suppress excessive decrease of the discharge amount of the foam from the second portion 83*b* which is farther from the discharge port 183 and has a smaller plane area (opening area) out of the first portion 83*a* and the second portion 83*b* while suppressing excessive increase of the discharge amount of the foam discharged from the first portion 83*a* which is closer to the discharge port 183 and has a larger planar area (opening area) out of the first portion 83*a* and the second portion 83*b*.

This makes it possible to discharge the foam in a well-balanced manner from each of the first portion 83*a* and the second portion 83*b* and shape the molded foamy object 150 into a predetermined intended shape.

It is to be noted that the inhibiting and guiding wall 180 has a function of adjusting the flow of foam from the primary discharge port 73 to the anterior chamber 30 and a function of adjusting the flow of foam from the anterior chamber 30 to the discharge port 83.

Here, a sloped wall surface 181 (that is, an outer surface of the semi-cylindrical inhibiting and guiding wall 180) which is a wall surface on the side of the second wall portion 84*b* and the second portion 83*b* out of the wall surface of the inhibiting and guiding wall 180 is sloped so as to be closer to the second wall portion 84*b* and the second portion 83*b* as shifting upward. Therefore, foam discharged from the primary discharge port 73 into the anterior chamber 30 can be effectively guided toward the second wall portion 84*b* and the second portion 83*b* by the sloped wall surface 181.

In the case of the present embodiment, a part of the inhibiting and guiding wall 180 overlaps the primary discharge port 73 in plan view. That is, a part of the inhibiting and guiding wall 180 is arranged at a position at which it faces the primary discharge port 73. However, in the present invention, the position at which the inhibiting and guiding wall 180 is arranged is not limited to the position facing the primary discharge port 73.

Furthermore, the tip (lower end) of the inhibiting and guiding wall 180 does not reach the upper surface of the primary plate-like portion 74, and is located above the upper surface of the primary plate-like portion 74.

In the fourth embodiment, the example in which the opening area of the first discharge region (the first portion 83*a*) is larger than the opening area of the second discharge region (the second portion 83*b*) has been described, but in the present invention, the magnitude relation between the opening area of the first discharge region and the opening area of the second discharge region is not particularly limited. The opening area of the first discharge region and the opening area of the second discharge region may be equal to each other, or the opening area of the second discharge region may be larger than the opening area of the first discharge region.

Furthermore, in the fourth embodiment, the example in which the first discharge region (the first portion 83*a*) is arranged to be closer to the primary discharge port 73 than the second discharge region (the second portion 83*b*) has been described, but in the present invention, the relationship of the distance between the first discharge region and the primary discharge port 73 and the distance between the second discharge region and the primary discharge port 73 is not particularly limited. The distance between the first discharge region and the primary discharge port 73 and the distance between the second discharge region and the primary discharge port 73 may be equal to each other, or the distance between the second discharge region and the primary discharge port 73 may be smaller than the distance between the first discharge region and the primary discharge port 73.

In the fourth embodiment, the shapes of the first discharge region (the first portion 83*a*) and the second discharge region (the second portion 83*b*) are not limited to the above examples. For example, when the first discharge region is larger in width than the second discharge region (the second discharge region is smaller in width than the first discharge region), the foam discharge container may have one or both of the inhibiting portion and the guiding portion.

As the second discharge region has a smaller opening area, is arranged to be farther from the primary discharge port 73 or is formed to have a smaller width, the discharge amount of foam is apt to be smaller. However, by providing the foam discharge container with one or both of the inhibiting portion and the guiding portion, it makes possible to sufficiently secure the amount of foam discharged from the second discharge region, and makes it easier to shape foam into a predetermined intended shape.

In the fourth embodiment, the example in which the first discharge region and the second discharge region are the openings spaced apart from each other (the first portion 83*a* and the second portion 83*b*) has been described. That is, the example in which the discharge port 83 is an aggregate of plural openings has been described.

However, the present invention is not limited to these examples, and the first discharge region and the second discharge region may be connected to each other via a connection opening which is narrower than the first discharge region and the second discharge region. That is, each of the first discharge region and the second discharge region may be constituted by each part of one opening.

Fifth Embodiment

Figure 17A:
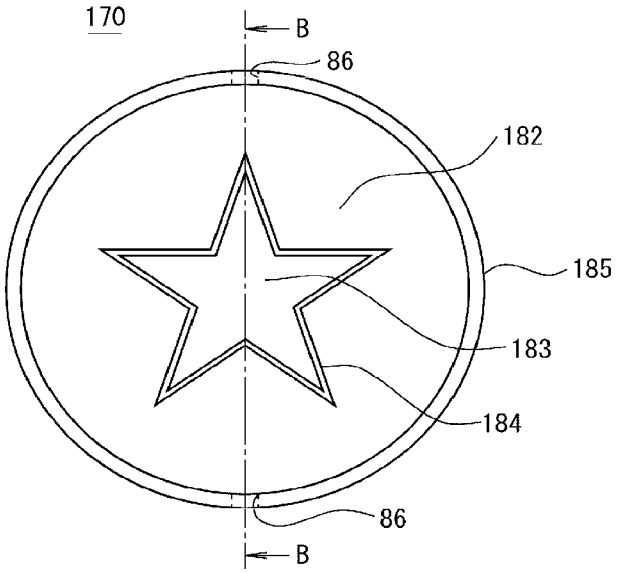
FIGS. 17A and 17B are diagrams showing a head member of a foam discharge container according to a fifth embodiment.

Next, a foam discharge container, a foam discharge cap, and a foam discharge head according to a fifth embodiment will be described with reference to FIGS. 17A and 17B. FIG. 17A is a plan view of the foam discharge head (head member 170) according to the fifth embodiment, and FIG. 17B is a sectional view taken along a line B-B of FIG. 17A.

The foam discharge container and the foam discharge cap according to the present embodiment are different from the foam discharge container 100 and the foam discharge cap 200 according to the first embodiment in that a foam discharge head described below is provided, and are configured in the same manner as the foam discharge container 100 and the foam discharge cap 200 according to the foregoing first embodiment in the other points.

Figure 17B:
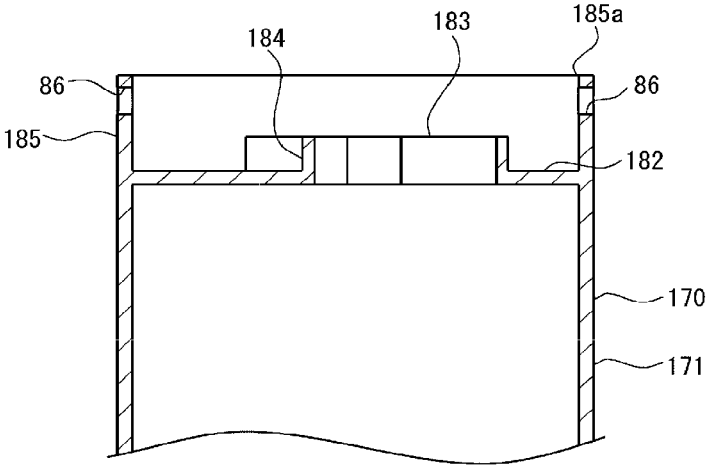

In the case of the present embodiment, the foam discharge head is constituted by the head member 170 shown in FIGS. 17A and 17B. That is, in the present embodiment, the foam discharge head is constituted by one member.

The head member 170 includes a cylindrical tubular portion 171, a plate-like portion 182 provided on the inner peripheral side of the upper end portion of the tubular portion 171, and a discharge port 183 formed in the plate-like portion 182.

More specifically, the plate-like portion 182 has a discharge port forming wall 184 standing upward from a flat-plate portion of the plate-like portion 182, and the discharge port 183 is formed at the tip (upper end) of the discharge port forming wall 184.

The planar shapes of the discharge port 183 and the discharge port forming wall 184 are not particularly limited, but they have, for example, star-like shapes as shown in FIG. 17A.

The tubular portion 171 corresponds to the tubular portion 71 in the first embodiment. For example, like the first embodiment, the head member 170 is mounted on the piston guide 140 by pushing the tubular portion 171 into the standing tubular portion 113 from the upper side of the cap member 110, and fitting and fixing the upper end portion of the piston guide 140 into the lower end portion of the tubular portion 171.

The head member 170 further has a pushing portion 185 standing upward from the peripheral edge of the plate-like portion 182, and holes 86 formed in the pushing portion 185. The pushing portion 185 extends upward beyond the discharge port 183. An opening 185*a* is formed at the upper end of the pushing portion 185.

The planar shape of the pushing portion 185 coincides with the planar shape of the tubular portion 171, for example.

It is to be noted that the discharge port forming wall 184 is accommodated inside the pushing portion 185 in plan view.

In the case of the present embodiment, the foam discharge head does not have configurations corresponding to the anterior chamber 30 (surrounding wall 87), the primary discharge port 73, the protruding portion 88, the primary plate-like portion 74, the annular wall 75, and the annular wall 81. Therefore, as compared with the above embodiments, the foam discharge container, the foam discharge cap, and the foam discharge head have simple configurations.

In the present embodiment, the foam generated by the foamer mechanism 20 is squeezed by the plate-like portion 182 and the discharge port forming wall 184, and discharged from the discharge port 183.

In the case of the present embodiment, a discharge target body such as a hand is placed on the upper end of the pushing portion 185, and the push-down operation is performed on the foam discharge head, whereby a molded foamy object having a predetermined intended shape (for example, a star-like shape) can be attached to the discharge target body.

Sixth Embodiment

Next, a foam discharge container, a foam discharge cap, and a foam discharge head according to a sixth embodiment will be described with reference to FIG. 18.

The foam discharge container and the foam discharge cap according to the present embodiment are different from the foam discharge container and the foam discharge cap according to the foregoing fifth embodiment in that a foam discharge head described hereinafter is provided, and configured in the same manner as the foam discharge container and the foam discharge cap according to the foregoing fifth embodiment in the other points.

Figure 18:
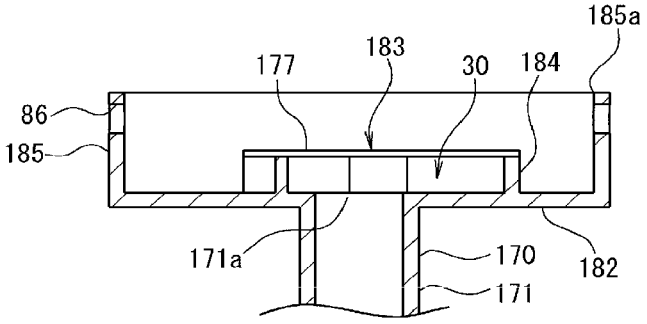
FIG. 18 is a diagram showing a head member of a foam discharge container according to a sixth embodiment.

In the case of this embodiment, the foam discharge head is constituted by the head member 170 shown in FIG. 18. That is, in the present embodiment, the foam discharge head is also constituted by one member.

The head member 170 in the present embodiment is different from the head member 170 in the fifth embodiment in the following point, and is configured in the same manner as the head member 170 in the foregoing fifth embodiment in the other points.

In the case of the present embodiment, the plate-like portion 182 protrudes outward (to the periphery) from the upper end of the tubular portion 171.

Furthermore, the discharge port forming wall 184 surrounds a wider range than the primary discharge port 171*a* at the upper end of the tubular portion 171 in plan view.

A mesh 177 is provided at the upper end of the discharge port forming wall 184. Therefore, foam passing through the mesh 177 is discharged from the discharge port 183 at the upper end of the discharge port forming wall 184.

In the present embodiment, since foam generated by the foamer mechanism 20 suffers a pressure loss due to the mesh 177, after discharged from the primary discharge port 171*a* at the tip of the tubular portion 171, the foam spreads in the anterior chamber 30 which is an internal space of the discharge port forming wall 184, and discharged from the discharge port 183.

Therefore, the foam can be shaped into a predetermined intended shape (for example, a star-like shape similar to that of the fifth embodiment) by the discharge port forming wall 184 and the discharge port 183.

Furthermore, passage of the foam through the mesh 177 when the foam is discharged from the discharge port 183 makes it possible to makes the foam finer and more uniform.

Seventh Embodiment

Next, a foam discharge head 300 according to a seventh embodiment will be described with reference to FIGS. 19 to 21.

Figure 20A:
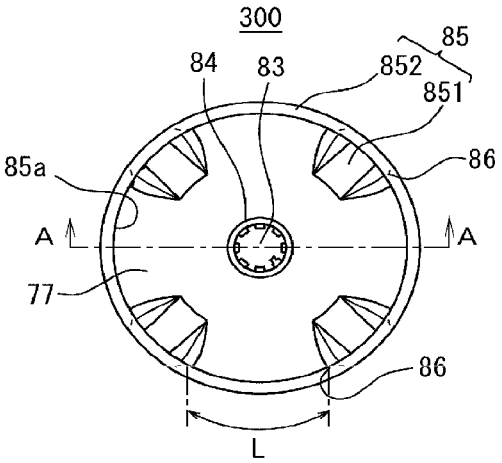
FIGS. 20A, 20B, 20C, and 20D are diagrams showing a foam discharge head of the foam discharge container according to the seventh embodiment.
Figure 20B:
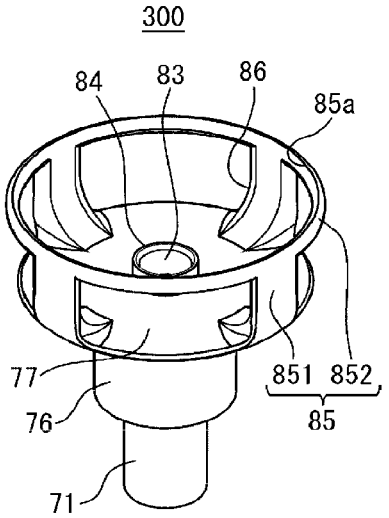
Figure 20C:
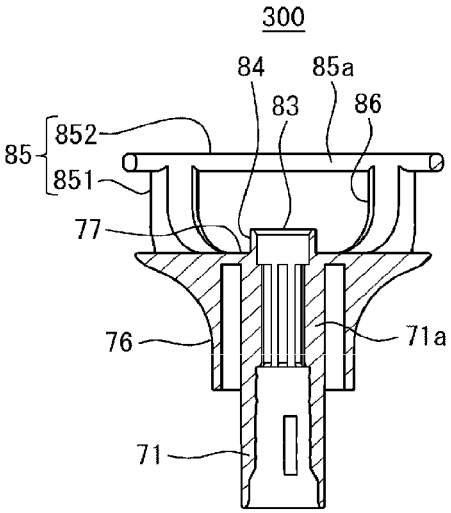
Figure 20D:
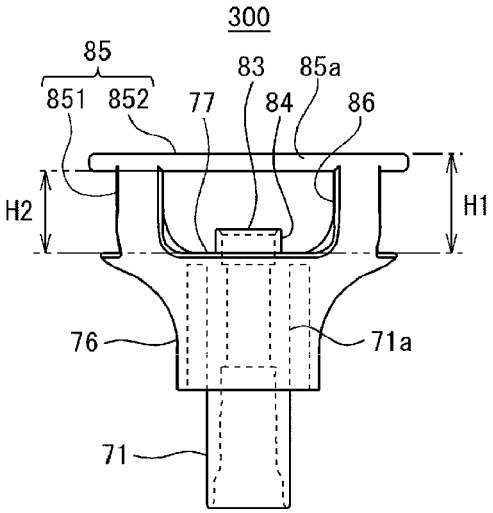

FIG. 20A is a plan view of the foam discharge head 300, FIG. 20B is a perspective view of the foam discharge head 300, FIG. 20C is a sectional view of the foam discharge head 300 taken along a line A-A of FIG. 20A, and FIG. 20D is a side view of the foam discharge head 300.

The foam discharge head 300 according to the present embodiment is different from the foam discharge head 300 according to the foregoing first embodiment in the following point, and is configured in the same manner as the foam discharge head 300 in the first embodiment in the other points.

The nozzle forming wall 84 of the foam discharge head 300 according to the present embodiment has a circular shape when viewed in the pushing direction (FIG. 20A). That is, the planar shape of the nozzle forming wall 84 is circular in planar shape. In addition, the foam discharge head 300 has a single nozzle forming wall 84.

Figure 21:
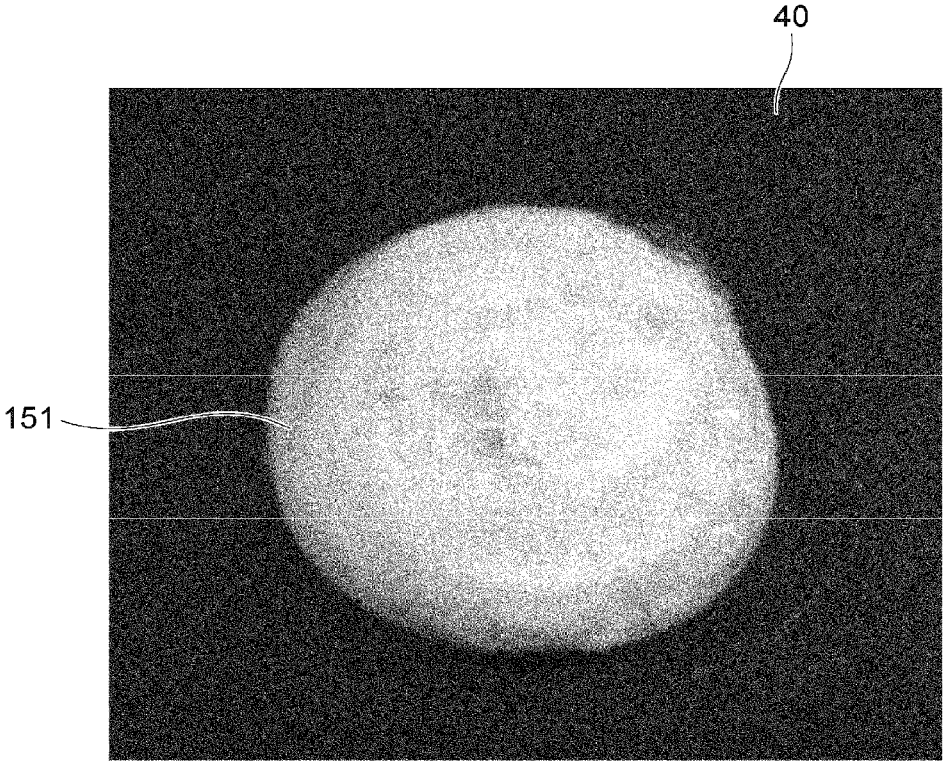
FIG. 21 is a plan view showing a state where foam is received by a discharge target body (plate) in the seventh embodiment.

Therefore, in the case of the present embodiment, for example, as shown in FIG. 21, a circular foamy body 151 can be formed. In the following description, in order to distinguish from a non-circular molded foamy object, circular foam discharged onto the discharge target body 40 is referred to as a foamy body 151.

Furthermore, in the foregoing first embodiment, the example in which the foam discharge head 300 is constituted by the two members of the first head member 70 and the second head member 80 has been described, but in the case of the present embodiment, the foam discharge head 300 is constituted by a single member.

As shown in any one of FIGS. 19, 20A, 20B, 20C and 20D, the foam discharge head 300 includes, for example, a tubular portion 71, and a table-like portion 77 provided at the upper end portion of the tubular portion 71. The upper surface of the table-like portion 77 is formed to be flat.

The foam discharge head 300 further includes a nozzle forming wall 84 protruding upward from the upper surface of the table-like portion 77, and an outer tubular portion 76 that extends downward from the table-like portion 77 and is arranged around the upper portion 71*a* of the tubular portion 71.

The nozzle forming wall 84 is arranged, for example, at a center portion of the table-like portion 77. The internal space of the tubular portion 71 intercommunicates with the internal space of the nozzle forming wall 84, and the tubular portion 71 supplies foam to the internal space of the nozzle forming wall 84. The tubular portion 71 and the nozzle forming wall 84 are arranged coaxially with each other. The internal space of the tubular portion 71 directly intercommunicates with the internal space of the nozzle forming wall 84. Therefore, in the case of the present embodiment, the foam discharge head 300 does not have the foregoing anterior chamber 30.

The inner diameter of the outer tubular portion 76 is set to be larger than the outer diameter of the tubular portion 71.

The foam discharge head 300 further includes a pushing portion 85 erected upward from a peripheral edge portion of the upper surface of the table-like portion 77. More specifically, the pushing portion 85 is configured to include plural (for example, four) pillar-shaped portions 851 which are intermittently arranged (for example, at equal angular intervals) in the peripheral direction of the upper surface of the table-like portion 77, and an annular portion 852 arranged on the upper side of the pillar-shaped portions 851. The annular portion 852 is horizontally arranged, and mutually connects the upper ends of the pillar-shaped portions 851 to one another. The pillar-shaped portions 851 correspond to the standing portion of the pushing portion 85.

Figure 19:
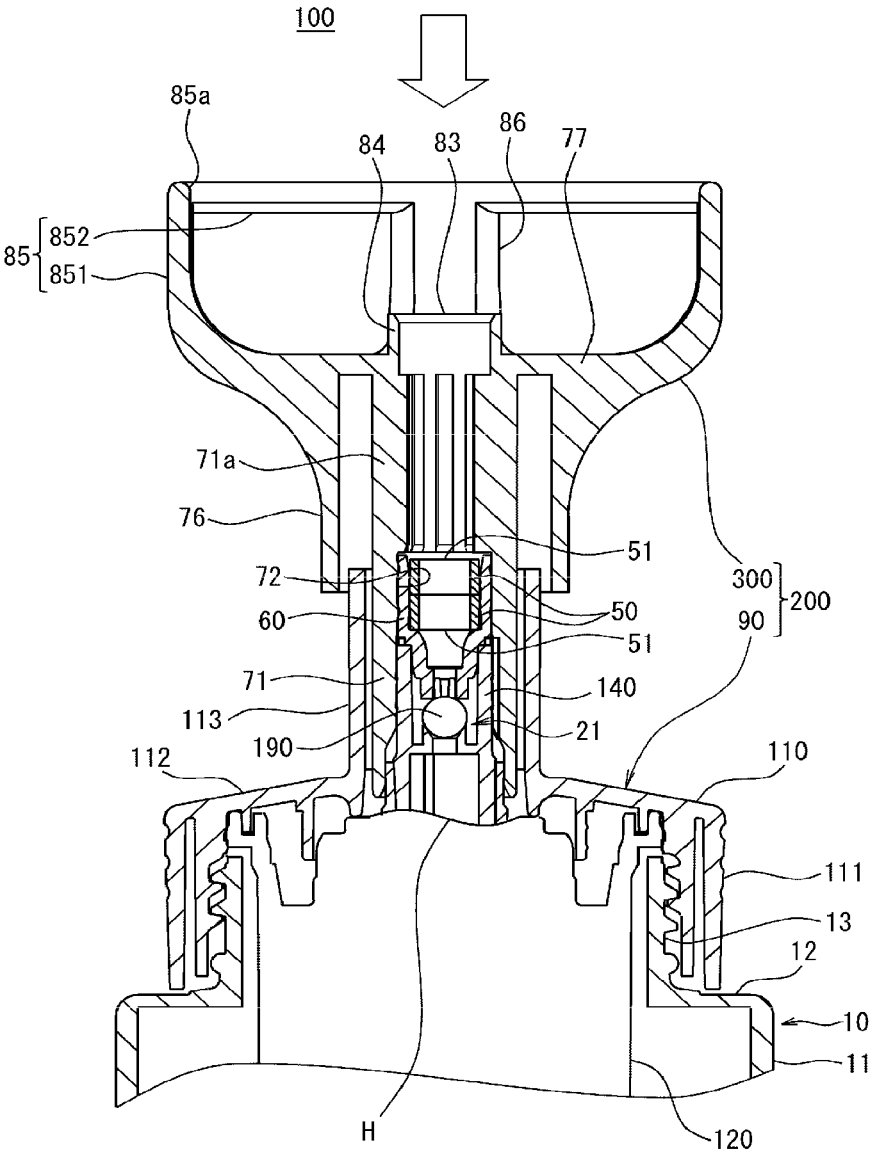
FIG. 19 is a front sectional view showing an upper portion of a foam discharge container according to a seventh embodiment.

In the case of the present embodiment, the height positions of the lower ends of the holes 86 are set to be lower than the height position of the upper end of the nozzle forming wall 84 (FIGS. 19, 20C and 20D). Therefore, even when the foam discharge container 100 is placed under an environment where shower water (hot water) or the like is sprinkled, water accumulated on the upper surface of the table-like portion 77 does not flow into the nozzle forming wall 84, and can be smoothly discharged via the holes 86 to the outside.

More specifically, in the case of the present embodiment, the height positions of the lower ends of the holes 86 are set to be equal to the height position of the upper surface of the table-like portion 77 (FIGS. 19, 20C and 20D). As a result, even when the foam discharge container 100 is placed under an environment where shower water (hot water) or the like is sprinkled, water is smoothly discharged to the outside through the holes 86, so that water can be suppressed from accumulating on the upper surface of the table-like portion 77.

In the case of the present embodiment, when the height difference from the upper surface of the table-like portion 77 to the upper end position of the annular portion 852 is taken as a height H1 (FIG. 20D), it is preferable that the height dimension H2 (FIG. 20D) of the holes 86 is, for example, equal to or more than 50% of the height H1. As a result, water can be more suitably smoothly discharged to the outside through the holes 86. Furthermore, from the viewpoint of sufficiently securing the structural strength of the pushing portion 85, it is preferable that the height dimension H2 (FIG. 20D) of the holes 86 is equal to or less than 95% of the height H1. It is to be noted that the height H1 is also the standing height of the pushing portion 85.

Furthermore, in the case of the present embodiment, the total length of regions where the holes 86 are arranged in the peripheral direction of the pushing portion 85 is preferably set in a range equal to or more than 50% of the circumferential length of the pushing portion 85, more preferably in a range equal to or more than 60%. That is, a length which is equal to four times of a length L shown in FIG. 20A is equal to or more than 50% of the circumferential length of the pushing portion 85. As a result, water can be more suitably smoothly discharged to the outside through the holes 86. From the viewpoint of sufficiently securing the structural strength of the pushing portion 85, it is preferable that the total length of regions where the holes 86 are arranged is set in a range equal to or less than 95% of the circumferential length of the pushing portion 85.

The foam discharge container 100 and the foam discharge cap 200 according to the present embodiment are different from the foam discharge container 100 and the foam discharge cap 200 according to the foregoing first embodiment in that the foam discharge head 300 shown in FIGS. 19, 20A, 20B, 20C and 20D is provided, and are configured in the same manner as the foam discharge container 100 and the foam discharge cap 200 according to the foregoing first embodiment in the other points.

In the case of the present embodiment, the push-down operation on the foam discharge head 300 is performed by pushing down the foam discharge head 300 by the discharge target body 40 while the discharge target body 40 such as a hand is caused to abut against the upper surface of the annular portion 852.

Eighth Embodiment

Next, a foam discharge container 100 according to an eighth embodiment will be described with reference to FIG. 22.

Figure 22:
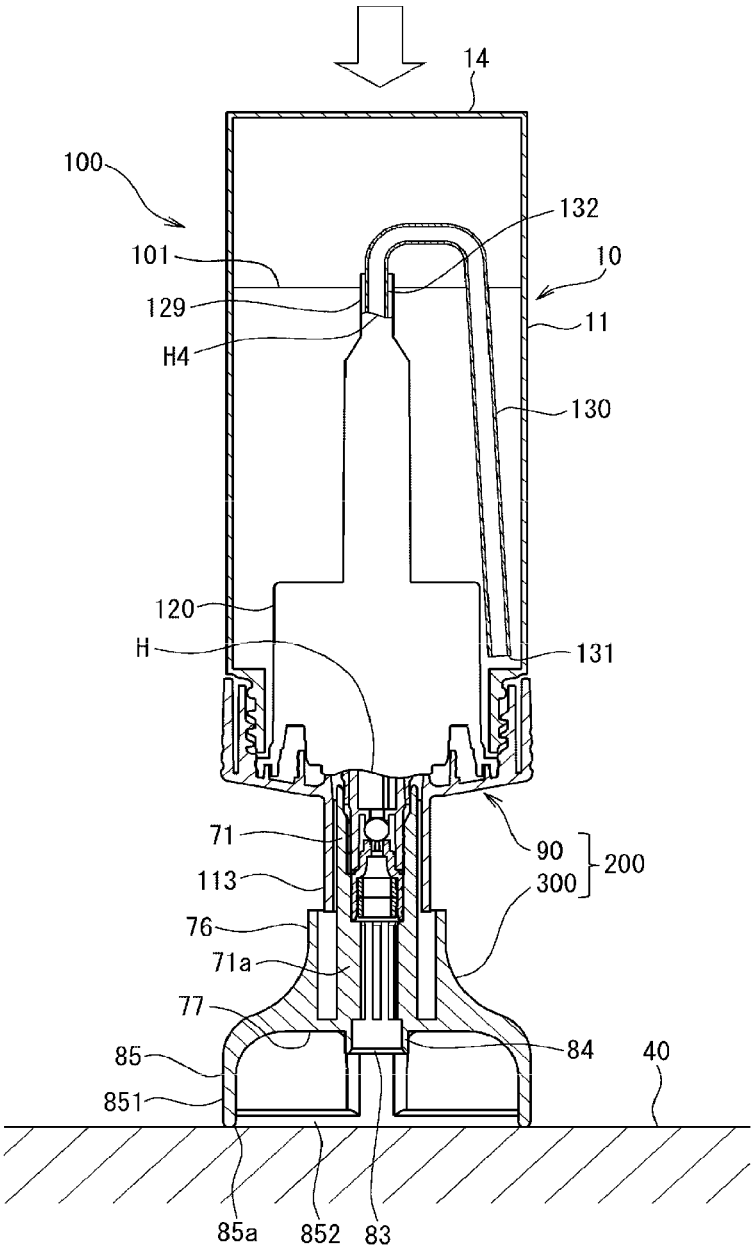
FIG. 22 is a front sectional view of a foam discharge container according to an eighth embodiment.

In FIG. 22, only an outline is shown for a portion of the foam discharge cap 200 which is located below a break line H4 and above a break line H.

The foam discharge container 100 according to the present embodiment is different from the foam discharge container 100 according to the seventh embodiment in the following point, and is configured in the same manner as the foam discharge container 100 according to the seventh embodiment in the other points.

In the case of the present embodiment, the dip tube 130 is bent, and the tip 131 of the dip tube 130 is located, for example, in the vicinity of the upper end portion of the body portion 11. As a result, the tip 131 of the dip tube 130 can be soaked in the liquid agent 101 in the container main body 10 while the foam discharge container 100 is turned upside down as shown in FIG. 22.

The base end 132 of the dip tube 130 is fixed to a cylindrical tube holding portion 129 formed at the lower end of the pump portion 120 (the upper end of the pump portion 120 in a state where the foam discharge container 100 is turned upside down as shown in FIG. 22).

As described above, the foam discharge cap 200 includes the dip tube 130 that supplies the liquid agent 101 in the container main body 10 to the pump portion 120, and the suction port of the tip 131 of the dip tube 130 is located below a liquid level of the liquid agent 101 in the container main body 10 with the discharge port 83 facing in a downward direction. Here, the downward direction is the direction of gravity.

In the case of the present embodiment, the push-down operation on the foam discharge head 300 is performed by pushing down the container main body 10 in the downward direction (the direction of gravity) while the foam discharge container 100 is turned upside down and the annular portion 852 is caused to abut against the discharge target body 40 as shown in FIG. 22. That is, the pushing operation of the foam discharge container 100 according to the present embodiment on the foam discharge head 300 is performed by pushing the container main body 10 in a direction to the discharge target body 40 while the pushing portion 85 is caused to abut against the discharge target body 40. By the pushing operation, foam passes through the nozzle forming wall 84, and is discharged from the discharge port 83. The foam popping out from the discharge port 83 is transferred to the discharge target body 40, whereby a foamy body 151 shaped into a circle as shown in FIG. 21 is set to be attached to the discharge target body 40. Here, the discharge target body 40 may be anything as long as it has an upper surface facing upward, and for example, a table, a floor, or the like may be applied as the discharge target body 40. It is to be noted that the container main body 10 is grasped by one hand and the container main body 10 is pushed down while the annular portion 852 is caused to abut against the other hand, whereby the foamy body 151 (FIG. 21) can be discharged onto the other hand (the discharge target body 40). Furthermore, the pushing operation of the foam discharge container 100 on the foam discharge head 300 may be performed by grasping the container main body 10 by one hand and pushing up the pushing portion 85 by the other hand while the annular portion 852 of the pushing portion 85 is caused to abut against the other hand placed on a lower side. In the present embodiment, the discharge target body 40 and the discharge port 83 are also kept to be spaced apart from each other from the start stage to the end stage of the pushing operation.

As described above, the foam discharge container 100 includes the container main body 10 that stores the liquid agent 101, and the foam discharge cap 200 that is mounted on the container main body 10 and discharges foam in response to the pushing operation. The foam discharge cap 200 includes the discharge port 83 and the pushing portion 85, and further includes the pump portion 120 that makes the foam from the liquid agent 101 upon movement of the container main body 10 relative to the pushing portion 85 in the opposite direction and discharges the foam from the discharge port 83. The container main body 10 is an operating portion which is grasped and pushed by a user in the pushing operation.

In the case of the present embodiment, the foam discharge container 100 is capable of self-standing in a state (a grounded state) where (the annular portion 852 of) the pushing portion 85 is in contact with a placement surface with the discharge port 83 facing in a downward direction as shown in FIG. 22. Therefore, the foam discharge container 100 can also be preserved in the posture shown in FIG. 22. The downward direction described here is also the direction of gravity.

Incidentally, by flexibly configuring the dip tube 130 and attaching a weight (not shown) to the tip 131 of the dip tube 130, the tip 131 of the dip tube 130 is enabled to be immersed in the liquid agent 101 in both of a case where the foam discharge container 100 is used under an orientation shown in FIG. 19 (the discharge port 83 faces in an upward direction) and a case where the foam discharge container 100 is used in an upside-down direction (the discharge port 83 faces in the downward direction) shown in FIG. 22. This makes it possible to use the foam discharge container 100 under both the orientations. Furthermore, in this case, even when the foam discharge container 100 is used while the discharge port 83 is placed to face in another direction other than the upward direction and the downward direction (for example, a lateral direction (horizontal direction)), the tip 131 of the dip tube 130 is enabled to be immersed in the liquid agent 101, and the molded foamy object 150 can be attached to, for example, a vertical wall surface (a wall surface perpendicular to the placement surface or the floor), or the like.

As described above, the foam discharge container 100 is an upright and inverted foam discharge container that is usable in both of an upright state where the discharge port 83 is placed to face in an upward direction and an inverted state where the discharge port 83 is placed to face in a downward direction. Since the foam discharge container 100 is an upright and inverted foam discharge container, the foam discharge container 100 can attach foam discharged from the discharge port 83 to the discharge target body 40 by performing the pushing operation on the pushing portion 85 or the container main body 10 while the pushing portion 85 is caused to abut against the discharge target body 40 to shorten a relative distance between the pushing portion 85 (the foam discharge head 300) and the container main body 10.

Ninth Embodiment

Next, a foam discharge container 100, a foam discharge cap 200, and a foam discharge head 300 according to a ninth embodiment will be described with reference to FIGS. 23 to 26.

Figure 24:
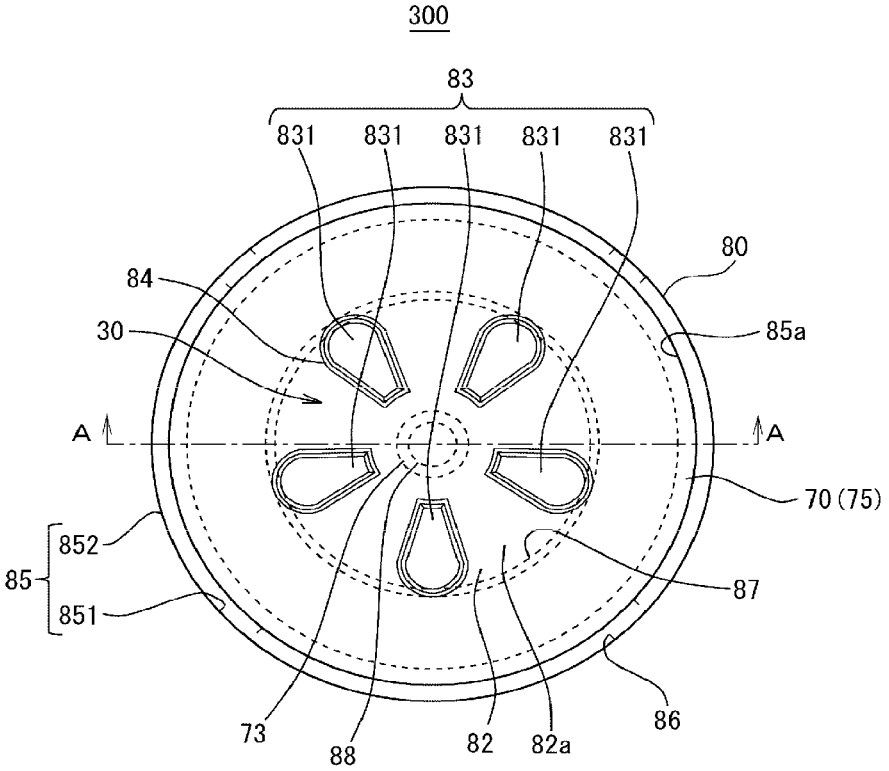
FIG. 24 is a plan view showing a foam discharge head of the foam discharge container according to the ninth embodiment.
Figure 25A:
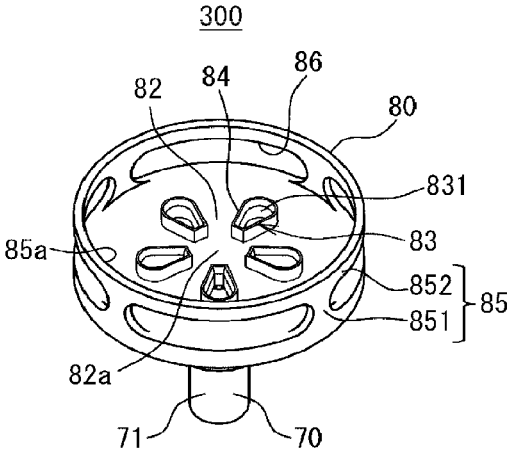
FIGS. 25A, 25B, and 25C are diagrams showing the foam discharge head of the foam discharge container according to the ninth embodiment.
Figure 25B:
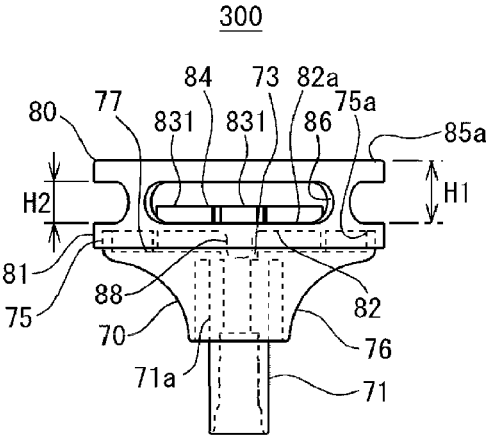
Figure 25C:
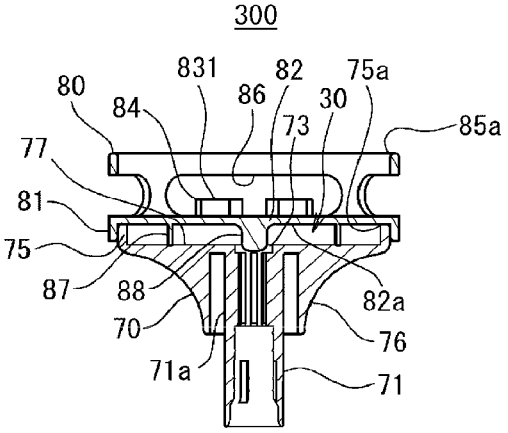

FIG. 25A is a perspective view of the foam discharge head 300, FIG. 25B is a side view of the foam discharge head 300, and FIG. 25C is a sectional view taken along a line A-A in FIG. 24.

The foam discharge container 100 according to the present embodiment is different from the foam discharge container 100 according to the foregoing eighth embodiment in that a foam discharge head 300 described below is provided, and is configured in the same manner as the foam discharge container 100 according to the foregoing eighth embodiment in the other points.

The foam discharge head 300 according to the present embodiment is different from the foam discharge head 300 according to the foregoing first embodiment (FIG. 3, FIG. 4, and FIG. 7) in the following point, and is configured in the same manner as the foam discharge head 300 according to the foregoing first embodiment in the other points.

As shown in any one of FIG. 24, FIG. 25A, FIG. 25B and FIG. 25C, the first head member 70 of the foam discharge head 300 according to the present embodiment includes a tubular portion 71, a table-like portion 77 provided at the upper end portion of the tubular portion 71, an annular wall 75 standing upward from the peripheral portion of the table-like portion 77, and an outer tubular portion 76 which extends in a downward direction from the table-like portion 77, and is arranged around the upper portion 71*a* of the tubular portion 71. The downward direction described here is the direction of gravity in a state where the bottom portion 14 of the foam discharge container 100 contacts the placement surface and the foam discharge container 100 self-stands. A primary discharge port 73 is formed at the upper end portion of the tubular portion 71. The upper surface of the table-like portion 77 is formed flatly.

Furthermore, the pushing portion 85 of the second head member 80 of the foam discharge head 300 according to the present embodiment is configured to include plural (for example, four) pillar-shaped portions 851 which are arranged intermittently (for example, at equal angular intervals) in the peripheral direction of the upper surface of the plate-like portion 82*a*, and an annular portion 852 arranged on the upper side of the pillar-shaped portions 851. The annular portion 852 is horizontally arranged, and connect the upper ends of the pillar-shaped portions 851 to one another.

Furthermore, the height positions of the lower ends of the holes 86 of the second head member 80 of the foam discharge head 300 according to the present embodiment are set to be lower than the height position of the upper end of the nozzle forming wall 84 (FIG. 25B and FIG. 25C). Therefore, even when the foam discharge container 100 is placed under an environment where shower water (hot water) is sprinkled, water accumulated on the upper surface of the plate-like portion 82*a* is smoothly discharged to the outside through the holes 86 without flowing into the nozzle forming wall 84.

More specifically, in the case of the present embodiment, the height positions of the lower ends of the holes 86 are set to be equal to the height position of the upper surface of the plate-like portion 82*a* (FIG. 25B and FIG. 25C). As a result, even when the foam discharge container 100 is placed under an environment where shower water (hot water) is sprinkled, water is smoothly discharged to the outside through the holes 86, so that water can be suppressed from be accumulated on the upper surface of the plate-like portion 82*a*.

In the present embodiment, when the height difference between the upper surface of the plate-like portion 82*a* and the upper end position of the annular portion 852 is taken as a height H1 (FIG. 25B), the height dimension H2 of the holes 86 (FIG. 25B) is preferable, for example, equal to or more than 50% of the height H1, more preferably set in a range equal to or more than 60%. As a result, water can be more appropriately smoothly discharged to the outside through the holes 86.

Furthermore, in the present embodiment, like the seventh embodiment, the total length of regions where the holes 86 are arranged in the peripheral direction of the pushing portion 85 is preferably set in a range equal to or more than 50% of the circumferential length of the pushing portion 85, more preferably set in a range equal to or more than 60%. As a result, water can be more appropriately smoothly discharged to the outside through the holes 86. From the viewpoint of sufficiently securing the structural strength of the pushing portion 85, it is preferable that the total length of the regions where the holes 86 are arranged is set in a range equal to or less than 95% of the circumferential length of the pushing portion 85.

Figure 23:
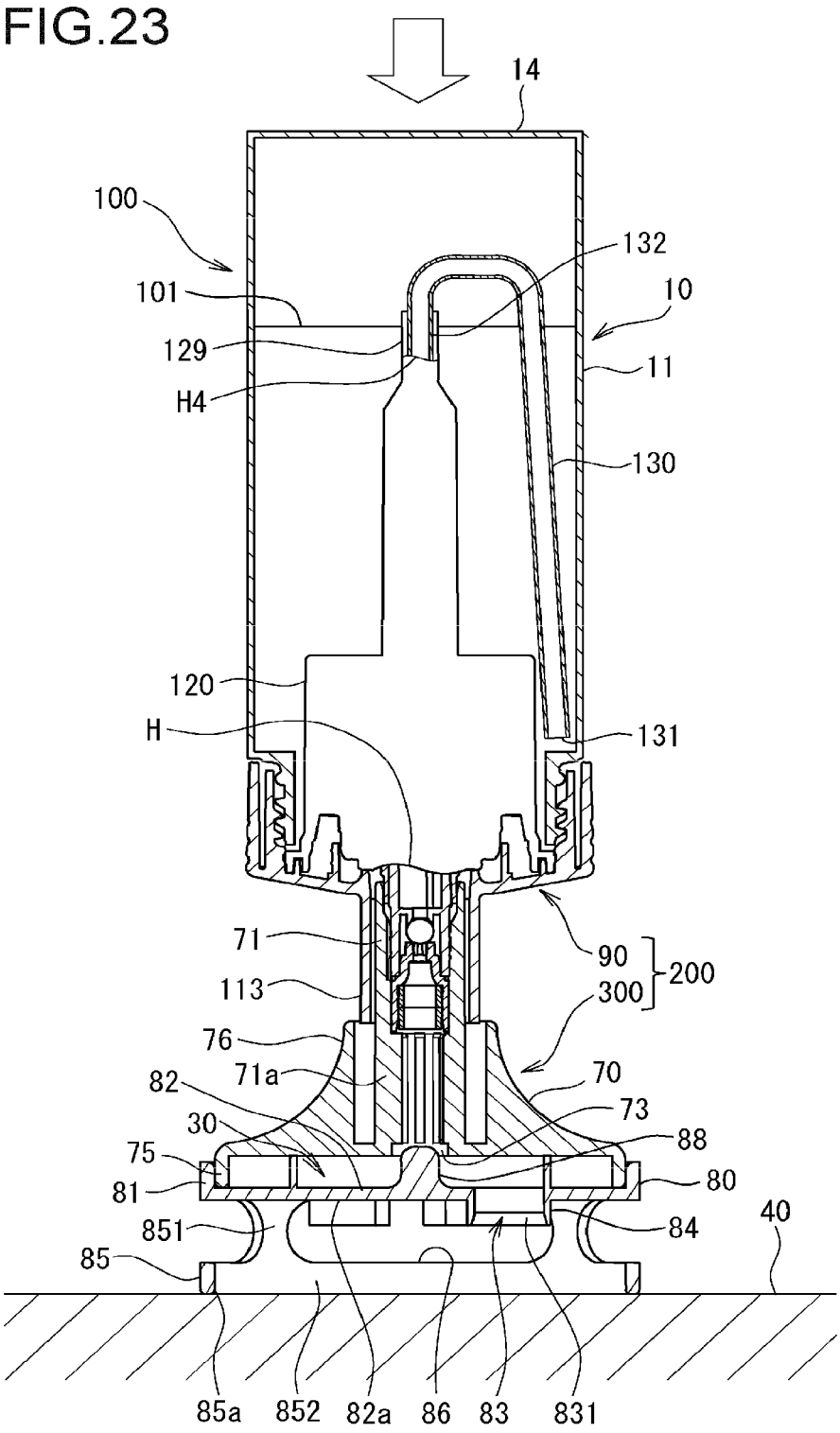
FIG. 23 is a front sectional view of a foam discharge container according to a ninth embodiment.

In the case of the present embodiment, like the eighth embodiment, the push-down operation on the foam discharge head 300 is performed by pushing down the container main body 10 downward while the annular portion 852 is made to abut against the discharge target body 40 as shown in FIG. 23. By the pushing operation, the foam passes through the nozzle forming wall 84 to be shaped in a predetermined intended shape and attaches to the discharge target body 40. That is, the foam popping out from the discharge port 83 is transferred onto the discharge target body 40, and as shown in FIG. 26, the molded foamy object 150 which is the foam shaped in the predetermined intended shape has been attached to the discharge target body 40.

Figure 26:
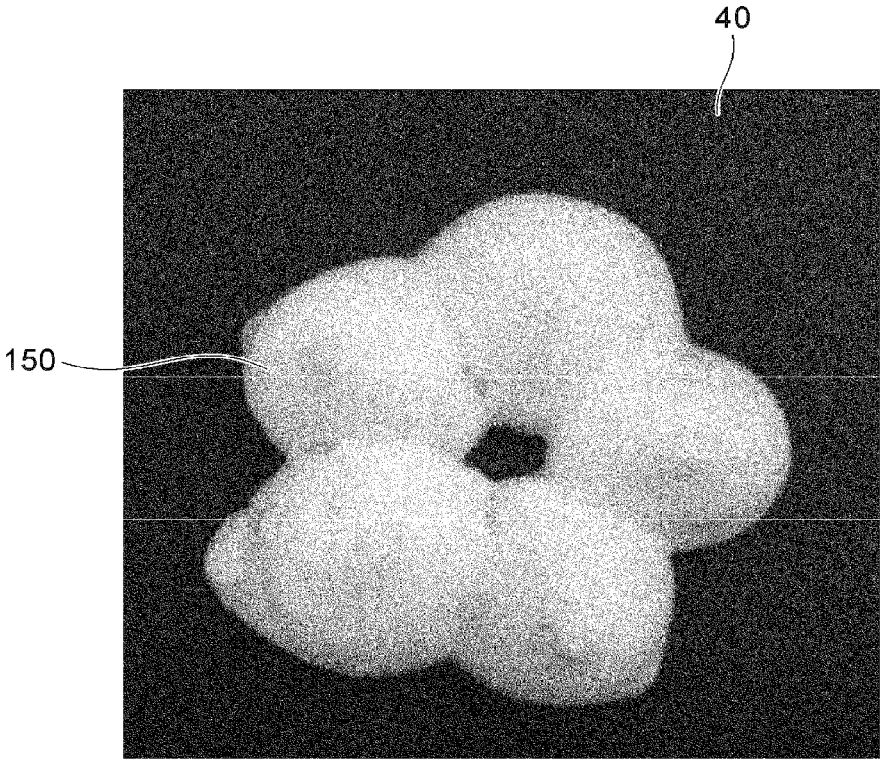
FIG. 26 is a plan view showing a state where foam is received by a discharge target body (plate) in the ninth embodiment.

In the case of the present embodiment, as shown in FIG. 26, the molded foamy object 150 has a shape simulating a flower.

As shown in FIGS. 24A and 24B, the discharge port 83 and the nozzle forming wall 84 are adaptable to the molded foamy object 150 having such a shape.

The discharge port 83 is configured to include plural (for example, five) openings 831.

The second head member 80 of the foam discharge head 300 has plural nozzle forming walls 84 corresponding to the respective openings 831.

The opening 831 of each nozzle forming wall 84 has a planar shape simulating a petal, and these openings 831 are radially arranged.

As shown in FIG. 26, bubbles discharged from the openings 831 are integrated, whereby the molded foamy object 150 has a shape simulating a flower.

Of course, the foam discharge head 300 having the structure described in the ninth embodiment is applicable to such a foam discharge container 100 that the foam discharge head 300 is pushed down with the discharge target body 40 like the foam discharge container 100 according to the first embodiment.

Tenth Embodiment

Next, a foam discharge container 100, a foam discharge cap 200, and a foam discharge head 300 according to a tenth embodiment will be described with reference to FIGS. 27 to 29. In the sectional view of FIG. 27, a front-view structure is shown for a portion between a break line H5 and a break line H6 in the foam discharge cap 200.

In the case of the present embodiment, like the eighth and ninth embodiments, the user can use the foam discharge container 100 while grasping the container main body 10.

That is, the foam discharge container 100 includes the container main body 10 for storing the liquid agent 101, and the foam discharge cap 200 that is attached to the container main body 10 and discharges foam in response to the pushing operation. The foam discharge cap 200 includes a discharge port 83 and a pushing portion 85, and further includes a pump portion 120 for making the foam from the liquid agent 101 and discharging the foam from the discharge port 83 upon relative movement of the container main body 10 in the opposite direction with respect to the pushing portion 85. The container main body 10 is a pushing portion which is grasped and pushed by a user in the pushing operation. The pushing operation of the foam discharge container 100 according to the present embodiment on the foam discharge head 300 is performed by pushing the container main body 10 in a direction of the discharge target body 40 while the pushing portion 85 is made to abut against the discharge target body 40.

Also, in the case of the present embodiment, like the eighth and ninth embodiments, the foam discharge container 100 is capable of self-standing while (the annular portion 852 of) the pushing portion 85 is in contact with the placement surface with the discharge port 83 facing in a downward direction. The downward direction described here is the direction of gravity.

Also, in the case of this embodiment, as in the eighth and ninth embodiments, the foam discharge cap 200 includes a dip tube 130 that supplies the liquid agent 101 in the container main body 10 to the pump portion 120. The suction port of the tip 131 of the dip tube 130 is located below the liquid level of the liquid agent 101 in the container main body 10 with the discharge port 83 facing in the downward direction. The downward direction described here is the direction of gravity.

The foam discharge container 100 according to the present embodiment is different from the foam discharge container 100 according to the ninth embodiment in the following point, and is configured in the same manner as the foam discharge container 100 according to the ninth embodiment in the other points.

Furthermore, in the case of the present embodiment, a portion (a top portion 15 in the present embodiment) on an opposite side of the foam discharge container 100 to the discharge port 83 is formed as a portion which is not placed on the placement surface, that is, a non-placement portion. As shown in FIG. 27, the top portion 15 of the container main body 10 when the foam discharge container 100 self-stands while the pushing portion 85 is in contact with the placement surface is formed in a convex shape protruding to the outside of the container main body 10, and preferably formed in a curved shape protruding to the outside of the container main body 10, more preferably formed in a hemispherical shape protruding upward.

Therefore, in the present embodiment, the top portion 15 which is the portion on the opposite side of the foam discharge container 100 to the discharge port 83 is a non-placement portion which makes it impossible for the foam discharge container 100 to self-stand when the top portion 15 is placed to be in contact with the ground.

Since the top portion 15 is hemispherical, for example, it is possible to appropriately perform an operation of grasping the container main body 10 as if the top portion is wrapped by hand and moving the container main body 10 as an operating portion in the opposite direction relatively to the pushing portion 85. The shape of the top portion 15 is not limited to a hemispherical shape, but may be a shape having a sloped surface, a conical shape, a quadrangular pyramid shape, or the like.

The structure of the foam discharge cap 200 in the present embodiment will be described hereinafter in more detail.

Figure 27:
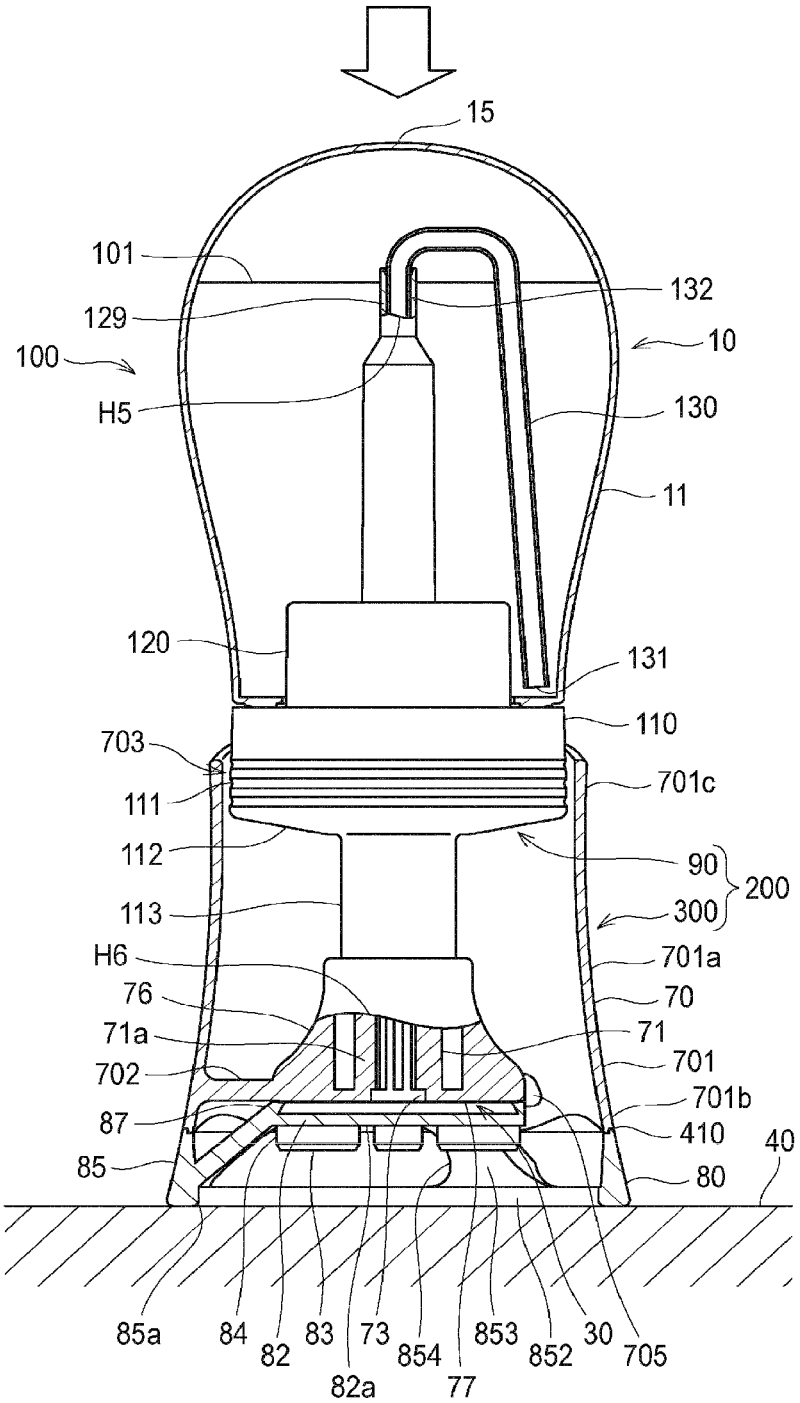
FIG. 27 is a front sectional view of a foam discharge container according to a tenth embodiment.

As shown in FIG. 27, also in the case of the present embodiment, the foam discharge cap 200 is configured to include the cap 90 and the foam discharge head 300.

The structure of the cap 90 is the same as the respective embodiments described above. However, in the case of the present embodiment, the discharge port 83 of the foam discharge container 100 is postured so as to face downward as shown in FIG. 27 under a normal installation state, and therefore, with respect to the common configuration (the cap 90 etc.) to the respective embodiments described above, the positional relationship of the respective components is set so that the components are placed upside down with respect to the respective embodiments described above.

Figure 28:
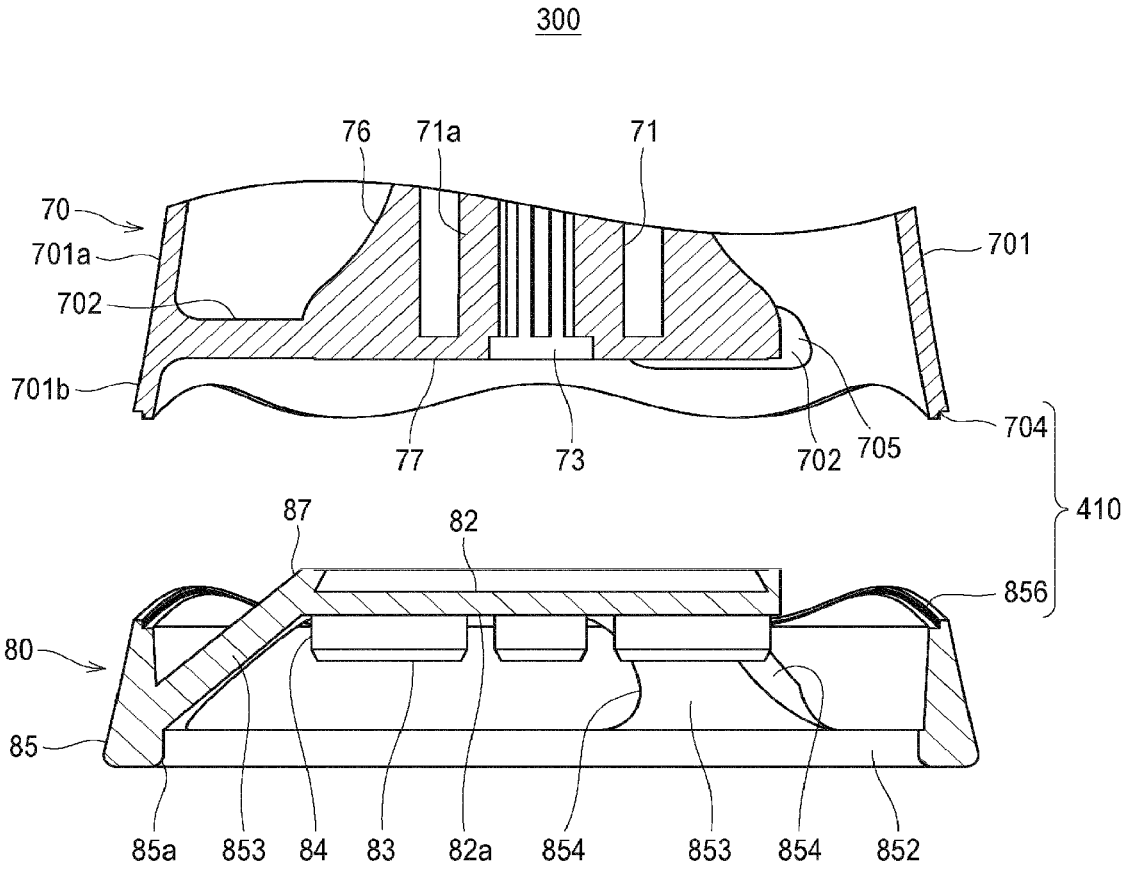
FIG. 28 is an exploded sectional view of a foam discharge head of a foam discharge container according to the tenth embodiment.
Figure 29:
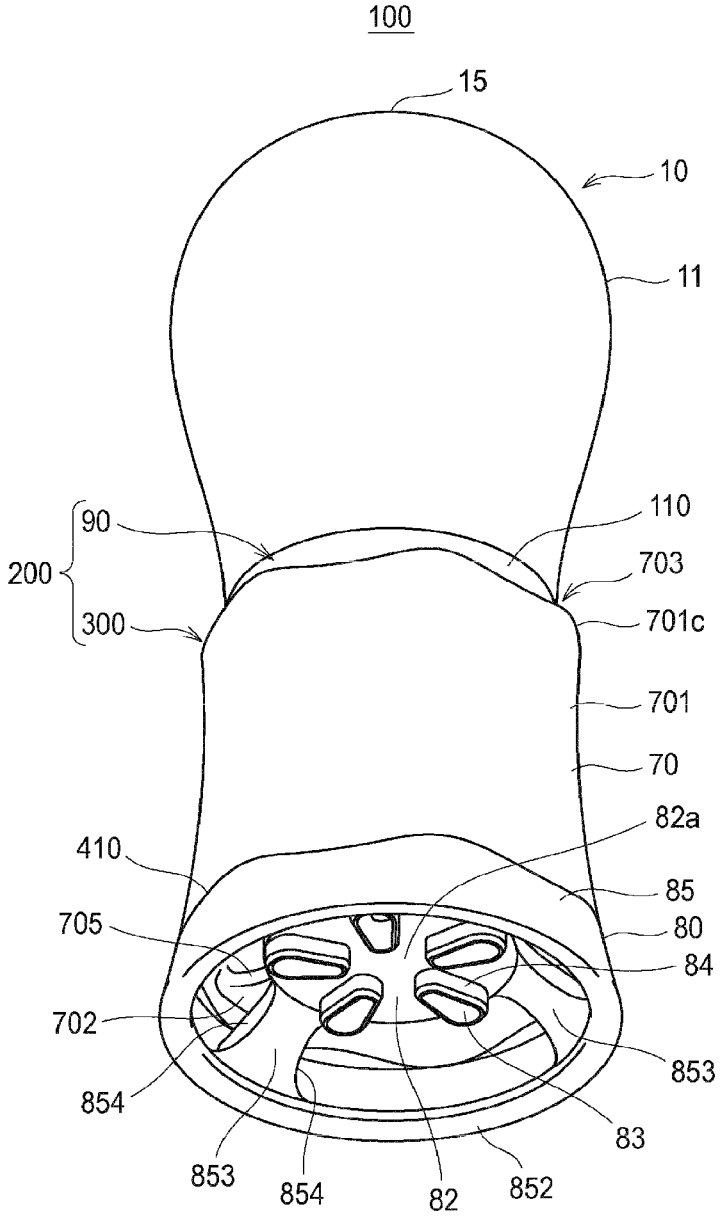
FIG. 29 is a perspective view when the foam discharge container according to the tenth embodiment is viewed from a lower side thereof.

As shown in FIG. 28, the foam discharge head 300 is configured to include a first head member 70 and a second head member 80.

As shown in FIGS. 27 and 28, like the ninth embodiment, the first head member 70 includes a tubular portion 71, a table-like portion 77, a primary discharge port 73, and an outer tubular portion 76. However, in the case of the present embodiment, the first head member 70 does not have the annular wall 75 (FIG. 23).

The connection structure between the first head member 70 and the cap 90 is the same as that of the ninth embodiment.

In the case of the present embodiment, the first head member 70 includes plural (three as an example) connecting portions 702 which radially extend from the outer peripheral portion of the table-like portion 77 circumferentially, and a second outer tubular portion 701 connected to the table-like portion 77 through the connecting portions 702.

The second outer tubular portion 701 is formed in a tubular shape (for example, substantially cylindrical shape), and covers the periphery of the outer tubular portion 76, the periphery of the standing tubular portion 113, and the periphery of at least the lower portion of the mounting portion 111.

The second outer tubular portion 701 includes an upper portion 701*a* located above the table-like portion 77 and the connecting portions 702, and a lower portion 701*b* located below the table-like portion 77 and the connecting portions 702.

It is to be noted that the gap between the adjacent connecting portions 702 serves as an opening 705 through which the internal space of the lower portion 701*b* and the internal space of the upper portion 701*a* is allowed to intercommunicate with each other.

As shown in FIG. 28, the second head member 80 includes the facing portion 82 (the plate-like portion 82*a*, the nozzle forming wall 84, the discharge port 83) and the surrounding wall 87 like the ninth embodiment.

In the case of the present embodiment, the surrounding wall 87 is, for example, sloped and reduced in diameter upwards.

In the case of the present embodiment, the second head member 80 does not have the protruding portion 88 (FIG. 23), the annular wall 81 (FIG. 23), and the holes 86 (FIG. 23) formed in the pushing portion 85.

In the case of the present embodiment, the second head member 80 has plural (three as one example) connecting portions 853 radially extending from the outer peripheral portion of the plate-like portion 82*a* of the facing portion 82 circumferentially. The plate-like portion 82*a* and the pushing portion 85 are connected to each other via the connecting portions 853.

The pushing portion 85 is formed in a tubular shape (for example, substantially cylindrical shape), and is arranged so as to surround the periphery of the facing portion 82 in plan view.

Each connecting portion 853 is arranged while postured so as to be inclined downward from the facing portion 82 side (inside) to the pushing portion 85 side (outside). That is, the tip of the connecting portion 853 (the connecting end between the connecting portion 853 and the pushing portion 85) is arranged at a position lower than the base end of the connecting portion 853 (the connecting end between the connecting portion 853 and the plate-like portion 82*a*).

The pushing portion 85 includes a portion located above the tip of the connecting portion 853 and a portion located below the tip of the connecting portion 853.

The gap between the adjacent connecting portions 853 serves as an opening 854 for allowing intercommunication between a region of the internal space of the pushing portion 85 below the connecting portions 853 and a region of the internal space of the pushing portion 85 or the second outer tubular portion 701 above the connecting portions 853.

Furthermore, in the case of the present embodiment, at least the lower portion of the foam discharge cap 200 is formed so as to be wide-based when the foam discharge container 100 self-stands while the pushing portion 85 is in contact with the placement surface as shown in FIG. 27. In addition, the foam discharge cap 200 increases in diameter in the opposite direction.

Therefore, the foam discharge container 100 is enabled to more stably self-stand in the posture of FIG. 27.

More specifically, at least the lower portion of the second outer tubular portion 701 (for example, a portion including a lower portion of the upper portion 701*a* and the lower portion 701*b*) has a wide-based shape. That is, at least the lower portion of the second outer tubular portion 701 gradually increases in diameter downwards.

Furthermore, the pushing portion 85 also has a wide-based shape (gradually increases in diameter downwards (in the opposite direction)).

The outer peripheral surface of the foam discharge cap 200 has a continuous curved shape from the second outer tubular portion 701 to the pushing portion 85, and a portion including the lower portion of the second outer tubular portion 701 and the pushing portion 85 is wide-based.

As shown in FIG. 27, a lower end edge of the second outer tubular portion 701 and an upper end edge of the pushing portion 85 are fitted to each other at a fitting portion 410, whereby the first head member 70 and the second head member 80 are connected to each other.

In a state where the first head member 70 and the second head member 80 are connected to each other, the upper end of the surrounding wall 87 is in contact with or in proximity to the lower surface of the table-like portion 77, and the anterior chamber 30 surrounded by the surrounding wall 87 is formed between the plate-like portion 82*a* and the table-like portion 77.

As shown in FIG. 28, at a lower end edge of the second outer tubular portion 701, an engaging portion 704 is continuously formed over the entire region in the peripheral direction of the lower end edge, and at an upper end edge of the pushing portion 85, an engaging portion 856 is continuously formed over the entire region in the peripheral direction of the upper end edge.

A step is formed in each of the engaging portion 704 and the engaging portion 856, and the step of the engaging portion 704 and the step of the engaging portion 856 are engaged with each other, whereby the engaging portion 704 and the engaging portion 856 are fitted to each other.

Each of the engaging portion 704 and the engaging portion 856 is formed to have a vertically undulating waveform. Under a state where the engaging portion 704 and the engaging portion 856 are fitted to each other, the undulating shape of the engaging portion 704 and the undulating shape of the engaging portion 856 are continuously in close contact with each other over the peripheral direction of the lower end edge of the second outer tubular portion 701 and the upper end edge of the pushing portion 85 with no gap. A portion at which the engaging portion 704 and the engaging portion 856 are in close contact with each other is formed in a wave-like shape as shown in FIG. 29. Furthermore, the upper end portion 701*c* of the second outer tubular portion 701 is also formed in a wave-like shape as shown in FIG. 29. The wave-like shape of the upper end portion 701*c* of the second outer tubular portion 701 has a shape in which the concave and convex positions thereof are coincident with those of the wave-like shapes of the engaging portion 704 and the engaging portion 856.

Furthermore, the second head member 80 is restricted from rotating relatively to the first head member 70 in the peripheral direction.

A connecting portion 702 and a connecting portion 853 are formed in the same planar shape, and also the connecting portion 702 and the connecting portion 853 overlap each other vertically in a state where the first head member 70 and the second head member 80 are connected to each other. Therefore, an opening 854 and an opening 705 have the same planar shape, and also the opening 854 and the opening 705 overlap each other vertically in a state where the first head member 70 and the second head member 80 are connected to each other.

Here, a region below the connecting portion 853 in the internal space of the pushing portion 85 intercommunicates with a region above the connecting portion 853 in the internal spaces of the pushing portion 85 and the second outer tubular portion 701 via plural openings 854.

Furthermore, a region above the connecting portion 853 in the internal spaces of the pushing portion 85 and the second outer tubular portion 701 intercommunicates with a region above the connecting portion 702 in the internal space of the second outer tubular portion 701 via plural openings 705.

A region above the connecting portion 702 in the internal space of the second outer tubular portion 701 intercommunicates with the external space of the foam discharge container 100 via a gap 703 between the inner peripheral surface of the upper end portion 701*c* of the second outer tubular portion 701 and the outer peripheral surface of a mounting portion 111. The outer peripheral surface of the mounting portion 111 and the inner peripheral surface of the upper end portion 701*c* of the second outer tubular portion 701 are in proximity to each other.

In the case of the present embodiment, the container main body 10 has a cylindrical neck portion, and the mounting portion 111 is screwed to the neck portion, whereby the mounting portion 111 is mounted around the neck portion.

As described above, the container main body 10 has the neck portion, and the foam discharge cap 200 has the tubular mounting portion 111 that is mounted on the neck portion while surrounding the neck portion, and a tubular portion (second outer tubular portion 701) that extends from the pushing portion 85 to the container main body 10 and covers the periphery of the mounting portion 111 or the container main body 10. The pushing portion 85 is an annular standing wall that surrounds the periphery of the discharge port 83 and stands in the opposite direction (downward in the present embodiment) beyond the discharge port 83. The internal space of the pushing portion 85 intercommunicates with the external space of the foam discharge container 100 via the internal space of the tubular portion (the second outer tubular portion 701) and the gap 703 between the inner peripheral surface of the tubular portion and the outer peripheral surface of the mounting portion 111.

Therefore, when foam is discharged from the discharge port 83, the atmosphere (air) in the internal space of the pushing portion 85 can be easily released to the external space of the foam discharge container 100 via the internal space of the tubular portion (second outer tubular portion 701) and the gap 703 between the inner peripheral surface of the tubular portion and the outer peripheral surface of the mounting portion 111.

Therefore, foam can be more smoothly discharged from the discharge port 83.

Furthermore, the foam discharge cap 200 includes the tubular portion (the second outer tubular portion 701), which stabilizes the self-standing state of the foam discharge container 100 and makes the design of the foam discharge container 100 excellent.

The example in which the gap 703 is formed between the inner peripheral surface of the tubular portion (the second outer tubular portion 701) and the outer peripheral surface of the mounting portion 111 has been described here. However, the present invention is not limited to this example, and the gap 703 may be formed between the inner peripheral surface of the tubular portion (the second outer tubular portion 701) and the outer peripheral surface of the body portion 11 of the container main body 10, or may be formed between the outer peripheral surface of both the body portion 11 of the container main body 10 and the mounting portion 111 and the inner peripheral surface of the tubular portion (the second outer tubular portion 701).

In the case of the present embodiment, the gap 703 is not so narrow that the mounting portion 111 and the second outer tubular portion 701 are guided by each other when the container main body 10 is operated in the opposite direction.

However, the present invention is not limited to this example, and the gap 703 may be formed to be narrower, so that the mounting portion 111 and the second outer tubular portion 701 is guided to each other when the container main body 10 is operated in the opposite direction.

That is, the foam discharge container 100 may be configured so that the container main body 10 has the neck portion, the foam discharge cap 200 has a tubular mounting portion 111 which is mounted on the neck portion while surrounding the neck portion, and the tubular portion (second outer tubular portion 701) which extends from the pushing portion 85 to the container main body 10 side and is arranged coaxially with the mounting portion 111, and the tubular portion and the mounting portion 111 guide each other in the pushing operation.

In this case, for example, the relative movement between the container main body 10 and the foam discharge head 300 is guided by the outer peripheral surface of the mounting portion 111 and the outer peripheral surface of the second outer tubular portion 701 which are larger in diameter than the inner peripheral surface of the outer tubular portion 76 and the outer peripheral surface of the standing tubular portion 113. Therefore, the container main body 10 can be more stably pushed in the pushing operation.

Furthermore, the tubular portion (the second outer tubular portion 701) may be arranged around the container main body 10 coaxially with the container main body 10, and the tubular portion and the container main body 10 may guide each other in the pushing operation. Furthermore, in the pushing operation, the tubular portion and the container main body 10 may guide each other, and the tubular portion and the mounting portion 111 may guide each other.

Eleventh Embodiment

Next, a liquid agent discharge container 500, a liquid agent discharge cap 600, and a liquid agent discharge head 700 according to an eleventh embodiment will be described with reference to FIGS. 30 to 32. In a sectional view of FIG. 30, a front structure is shown for a portion between a break line H5 and a break line H6 in the container main body 10 and the liquid agent discharge cap 600.

Although foam is discharged from the container in each of the foregoing embodiments, a non-foamy liquid agent 101 is discharged from the container in the present embodiment. That is, the liquid agent 101 in the container main body 10 is discharged onto a discharge target body 40 as it is.

Figure 30:
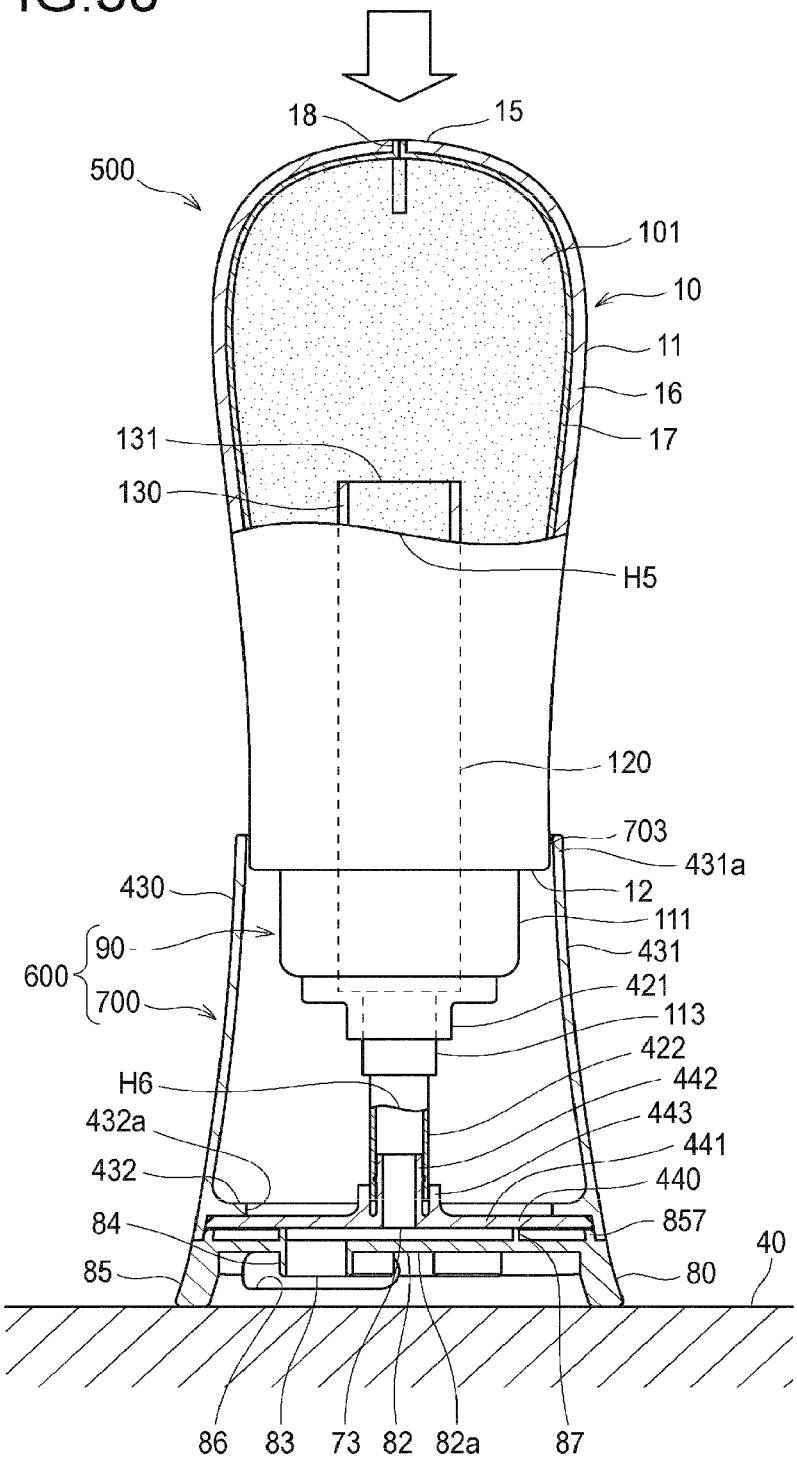
FIG. 30 is a front sectional view of a liquid agent discharge container according to an eleventh embodiment.

Furthermore, in the case of the present embodiment, under a normal placement state of the liquid agent discharge container 500, a discharge port 83 is postured to face in a downward direction as shown in FIG. 30. The downward direction described here is the direction of gravity. Therefore, with respect to the common configuration to the first to ninth embodiments described above, the positional relationship of the respective components is set so that the components are placed upside down with respect to the first to ninth embodiments.

The liquid agent discharge container 500 according to the present embodiment is a liquid agent discharge container 500 that discharges a liquid agent in response to the pushing operation, the liquid agent discharge container including a container main body 10 that stores the liquid agent 101, and a liquid agent discharge cap 600 that is mounted on the container main body 10, and discharges the liquid agent 101 in response to the pushing operation.

The liquid agent discharge cap 600 includes a discharge port 83 which is opened in a direction opposite of the pushing direction of the pushing operation and discharges the liquid agent 101, a pushing portion 85 that keeps the distance between the discharge target body 40 receiving the liquid agent 101 and the discharge port 83 constant, and a pump portion 120 that causes the liquid agent 101 to be discharged from the discharge port 83 upon movement of the container main body 10 relative to the pushing portion 85 in the opposite direction.

The container main body 10 is an operating portion to be grasped and pushed by a user in the pushing operation.

With respect to various definitions in the case of the present embodiment, description on the same definitions as those in the foregoing embodiments will not be repeated.

According to the present embodiment, it is possible to receive a liquid agent on a discharge target body such as a hand by one-hand operation.

The liquid agent 101 can be discharged from the discharge port 83 onto the discharge target body 40 by performing an operation of grasping the container main body 10 by a user and moving downward the container main body 10 as an operating portion relatively to the pushing portion 85 while the pushing portion 85 is pushed against the upper surface of the discharge target body 40. Specifically, this operation is performed by pushing the container main body 10 in a direction facing the discharge target body 40 while the pushing portion 85 is caused to abut against the discharge target body 40. In the present embodiment, the discharge target body 40 and the discharge port 83 are kept to be spaced apart from each other from a start stage to an end stage of the pushing operation.

In the case of the present embodiment, since the liquid agent discharge container 500 discharges the liquid agent 101 while the liquid agent 101 is kept liquid, the pump portion 120 is a hand-push type liquid pump unlike the hand-push type foam pump described in each of the foregoing embodiments. Furthermore, the liquid agent discharge container 500 does not have the foamer mechanism 20.

The liquid agent discharge cap 600 includes a cap 90 having the pump portion 120, and a liquid agent discharge head 700 mounted on the cap 90.

The liquid agent discharge head 700 is pushed into the container main body 10 side, whereby the pump portion 120 causes the liquid agent 101 to be discharged from the discharge port 83 while the liquid agent 101 is kept liquid.

The structure of the liquid pump (pump portion 120) is well known, and thus detailed description thereon will be omitted in this specification.

In the case of the present embodiment, the direction of the discharge port 83 when the liquid agent 101 is discharged is not limited to the downward direction. Depending on the viscosity of the liquid agent 101, the liquid agent discharge container 500 may be used while the discharge port 83 is oriented upward or in another direction other than the upward direction and the downward direction (for example, laterally (horizontal direction)), whereby the liquid agent 101 discharged from the discharge port 83 can be attached to, for example, a surface facing downward, a wall surface perpendicular to a placement surface or a floor, or the like.

In the present embodiment, a conditioner can be cited as a representative example of the liquid agent 101. However, the liquid agent 101 is not limited to the conditioner, and it is possible to exemplify various materials used in a liquid state (a state of fluid) such as a cleansing agent, a cosmetic agent such as a skin care cream, a gel sterilizing agent, a gel stamp for a toilet, a cosmetic for hair, various kinds of foods (for example, edible fats and oils such as mayonnaise and margarine, creams, etc.), etc.

The cap 90 includes, for example, a mounting portion 111 to be mounted on a neck portion of the container main body 10, an annular portion 421 mounted on the lower side of the mounting portion 111, a standing tubular portion 113 penetrating through the mounting portion 111 and the annular portion 421 and protruding downward, and a tubular portion 422 protruding further downward from the standing tubular portion 113.

The liquid agent discharge head 700 is mounted on the lower end portion of the tubular portion 422.

As shown in FIG. 30, in the case of the present embodiment, the liquid agent discharge container 500 is a so-called delamination (delamination) container, and the container main body 10 is configured to include an outer shell 16 made of hard synthetic resin, and an inner bag 17 accommodated inside the outer shell 16. The outer shell 16 has a body portion 11, a shoulder portion 12, a top portion 15, and a neck portion. The liquid agent 101 is accommodated inside the inner bag 17. The tip 131 of a dip tube 130 is located inside the inner bag 17.

Furthermore, the container main body 10 has an introduction portion 18 for introducing outside air into a space between the inner peripheral surface of the outer shell 16 and the outer surface of the inner bag 17.

When the liquid agent 101 is discharged from the liquid agent discharge container 500 and the liquid agent 101 stored in the inner bag 17 is reduced, the inner bag 17 deflates and peels off from the outer shell 16, and also outside air is introduced through the introduction portion 18 into a space between the inner peripheral surface of the outer shell 16 and the outer surface of the inner bag 17.

The inflow of outside air into the inner bag 17 is substantially prevented.

Figure 31:
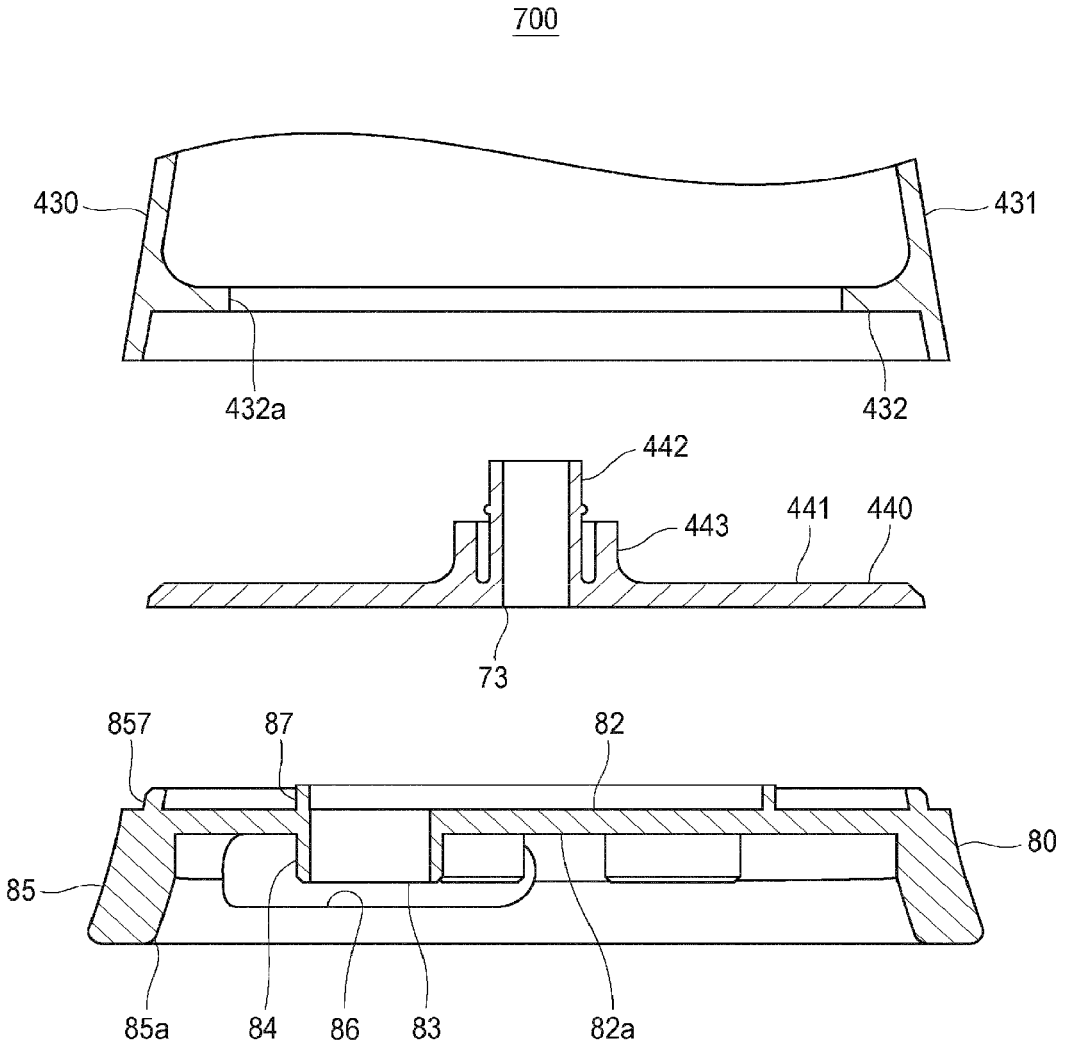
FIG. 31 is an exploded sectional view of a liquid agent discharge head of the liquid agent discharge container according to the eleventh embodiment.

As shown in FIG. 31, the liquid agent discharge head 700 is configured, for example, by assembling three members of a first head member 440, a second head member 80, and a third head member 430 to one another.

The first head member 440 includes a plate-like portion 441 being a flat plate-like portion which is circular in plan view, an inner tubular portion 442 which stands upward from the center portion of the plate-like portion 441, and an outer tubular portion 443 which is arranged around the inner tubular portion 442 so as to be coaxial with the inner tubular portion 442, and stands upward from the center portion of the plate-like portion 441.

A hole penetrating through the inner tubular portion 442 and the plate-like portion 441 is formed in the center portion of the first head member 440, and the lower end of the hole serves as a primary discharge port 73.

The second head member 80 has a facing portion 82 having a plate-like portion 82*a*.

The facing portion 82 further includes a nozzle forming wall 84 having a discharge port 83.

The second head member 80 further includes a pushing portion 85 extending downward from the peripheral edge portion of the plate-like portion 82*a*, a fitting wall 857 which stands upward from the peripheral edge portion of the plate-like portion 82*a* and is circular in plan view, and a surrounding wall 87 standing upward from the upper surface of the plate-like portion 82*a* inside the fitting wall 857. A region surrounded by the surrounding wall 87 is an anterior chamber 30. The liquid agent 101 is discharged to the anterior chamber 30 via the primary discharge port 73, spreads in the anterior chamber 30, and is discharged from the discharge port 83. In plan view, the discharge port 83 is arranged in a region inside the surrounding wall 87. One or plural holes 86 (for example, two holes as shown in FIG. 32) are formed in the pushing portion 85.

The discharge port 83 is configured to include plural openings. In addition, each opening has a non-circular shape.

Figure 32:
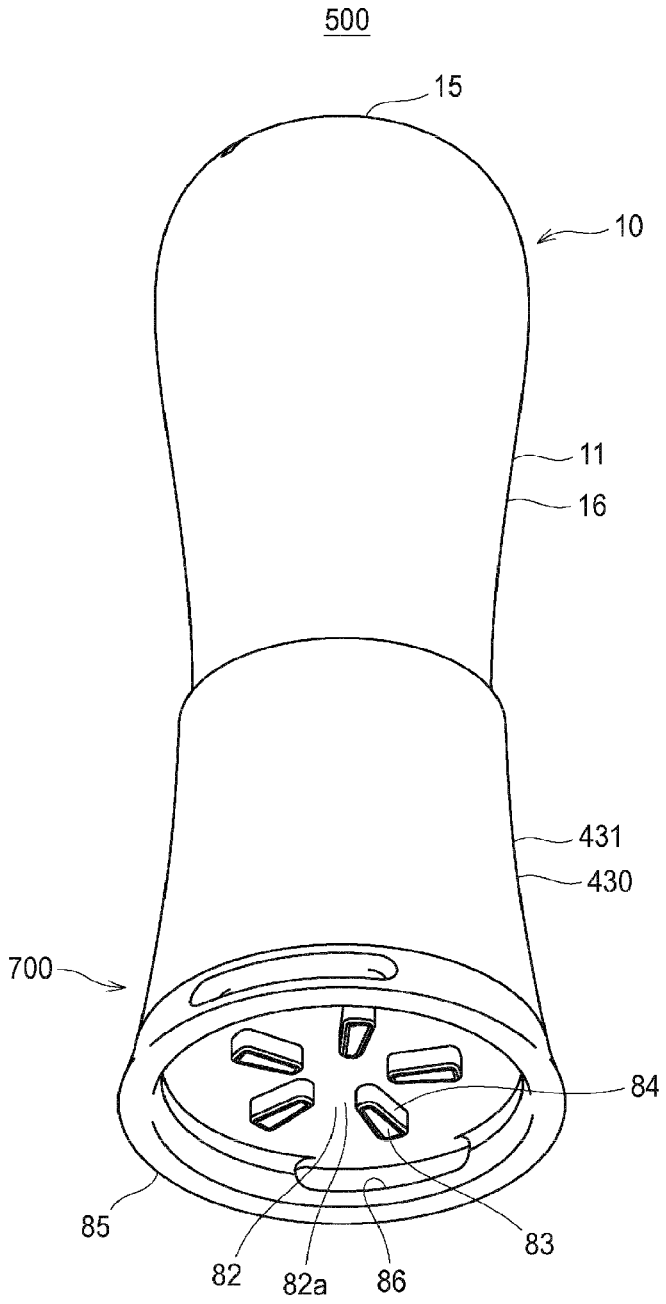
FIG. 32 is a perspective view when the liquid agent discharge container according to the eleventh embodiment is viewed from a lower side thereof.

As one example, as shown in FIG. 32, the discharge port 83 is constituted by plural openings which are arranged radially so that the shape of the liquid agent 101 discharged from the discharge port 83 has a shape simulating a petal.

However, the shape of the discharge port 83 may have another shape.

Furthermore, the discharge port 83 may be constituted by a single opening, and the shape of the opening may be a non-circular shape. Also in this case, the liquid agent 101 discharged from the discharge port 83 can be formed into a predetermined intended shape.

As described above, in the case of the present embodiment, the liquid agent 101 discharged from the discharge port 83 has been formed in a predetermined intended shape. In the liquid agent discharge container 500 according to the present embodiment, like the first embodiment, the discharge port 83 forms the liquid agent into a predetermined intended shape and discharges the liquid agent. The discharged liquid agent 101 is a liquid agent molded object which is formed in a predetermined intended shape.

However, the present invention is not limited to this example, and the liquid agent 101 discharged from the discharge port 83 may have a circular shape, or may have other unspecified shapes.

Furthermore, it is preferable that the viscosity of the liquid agent 101 in the container main body 10 is equal to or more than 1,000 mPa-s and equal to or less than 100,000 mPa-s at 20° C. The viscosity of the liquid agent 101 at 20° C. is more preferably equal to or more than 10,000 mPa-s and equal to or less than 80,000 mPa·s, further preferably equal to or more than 30,000 mPa·s and equal to or less than 60,000 mPa-s. The viscosity of the liquid agent 101 is measured with a B type viscometer. In the measurement based on the B type viscometer, for example, an appropriate rotor or spindle is selected according to the dosage form and viscosity of the liquid agent 101, the rotor or spindle is rotated at a rotational speed corresponding to it (50 to 60 rpm), and the viscosity at the time when the rotation time reaches 60 seconds can be measured.

The viscosity of the liquid agent 101 being equal to or more than 1,000 mPa-s and equal to or less than 100,000 mPa-s at 20° C. makes it possible to appropriately form the liquid agent 101 discharged from the discharge port 83 into a predetermined intended shape.

The third head member 430 includes a tube-shaped (for example, substantially cylindrical) tubular portion 431, and an annular inner flange portion 432 protruding inward from the inner peripheral surface of the tubular portion 431. An opening 432*a* is formed in the inner flange portion 432. The inner flange portion 432 is arranged at a position which is spaced upward apart from the lower end of the tubular portion 431.

As shown in FIG. 30, the plate-like portion 441 of the first head member 440 and the fitting wall 857 of the second head member 80 are successively fitted, in this order, into a lower portion of the tubular portion 431 of the third head member 430, the lower portion being located below the inner flange portion 432, whereby the first head member 440 and the second head member 80 are assembled to the third head member 430 to constitute the liquid agent discharge head 700.

Furthermore, the lower end portion of the tubular portion 422 of the cap 90 is press-fitted into the gap between the outer peripheral surface of the inner tubular portion 442 of the first head member 440 and the inner peripheral surface of the outer tubular portion 443, whereby the first head member 440, and thus the entirety of the liquid agent discharge head 700 is fixed to the cap 90.

The outer shape of the liquid agent discharge container 500 according to the present embodiment is roughly the same as the outer shape of the foam discharge container 100 according to the tenth embodiment described above.

That is, as shown in FIG. 30, the liquid agent discharge container 500 is capable of self-standing while the pushing portion 85 is in contact with the placement surface with the discharge port 83 facing in the downward direction.

The top portion 15 of the container main body 10 when the liquid agent discharge container 500 is self-standing while the pushing portion 85 is in contact with the placement surface is formed in a hemispherical shape protruding upward.

At least the lower portion of the liquid agent discharge cap 600 when the liquid agent discharge container 500 is self-standing while the pushing portion 85 is in contact with the placement surface is formed in a wide-based shape.

More specifically, at least the lower portion of the tubular portion 431 and the pushing portion 85 has a wide-based shape (gradually increasing in diameter downward).

The outer peripheral surface of the liquid agent discharge cap 600 has a surface which is continuously curved from the tubular portion 431 to the pushing portion 85, and a portion containing the lower portion of the tubular portion 431 and the pushing portion 85 is wide based.

In the case of the present embodiment, an upper end portion 431*a* of the tubular portion 431 covers the periphery of the lower end portion of the body portion 11. The tubular portion 431 is arranged coaxially with the body portion 11 of the container main body 10. A gap 703 between the inner peripheral surface of the upper end portion 431*a* and the outer peripheral surface of the lower end portion of the body portion 11 is set to be narrow to the extent that the tubular portion 431 and the body portion 11 guide each other when the pushing operation is performed on the container main body 10.

As described above, the container main body 10 has the neck portion, and the liquid agent discharge cap 600 has the tubular mounting portion 111 which is mounted on the neck portion while surrounding the neck portion, and the tubular portion 431 which extends from the pushing portion 85 to the container main body 10 side and is arranged coaxially with the container main body 10. In the pushing operation described above, the tubular portion 431 and the container main body 10 guide each other.

However, the present invention is not limited to this example. The upper end portion 431*a* of the tubular portion 431 may cover the periphery of the mounting portion ill, the upper end portion 431*a* may be arranged coaxially with the mounting portion 111, and the tubular portion 431 and the mounting portion 111 may guide each other in the pushing operation.

Furthermore, the upper end portion 431*a* of the tubular portion 431 may cover the peripheries of the mounting portion 111 and the lower end portion of the body portion 11, and be arranged coaxially with the mounting portion 111 and the lower end portion of the body portion 11, and the tubular portion 431 and the mounting portion 111, the container main body 10 may guide each other in the pushing operation.

Furthermore, the liquid agent discharge head 700 may not include the third head member 430. That is, the liquid agent discharge head 700 may be constituted by assembling the first head member 440 and the second head member 80 to each other.

Furthermore, in the present embodiment, like the tenth embodiment, air may be allowed to be released to the outside of the liquid agent discharge container 500 via the gap 703.

That is, the container main body 10 has the neck portion, and the liquid agent discharge cap 600 has the tubular mounting portion 111 mounted on the neck portion while surrounding the neck portion, and the tubular portion 431 which extends from the pushing portion 85 to the container main body 10 side and covers the periphery of the mounting portion 111 or the container main body 10. The pushing portion 85 is an annular standing wall which surrounds the periphery of the discharge port 83 and stands in the opposite direction (downward in the present embodiment) beyond the discharge port 83, and the internal space of the pushing portion 85 may intercommunicate with the external space of the liquid agent discharge container 500 through the internal space of the tubular portion 431 and the gap 703 between the inner peripheral surface of the tubular portion 431 and the outer peripheral surface of the mounting portion 111 or the container main body 10.

In order to realize such a configuration, for example, holes which vertically penetrate through the plate-like portion 82*a* and the plate-like portion 441 respectively may be formed in the plate-like portion 82*a* and the plate-like portion 441, and the size of the gap 703 may be made sufficiently large.

Such a configuration makes it possible to easily release the atmosphere (air) in the internal space of the pushing portion 85 to the external space of the liquid agent discharge container 500 through the internal space of the tubular portion 431 and the gap 703 when the liquid agent 101 is discharged from the discharge port 83.

In this case, the hole 86 may not be formed in the pushing portion 85.

In the eleventh embodiment described above, the example in which the liquid agent discharge container 500 is a delamination container has been described. However, the liquid agent discharge container 500 may be a container having the container main body 10 having a single layer structure.

In this case, the shape of the dip tube 130 may be the same bent shape as that of the eighth to tenth embodiments, and the tip 131 may be positioned in the vicinity of the lower end portion of the body portion 11. As a result, the tip 131 can be soaked in the liquid agent 101 while the discharge port 83 is placed to face downward.

That is, the liquid agent discharge cap 600 has a dip tube 130 for supplying the liquid agent 101 in the container main body 10 to the pump portion 120, and it is possible to adopt a structure in which the suction port of the tip 131 of the dip tube 130 is located below the liquid level of the liquid agent 101 in the container main body 10 while the discharge port 83 is placed to face downward.

Furthermore, in the foregoing eleventh embodiment, the liquid agent discharge container 500 may be a well-known popple container. The popple container is a container having an airless pump, and an inner tray is provided inside the container main body 10 having shape retainability so as to be slidable vertically. In this case, the liquid agent 101 is stored in a region above the inner tray. The popple container is particularly preferably used when the liquid agent 101 has a high viscosity. When the liquid agent 101 in the container main body 10 decreases and thus the internal pressure of the container main body 10 decreases, the inner tray is pulled by the liquid agent 101 having a high viscosity and moved to the neck portion side.

The present invention is not limited to the above-described embodiments, but includes various modifications, improvements, etc. as long as the object of the present invention is achieved.

For example, in each of the foregoing embodiments, the example in which the pushing portion 85 has an annular shape (the annular shape described here is not limited to a circular ring, but includes, for example, a polygonal annular shape such as a square ring or a triangular ring) has been described. However, the present invention is not limited to this example, and the pushing portion 85 may be, for example, one or plural rod-like bodies or the like standing up around the discharge port.

In the first to sixth embodiments described above, the example in which the pushing direction of the pushing operation (the pushing direction of the foam discharging head) is the downward direction has been described, but the pushing direction of the pushing operation is not particularly limited. For example, a foam discharge container whose pushing direction of the pushing operation is a horizontal direction can be placed on a wall.

In the first to tenth embodiments described above, the example in which the foam discharge container is the pump container using the foamer mechanism 20 has been described. However, the present invention is not limited to this example, and the foam discharge container may be an aerosol container which is filled with a liquid agent together with compressed gas in a container main body. In this case, it is preferable that the aerosol container is of such a type that a fixed amount of foam is discharged by one discharge operation.

In the foregoing, the example in which the holes 86 for causing the regions inside and outside the pushing portion 85 to mutually intercommunicate with each other are formed in the pushing portion 85 has been described, but the holes 86 may be formed in other sites.

For example, the holes 86 may be formed in a region outside the surrounding wall 87 in plan view in the plate-like portion 82*a* (a region into which no foam intrudes) and a region outside the surrounding wall 87 in plan view in the primary plate-like portion 74 or in the annular wall 81. Furthermore, the plate-like portions 82*a* and 182 may be formed in a curved surface shape.

In the foregoing, the example in which the foam discharge container, the foam discharge cap, and the foam discharge head have one of the protruding portion 88 and the inhibiting and guiding wall 180 has been described. However, the foam discharge container, the foam discharge cap, and the foam discharge head may have both the protruding portion 88 and the inhibiting and guiding wall 180.

When the shape and arrangement of the discharge port are set so that foam uniformly flows from the primary discharge port to the discharge port, the foam discharge container, the foam discharge cap, and the foam discharge head may not be provided with the protruding portion 88.

The container main body 10 of the foam discharge container 100 according to the foregoing first to tenth embodiments may also be a delamination container like the container main body 10 of the liquid agent discharge container 500 according to the eleventh embodiment.

Furthermore, the foregoing embodiments may be combined within a range in which the contents thereof do not conflict with one another.

The foregoing embodiments encompass the following technical concepts.

<1> A foam discharge container that discharges foam in response to a pushing operation, the foam discharge container comprising: a discharge port that is opened in an opposite direction of an operating direction of the pushing operation and discharges the foam; and a pushing portion that keeps a distance between a discharge target body receiving the foam and the discharge port constant.

<2> The foam discharge container according to <1>, wherein the discharge port is formed at a tip of a nozzle forming wall standing in the opposite direction, and the pushing portion extends beyond the discharge port in the opposite direction.

<3> The foam discharge container according to <2>, wherein the pushing portion is formed in a standing-wall shape surrounding the periphery of the discharge port, and has a hole or a notched portion which communicates an inside region and an outside region of the pushing portion with each other.

<4> The foam discharge container according to any one of <1> to <3>, comprising: a primary discharge port that discharges the foam; an anterior chamber in which the foam discharged from the primary discharge port spreads in an internal space; and a facing portion that is arranged so as to face the primary discharge port with the anterior chamber interposed between the facing portion and the primary discharge port and has the discharge port formed in the facing portion.

<5> The foam discharge container according to <3>, comprising: a primary plate-like portion having a primary discharge port that discharges the foam; an anterior chamber in which the foam discharged from the primary discharge port spreads in an internal space; and a facing portion that is arranged so as to face the primary discharge port with the anterior chamber interposed between the facing portion and the primary discharge port, and has the discharge port formed in the facing portion, wherein the facing portion is configured to include a plate-like portion that is arranged so as to face the primary plate-like portion with the anterior chamber interposed between the plate-like portion and the primary plate-like portion and has the discharge port formed in the plate-like portion, the anterior chamber is a region surrounded by a surrounding wall standing between the primary plate-like portion and the plate-like portion, and when the foam discharge container is viewed in the operating direction, the surrounding wall is accommodated inside the pushing portion, and the discharge port and the primary discharge port are accommodated inside the surrounding wall.

<6> The foam discharge container according to <4> or <5>, wherein when the foam discharge container is viewed in the operating direction, the facing portion covers at least a part of the primary discharge port.

<7> The foam discharge container according to <6>, wherein the facing portion is configured to include a protruding portion protruding toward the primary discharge port, and when the foam discharge container is viewed in the operating direction, the protruding portion overlaps at least a part of the primary discharge port.

<8> The foam discharge container according to any one of <4> to <7>, wherein the discharge port is configured to include a first discharge region and a second discharge region, and the foam discharge container includes one or both of an inhibiting portion that inhibits the foam discharged from the primary discharge port into the anterior chamber from flowing to the first discharge region, and a guiding portion that guides the foam discharged from the primary discharge port into the anterior chamber to the second discharge region.

<9> The foam discharge container according to any one of <1> to <8>, wherein the foam discharged from the discharge port has been formed in a predetermined intended shape.

<10> The foam discharge container according to any one of <1> to <9>, wherein the discharge port is configured to have a non-circular shape or include plural openings.

<11> A foam discharge cap that is used while mounted on a container main body storing a liquid agent and discharges foam in response to a pushing operation, the foam discharge cap comprising: a discharge port that is opened in an opposite direction of an operating direction of the pushing operation and discharges the foam; and a pushing portion that keeps a distance between a discharge target body receiving the foam and the discharge port constant.

<12> A foam discharge head that is used while mounted on a cap to be mounted on a container main body storing a liquid agent, and discharges foam in response to a pushing operation, the foam discharge head comprising: a discharge port that is opened in an opposite direction of an operating direction of the pushing operation and discharges the foam; and a pushing portion that keeps a distance between a discharge target body receiving the foam and the discharge port constant.

<13> The foam discharge container according to any one of the foregoing items, wherein the discharge port is formed in such a shape that the foam is shaped into the intended shape when the foam is discharged while the distance between the discharge port and the discharge target body is equal to a predetermined distance, and the pushing portion keeps the distance between the discharge target body and the discharge port to the predetermined distance.

Furthermore, the foregoing embodiments encompass the following technical concepts.

[1] A foam discharge container that discharges foam in response to a pushing operation, the foam discharge container comprising: a discharge port that is opened in an opposite direction of a pushing direction of the pushing operation and discharges the foam; and a pushing portion that keeps a distance between a discharge target body receiving the foam and the discharge port constant.

[2] The foam discharge container according to [1], wherein the discharge port is formed at a tip of a nozzle forming wall standing in the opposite direction, and the pushing portion extends beyond the discharge port in the opposite direction.

[3] The foam discharge container according to [1] or [2], wherein the pushing portion has a standing portion standing at a position which is away from the discharge port in an outward direction, and the pushing portion has the standing portion, and an intercommunicating portion which communicates an inside region and an outside region of the pushing portion with each other.

[4] The foam discharge container according to any one of [1] to [3], comprising: a primary discharge port that discharges the foam; an anterior chamber in which the foam discharged from the primary discharge port spreads in an internal space; and a facing portion that is arranged so as to face the primary discharge port with the anterior chamber interposed between the facing portion and the primary discharge port and has the discharge port formed in the facing portion.

[5] The foam discharge container according to any one of [1] to [4], comprising: a primary plate-like portion having a primary discharge port that discharges the foam; an anterior chamber in which the foam discharged from the primary discharge port spreads in an internal space; and a facing portion that is arranged so as to face the primary discharge port with the anterior chamber interposed between the facing portion and the primary discharge port, and has the discharge port formed in the facing portion, wherein the facing portion is configured to include a plate-like portion that is arranged so as to face the primary plate-like portion with the anterior chamber interposed between the plate-like portion and the primary plate-like portion and has the discharge port formed in the plate-like portion, the anterior chamber is a region surrounded by a surrounding wall standing between the primary plate-like portion and the plate-like portion, and when the foam discharge container is viewed in the pushing direction, the surrounding wall is accommodated inside the pushing portion, and the discharge port and the primary discharge port are accommodated inside the surrounding wall.

[6] The foam discharge container according to [4] or [5], wherein when the foam discharge container is viewed in the pushing direction, the facing portion covers at least a part of the primary discharge port.

[7] The foam discharge container according to any one of [4] to [6], wherein the facing portion is configured to include a protruding portion protruding toward the primary discharge port, and when the foam discharge container is viewed in the pushing direction, the protruding portion overlaps at least a part of the primary discharge port.

[8] The foam discharge container according to any one of [4] to [7], wherein the discharge port is configured to include a first discharge region and a second discharge region, and the foam discharge container includes one or both of an inhibiting portion that inhibits the foam discharged from the primary discharge port into the anterior chamber from flowing to the first discharge region, and a guiding portion that guides the foam discharged from the primary discharge port into the anterior chamber to the second discharge region.

[9] The foam discharge container according to any one of [1] to [8], wherein the foam discharged from the discharge port has been formed in a predetermined intended shape.

[10] The foam discharge container according to any one of [1] to [9], wherein the discharge port is configured to have a non-circular shape or include plural openings.

[11] The foam discharge container according to any one of [1] to [10], comprising: a container main body that stores a liquid agent; and a foam discharge cap that is mounted on the container main body and discharges the foam in response to the pushing operation, wherein the foam discharge cap includes the discharge port and the pushing portion, and further includes a pump portion that makes the foam from the liquid agent upon movement of the container main body relative to the pushing portion in the opposite direction and discharges the foam from the discharge port, and the container main body is an operating portion which is grasped and pushed by a user in the pushing operation.

[12] The foam discharge container according to [11], wherein the foam discharge container is capable of self-standing while the pushing portion is in contact with a placement surface with the discharge port facing in a downward direction.

[13] The foam discharge container according to [11] or [12], wherein at least lower portion of the foam discharge cap when the foam discharge container is self-standing while the pushing portion is in contact with a placement surface is formed in a wide-based shape.

[14] The foam discharge container according to any one of [11] to [13], wherein a top portion of the container main body when the foam discharge container is self-standing in a state where the pushing portion is in contact with a placement surface is formed in a curved shape protruding to an outside of the container main body.

[15] The foam discharge container according to any one of [1] to [14], wherein a portion on an opposite side of the discharge port in the foam discharge container is a non-placement portion at which the foam discharge container is incapable of self-standing in a posture that the portion is in contact with a ground.

[16] The foam discharge container according to any one of [11] to [15], wherein the foam discharge cap includes a dip tube that supplies the liquid agent in the container main body to the pump portion, and a suction port of a tip of the dip tube is located below a liquid level of the liquid agent in the container main body with the discharge port facing in a downward direction.

[17] The foam discharge container according to any one of [11] to [16], wherein the container main body has a neck portion, the foam discharge cap has a tubular mounting portion that is mounted on the neck portion while surrounding the neck portion, and a tubular portion that extends from the pushing portion to the container main body and covers a periphery of the mounting portion or the container main body, the pushing portion is an annular standing wall that surrounds a periphery of the discharge port and stands in the opposite direction beyond the discharge port, and an internal space of the pushing portion intercommunicates with an external space of the foam discharge container via an internal space of the tubular portion and a gap between an inner peripheral surface of the tubular portion and an outer peripheral surface of the mounting portion or the container main body.

[18] The foam discharge container according to any one of [11] to [17], wherein the container main body has a neck portion, the foam discharge cap has a tubular mounting portion that is mounted on the neck portion while surrounding the neck portion, and a tubular portion that extends from the pushing portion to the container main body side and is arranged coaxially with the mounting portion or the container main body, and the tubular portion and the mounting portion or the container main body guide each other in the pushing operation.

[19] The foam discharge container according to any one of [1] to [18], wherein the discharge port is formed in such a shape that the foam is shaped into the intended shape when the foam is discharged while a distance between the discharge port and the discharge target body is equal to a predetermined distance, and the pushing portion keeps the distance between the discharge target body and the discharge port to the predetermined distance.

[20] The foam discharge container according to any one of [1] to [19], wherein the foam discharged from the discharge port is a molded foamy object formed in a predetermined intended shape.

[21] The foam discharge container according to any one of [1] to [20], wherein the discharge target body and the discharge port are kept to be spaced apart from each other from a start stage to an end stage of a pushing operation.

[22] The foam discharge container according to any one of [1] to [21], wherein a liquid agent to be formed into foam is hand soap, facial cleanser, a cleansing agent, dishwashing detergent, hair dressing agent, body soap, shaving cream, skin cosmetic (foundation, essence, etc.), hair dye, antiseptic, cream to be coated on food (such as bread), household detergent, disinfectant, or detergent for clothing (for partial washing or the like).

[23] The foam discharge container according to any one of [1] to [22], wherein the viscosity of the liquid agent serving as the foam is equal to or more than 1 mPa·s and equal to or less than 20 mPa·s at 20° C.

[24] The foam discharge container according to any one of [1] to [23], comprising a container main body that stores a liquid agent; and a foam discharge cap that is mounted on the container main body and discharges the foam in response to the pushing operation, wherein the foam discharging cap has the discharge port and the pushing portion.

[25] The foam discharge container according to any one of [1] to [24], wherein the foam discharge container is a manual pump container (pump foamer), and has a foamer mechanism for foaming a liquid agent.

[26] The foam discharge container according to any one of [1] to [25], wherein the upper end surface of the pushing portion is formed in an annular shape in plan view and is arranged flatly and horizontally.

[27] The foam discharge container according to any one of [1] to [26], wherein the inner peripheral surface of the surrounding wall surrounds the discharge port (and the inner peripheral surface of the nozzle forming wall) at a shortest distance in plan view.

[28] The foaming discharge container according to any one of [1] to [27], wherein the inner peripheral surface of the surrounding wall (the entire or a part of the inner peripheral surface of the surrounding wall) is formed inside the outer peripheral surface of the nozzle forming wall in plan view.

[29] the foam discharge container according to any one of [1] to [28], wherein the height dimension of the pushing portion is equal to or more than twice of the height dimension of the nozzle forming wall, preferably equal to or more than 3 times, and equal to or less than 10 times, preferably equal to or less than 8 times.

[30] The foam discharge container according to any one of [1] to [29], wherein the height difference between the discharge port and the pushing portion is equal to or more than 5 mm and equal to or less than 20 mm, preferably equal to or more than 7 mm and equal to or less than 18 mm.

[31] The foam discharge container according to any one of [1] to [30], wherein the height dimension of the nozzle forming wall is equal to or more than 1 mm, preferably equal to or more than 2 mm, and equal to or less than 10 mm, preferably equal to or less than 8 mm.

[32] The foam discharge container according to any one of [1] to [31], wherein the pushing portion has a notched portion formed at an upper end thereof.

[33] The foam discharge container according to any one of [1] to [32], comprising a foamer mechanism that foams a liquid agent, wherein the foam discharge container squeezes foam generated by the foamer mechanism by the plate-like portion and the discharge port forming wall to discharge the foam from the discharge port.

[34] The foam discharge container according to any one of [1] to [33], comprising a mesh provided at an upper end of the discharge port forming wall.

[35] The foam discharge container device according to any one of [1] to [34], comprising a tubular portion that intercommunicates with an internal space of the nozzle forming wall to supply foam into the internal space of the nozzle forming wall, wherein the tubular portion and the nozzle forming wall are arranged coaxially with each other.

[36] The foam discharge container according to any one of [1] to [35], wherein the height position of the lower end of the hole or the notch portion is lower than the height position of the upper end of the nozzle forming wall.

[37] The foam discharge container according to any one of [1] to [36], comprising a tubular portion that intercommunicates with an internal space of the nozzle forming wall to supply foam to the internal space of the nozzle forming wall, and a table-like portion that is provided to an upper end portion of the tubular portion and has a flat upper surface, wherein the nozzle forming wall protrudes upward from the upper surface of the table-like portion, and the height position of the lower end of the hole or the notched portion is equal to the height position of the upper surface of the table-like portion.

[38] The foam discharge container according to any one of [1] to [37], comprising: a foam discharge head that includes the pushing portion and discharges foam in response to a pushing operation; and a container main body that stores a liquid agent to be made into foam, wherein a pushing operation on the foam discharge head is performed by pushing the container main body in a direction to the discharge target body while the pushing portion is caused to abut against the discharge target body.

[39] The foam discharge container according to any one of claims [1] to [38], wherein the foam discharge container is an upright and inverted foam discharge container that has a container main body storing a liquid agent and is usable in both of an upright state where the discharge port is placed to face in an upward direction and an inverted state where the discharge port is placed to face in a downward direction.

[40] A foam discharge cap that is used while mounted on a container main body storing a liquid agent, and discharges foam in response to a pushing operation, the foam discharge cap comprising: a discharge port that is opened in an opposite direction of a pushing direction of the pushing operation and discharges the foam; and a pushing portion that keeps a distance between a discharge target body receiving the foam and the discharge port constant.

[41] The foam discharge cap according to [40] used in the foam discharge container according to any one of [1] to [39].

[42] A foam discharge head that is used while mounted on a cap to be mounted on a container main body storing a liquid agent, and discharges foam in response to a pushing operation, the foam discharge head comprising: a discharge port that is opened in an opposite direction of a pushing direction of the pushing operation and discharges the foam; and a pushing portion that keeps a distance between a discharge target body receiving the foam and the discharge port constant.

[43] The foam discharge head according to [42] used while mounted on the foam discharge cap according to [40].

[44] A foam discharge method of attaching foam to a discharge target body by using the foam discharge container according to [39], the foam discharge method comprising: performing a pushing operation on the pushing portion or the container main body while the pushing portion is caused to abut against the discharge target body to shorten a relative distance between the pushing portion and the container main body, thereby attaching foam discharged from the discharge port to the discharge target body.

[45] A liquid agent discharge container that discharges a liquid agent in response to a pushing operation, the liquid agent discharge container comprising: a container main body that stores a liquid agent; and a liquid agent discharge cap that is mounted on the container main body, and discharges the liquid agent in response to the pushing operation, wherein the liquid agent discharge cap includes a discharge port which is opened in a direction opposite to a pushing direction of the pushing operation and discharges the liquid agent, a pushing portion that keeps a distance between a discharge target body receiving the liquid agent and the discharge port constant, and a pump portion that discharges the liquid agent from the discharge port upon movement of the container main body relative to the pushing portion in the opposite direction, and the container main body is an operating portion to be grasped and pushed by a user in the pushing operation.

[46] The liquid agent discharge container according to [45], wherein the liquid agent discharge container is capable of self-standing while the pushing portion is in contact with a placement surface with the discharge port facing in a downward direction.

[47] The liquid agent discharge container according to [45] or [46], wherein at least lower portion of the liquid agent discharge cap when the liquid agent discharge container is self-standing while the pushing portion is in contact with a placement surface is formed in a wide-based shape.

[48] The liquid agent discharge container according to any one of [45] to [47], wherein a top portion of the container main body when the liquid agent discharge container is self-standing while the pushing portion is in contact with a placement surface is formed in a curved shape protruding to an outside of the container main body.

[49] The liquid agent discharge container according to any one of [45] to [48], wherein a portion on an opposite side of the discharge port in the foam discharge container is a non-placement portion at which the foam discharge container is incapable of self-standing in a posture that the portion is in contact with a ground.

[50] The liquid agent discharge container according to any one of [45] to [49], wherein the liquid agent discharge cap includes a dip tube that supplies the liquid agent in the container main body to the pump portion, and a suction port of a tip of the dip tube is located below a liquid level of the liquid agent in the container main body with the discharge port facing in a downward direction.

[51] The liquid agent discharge container according to any one of [45] to [50], wherein the container main body has a neck portion, the liquid agent discharge cap has a tubular mounting portion that is mounted on the neck portion while surrounding the neck portion, and a tubular portion that extends from the pushing portion to the container main body side and covers a periphery of the mounting portion or the container main body, the pushing portion is an annular standing wall that surrounds a periphery of the discharge port and stands in the opposite direction beyond the discharge port, and an internal space of the pushing portion intercommunicates with an external space of the liquid agent discharge container via an internal space of the tubular portion and a gap between an inner peripheral surface of the tubular portion and an outer peripheral surface of the mounting portion or the container main body.

[52] The liquid discharge container according to any one of [45] to [51], wherein the container main body has a neck portion, the liquid agent discharge cap has a tubular mounting portion that is mounted on the neck portion while surrounding the neck portion, and a tubular portion that extends from the pushing portion to the container main body side and is arranged coaxially with the mounting portion or the container main body, and the tubular portion and the mounting portion or the container main body guide each other in the pushing operation.

[53] The liquid agent discharge container according to any one of [45] to [52], wherein a viscosity of the liquid agent in the container main body is equal to or more than 1,000 mPa·s and equal to or less than 100,000 mPa·s at 20° C.

[54] The liquid agent discharge container according to any one of [45] to [53], wherein the liquid agent discharged from the discharge port has been formed in a predetermined intended shape.

[55] The liquid agent discharge container according to any one of [45] to [54], wherein the discharge port is configured to have a non-circular shape or include plural openings.

[56] The liquid agent discharge container according to any one of [45] to [55], wherein the discharge port is formed at a tip of a nozzle forming wall standing in the opposite direction, and the pushing portion extends beyond the discharge port in the opposite direction.

[57] The liquid discharge container according to any one of [45] to [56], wherein the pushing portion has a standing portion standing at a position spaced outward from the discharge port, and the pushing portion has the standing portion and an intercommunicating portion which communicates an inside region and an outside region of the pushing portion with each other.

[58] The liquid agent discharge container according to any one of [45] to [57], comprising a primary discharge port that discharges the liquid agent, an anterior chamber in which the liquid agent discharged from the primary discharge port spreads in an internal space, and a facing portion that is arranged so as to face the primary discharge port with the anterior chamber interposed between the facing portion and the primary discharge port, and has the discharge port formed in the facing portion.

[59] The liquid agent discharge container according to any one of [45] to [58], comprising a primary plate-like portion having a primary discharge port that discharges the liquid agent, an anterior chamber in which the liquid agent discharged from the primary discharge port spreads in an internal space, and a facing portion that is arranged so as to face the primary discharge port with the anterior chamber interposed between the facing portion and the primary discharge port and has the discharge port formed in the facing portion, wherein the facing portion is configured to include a plate-like portion that is arranged so as to face the primary plate-like portion with the anterior chamber interposed between the plate-like portion and the primary plate-like portion and has the discharge port formed in the plate-like portion, the anterior chamber is a region surrounded by a surrounding wall standing between the primary plate-like portion and the plate-like portion, and when the liquid agent discharge container is viewed in the pushing direction, the surrounding wall is accommodated inside the pushing portion while the discharge port and the primary discharge port are accommodated inside the surrounding wall.

[60] The liquid agent discharge container according to any one of [45] to [59], wherein when the liquid agent discharge container is viewed in the pushing direction, the facing portion covers at least a part of the primary discharge port.

[61] The liquid agent discharge container according to any one of [45] to [60], wherein the facing portion is configured to include a protruding portion protruding toward the primary discharge port, and when the liquid agent discharge container is viewed in the pushing direction, the protruding portion overlaps at least a part of the primary discharge port.

[62] The liquid agent discharge container according to any one of [45] to [61], wherein the discharge port is configured to include a first discharge region and a second discharge region, and the liquid agent discharge container includes one or both of an inhibiting portion that inhibits the liquid agent discharged from the primary discharge port into the anterior chamber from flowing to the first discharge region, and a guiding portion that guides the liquid agent discharged from the primary discharge port into the anterior chamber to the second discharge region.

[63] The liquid agent discharge container according to any one of [45] to [62], wherein the liquid agent discharged from the discharge port is formed in a predetermined intended shape.

[64] The liquid agent discharge container according to any one of [45] to [63], wherein the discharge port is configured to have a non-circular shape or include plural openings.

[65] The liquid agent discharge container according to any one of [45] to [64], wherein the discharge port is formed in such a shape that the liquid agent is shaped into the intended shape when the liquid agent is discharged while the distance between the discharge port and the discharge target body is equal to a predetermined distance, and the pushing portion keeps the distance between the discharge target body and the discharge port to the predetermined distance.

[66] The liquid agent discharge container according to any one of [45] to [65], wherein the liquid agent discharged from the discharge port is a liquid agent molded object formed in a predetermined intended shape.

[67] The liquid agent discharge container according to any one of [45] to [66], wherein the discharge target body and the discharge port are kept to be spaced apart from each other from a start stage to an end stage of the pushing operation.

[68] The liquid agent discharge container according to any one of [45] to [67], wherein an upper end surface of the pushing portion is formed in an annular shape in plan view and is arranged flatly and horizontally.

[69] The liquid agent discharge container according to any one of [45] to [68], wherein an inner peripheral surface of the surrounding wall surrounds the discharge port (and an inner peripheral surface of the nozzle forming wall) at a shortest distance in plan view.

[70] The liquid agent discharge container according to any one of [45] to [69], wherein an inner peripheral surface of the surrounding wall (the whole or a part of the inner peripheral surface of the surrounding wall) is formed inside an outer peripheral surface of the nozzle forming wall in plan view.

[71] The liquid agent discharge container according to any one of [45] to [70], wherein the height dimension of the pushing portion is equal to or more than twice of the height dimension of the nozzle forming wall, preferably equal to or more than three times, and equal to or less than ten times, preferably equal to or less than eight times.

[72] The liquid agent discharge container according to any one of [45] to [71], wherein the height difference between the discharge port and the pushing portion is equal to or more than 5 mm and equal to or less than 20 mm, preferably equal to or more than 7 mm and equal to or less than 18 mm.

[73] The liquid agent discharge container according to any one of [45] to [72], wherein the height dimension of the nozzle forming wall is equal to or more than 1 mm, preferably equal to or more than 2 mm, and equal to or less than 10 mm, preferably equal to or less than 8 mm.

[74] The liquid agent discharge container according to any one of [45] to [73], wherein the container main body is a delamination container configured to include an outer shell and an inner bag accommodated inside the outer shell.

The present application claims priority rights based on Japanese Patent Application No. 2016-191988 filed on Sep. 29, 2016, Japanese Patent Application No. 2017-104707 filed on May 26, 2017 and Japanese Patent Application No. 2017-181346 filed on Sep. 21, 2017, and incorporates herein all of the disclosures thereof.

DESCRIPTION OF SYMBOLS

10 container main body
11 body portion
12 shoulder portion
13 neck portion
14 bottom portion
15 top portion
16 outer shell
17 inner bag
18 introduction portion
20 foamer mechanism
21 gas-liquid mixing portion
30 anterior chamber
40 discharge target body
50 mesh holding ring
51 mesh
60 ring member
70 first head member
701 second outer tubular portion
701*a* upper portion
701*b* lower portion
701*c* upper end portion
702 connecting portion
703 gap
704 engaging portion
705 opening
71 tubular portion
71*a* upper portion
72 holding portion
73 primary discharge port
74 primary plate-like portion
75 annular wall
75*a* opening
76 outer tubular portion
77 table-like portion
80 second head member
81 annular wall
82 facing portion
82*a* plate-like portion
83 discharge port
83*a* first portion
83*b* second portion
831 opening
84 nozzle forming wall
84*a* first wall portion
84*b* second wall portion
85 pushing portion
85*a* opening
851 pillar-shaped portion
852 annular portion
853 connecting portion
854 opening
856 engaging portion
857 fitting wall
86 hole
87 surrounding wall
88 protruding portion
89 notched portion
90 cap
100 foam discharge container
101 liquid agent
110 cap member
111 mounting portion
112 annular blocking portion
113 standing tubular portion
120 pump portion
129 tube holding portion
130 dip tube
131 tip
132 base end
140 piston guide
150 molded foamy object (foam)
150*a* first portion
150*b* second portion
151 foamy body
170 head member
171 tubular portion
171*a* primary discharge port
182 plate-like portion
183 discharge port
184 discharge port forming wall
185 pushing portion
185*a* opening
177 mesh
180 inhibiting and guiding wall (inhibiting portion, guiding portion)
181 sloped wall surface
190 ball valve
200 foam discharge cap
300 foam discharge head
410 fitting portion
421 annular portion
422 tubular portion
430 third head member
431 tubular portion
431*a* upper end portion
432 inner flange portion
432*a* opening
440 first head member
441 plate-like portion
442 inner tubular portion
443 outer tubular portion
500 liquid agent discharge container
600 liquid agent discharge cap
700 liquid agent discharge head

The invention claimed is:

1. A foam discharge container that discharges foam in response to a pushing operation, the foam discharge container comprising:

a discharge port that is opened in an opposite direction of a pushing direction of the pushing operation and discharges the foam; and a pushing portion that keeps a distance between a discharge target body receiving the foam and the discharge port constant, wherein the discharge port is an opening at a tip of a nozzle forming wall standing in the opposite direction, the pushing portion is an annular standing wall that surrounds a periphery of the discharge port and stands in the opposite direction beyond the discharge port, the annular standing wall has an opening at a tip thereof in the opposite direction, and there are no obstacles between the discharge port and the opening of the annular standing wall.

2. The foam discharge container according to claim 1, wherein the pushing portion has a standing portion standing at a position which is away from the discharge port in an outward direction, and the pushing portion has the standing portion, and an intercommunicating portion which communicates an inside region and an outside region of the pushing portion with each other.

3. The foam discharge container according to claim 2, comprising:

a primary plate-like portion having a primary discharge port that discharges the foam;

an anterior chamber in which the foam discharged from the primary discharge port spreads in an internal space; and a facing portion that is arranged so as to face the primary discharge port with the anterior chamber interposed between the facing portion and the primary discharge port, and has the discharge port formed in the facing portion, wherein the facing portion is configured to include a plate-like portion that is arranged so as to face the primary plate-like portion with the anterior chamber interposed between the plate-like portion and the primary plate-like portion and has the discharge port formed in the plate-like portion, the anterior chamber is a region surrounded by a surrounding wall standing between the primary plate-like portion and the plate-like portion, and when the foam discharge container is viewed in the pushing direction, the surrounding wall is accommodated inside the pushing portion, and the discharge port and the primary discharge port are accommodated inside the surrounding wall.

4. The foam discharge container according to claim 1, comprising:

a primary discharge port that discharges the foam;

an anterior chamber in which the foam discharged from the primary discharge port spreads in an internal space; and a facing portion that is arranged so as to face the primary discharge port with the anterior chamber interposed between the facing portion and the primary discharge port and has the discharge port formed in the facing portion.

5. The foam discharge container according to claim 4, wherein when the foam discharge container is viewed in the pushing direction, the facing portion covers at least a part of the primary discharge port.

6. The foam discharge container according to claim 5, wherein the facing portion is configured to include a protruding portion protruding toward the primary discharge port, and when the foam discharge container is viewed in the pushing direction, the protruding portion overlaps at least a part of the primary discharge port.

7. The foam discharge container according to claim 4, wherein the discharge port is configured to include a first discharge region and a second discharge region, and the foam discharge container includes one or both of an inhibiting portion that inhibits the foam discharged from the primary discharge port into the anterior chamber from flowing to the first discharge region, and a guiding portion that guides the foam discharged from the primary discharge port into the anterior chamber to the second discharge region.

8. The foam discharge container according to claim 1, wherein the foam discharged from the discharge port has been formed in a predetermined intended shape.

9. The foam discharge container according to claim 1, wherein the discharge port is configured to have a non-circular shape or include plural openings.

10. The foam discharge container according to claim 1, comprising:

a container main body that stores a liquid agent; and a foam discharge cap that is mounted on the container main body and discharges the foam in response to the pushing operation, wherein the foam discharge cap includes the discharge port and the pushing portion, and further includes a pump portion that makes the foam from the liquid agent upon movement of the container main body relative to the pushing portion in the opposite direction and discharges the foam from the discharge port, and the container main body is an operating portion which is grasped and pushed by a user in the pushing operation.

11. The foam discharge container according to claim 10, wherein the foam discharge container is capable of self-standing in a state where the pushing portion is in contact with a placement surface with the discharge port facing in a downward direction.

12. The foam discharge container according to claim 10, wherein the container main body has a neck portion, the foam discharge cap has a tubular mounting portion that is mounted on the neck portion while surrounding the neck portion, and a tubular portion that extends from the pushing portion to the container main body and covers a periphery of the mounting portion or the container main body, and an internal space of the pushing portion intercommunicates with an external space of the foam discharge container via an internal space of the tubular portion and a gap between an inner peripheral surface of the tubular portion and an outer peripheral surface of the mounting portion or the container main body.

13. The foam discharge container according to claim 1, wherein the foam discharge container is an upright and inverted foam discharge container that has a container main body storing a liquid agent and is usable in both of an upright state where the discharge port is placed to face in an upward direction and an inverted state where the discharge port is placed to face in a downward direction.

14. A liquid agent discharge container that discharges a liquid agent in response to a pushing operation, the liquid agent discharge container comprising:

a container main body that stores a liquid agent; and a liquid agent discharge cap that is mounted on the container main body, and discharges the liquid agent in response to the pushing operation, wherein the liquid agent discharge cap includes a discharge port which is opened in a direction opposite of a pushing direction of the pushing operation and discharges the liquid agent, a pushing portion that keeps a distance between a discharge target body receiving the liquid agent and the discharge port constant, and a pump portion that discharges the liquid agent from the discharge port upon movement of the container main body relative to the pushing portion in the opposite direction, the container main body is an operating portion to be grasped and pushed by a user in the pushing operation, the discharge port is an opening at a tip of a nozzle forming wall standing in the opposite direction, the pushing portion is an annular standing wall that surrounds a periphery of the discharge port and stands in the opposite direction beyond the discharge port, the annular standing wall has an opening at a tip thereof in the opposite direction, and there are no obstacles between the discharge port and the opening of the annular standing wall.

15. The liquid agent discharge container according to claim 14, wherein the liquid agent discharge container is capable of self-standing while the pushing portion is in contact with a placement surface with the discharge port facing in a downward direction.

16. The liquid agent discharge container according to claim 14, wherein the liquid agent discharged from the discharge port has been formed in a predetermined intended shape.

* * * * *